US007137679B2

(12) United States Patent
Tsukada et al.

(10) Patent No.: US 7,137,679 B2
(45) Date of Patent: Nov. 21, 2006

(54) INK CONSUMPTION DETECTING METHOD, AND INK JET RECORDING APPARATUS

(75) Inventors: Kenji Tsukada, Nagano-Ken (JP); Munehide Kanaya, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 261 days.

(21) Appl. No.: 10/031,408

(22) PCT Filed: May 17, 2001

(86) PCT No.: PCT/JP01/04130

§ 371 (c)(1),
(2), (4) Date: Jan. 18, 2002

(87) PCT Pub. No.: WO01/87627

PCT Pub. Date: Nov. 22, 2001

(65) Prior Publication Data

US 2002/0105555 A1 Aug. 8, 2002

(30) Foreign Application Priority Data

May 18, 2000 (JP) ..... 2000-146983
May 18, 2000 (JP) ..... 2000-146985
May 18, 2000 (JP) ..... 2000-146986
Jun. 22, 2000 (JP) ..... 2000-187918

(51) Int. Cl.
*B41J 2/195* (2006.01)
*B41J 2/045* (2006.01)

(52) U.S. Cl. ..... 347/7; 347/70

(58) Field of Classification Search ..... 347/7, 347/19, 5, 37, 54, 62, 70, 68, 69, 71, 72; 73/290 V See application file for complete search history.

(56) References Cited

U.S. PATENT DOCUMENTS 3,110,980 A 11/1963 Westcott et al.
3,220,258 A 11/1965 Rod
3,394,589 A 7/1968 Tomioka
3,703,693 A 11/1972 Levinn
3,832,900 A 9/1974 Ross
3,889,247 A 6/1975 Voll
4,008,612 A 2/1977 Nagaoka et al.
4,107,994 A 8/1978 Sogo
4,196,625 A * 4/1980 Kern ..... 347/7
4,310,957 A 1/1982 Sachs
4,329,875 A 5/1982 Nolting et al.
4,337,470 A * 6/1982 Furukawa ..... 347/75

(Continued)

FOREIGN PATENT DOCUMENTS

CN 1274645 11/2000

(Continued)

OTHER PUBLICATIONS

Patent Abstracts of Japan, JP 11 020162 (Fuji Xerox Co. Ltd.) Published on Jan. 26, 1999.

(Continued)

*Primary Examiner*—Stephen Meier
*Assistant Examiner*—Leonard Liang
(74) *Attorney, Agent, or Firm*—Sughrue Mion, PLLC

(57) ABSTRACT

The present method detects an ink consumption condition in an ink cartridge loaded on an ink jet recording apparatus having a recording head for jetting ink drops, using a piezo-electric device mounted on the cartridge. The method detects the ink consumption condition using the piezo-electric device when the recording head is in a non-recording state. A complicated seal structure is not necessary and the ink residue can be detected surely.

3 Claims, 31 Drawing Sheets

U.S. PATENT DOCUMENTS 4,403,227 A 9/1983 Bertschy et al.
4,419,677 A 12/1983 Kasugayama et al.
4,479,982 A 10/1984 Nilsson et al.
4,570,482 A 2/1986 Murata et al.
4,594,891 A 6/1986 Benz et al.
4,604,633 A * 8/1986 Kimura et al. ..... 250/231.19
4,636,814 A 1/1987 Terasawa
4,677,448 A * 6/1987 Mizusawa et al. ..... 347/7
4,703,652 A 11/1987 Itoh et al.
4,770,038 A 9/1988 Zuckerwar et al.
4,796,782 A 1/1989 Wales et al.
4,811,595 A 3/1989 Marciniak et al.
4,853,718 A 8/1989 El Hatem et al.
4,935,751 A 6/1990 Hamlin
4,977,413 A * 12/1990 Yamanaka et al. ..... 200/83 N
4,984,449 A 1/1991 Caldwell et al.
4,984,457 A 1/1991 Morris
5,035,140 A 7/1991 Daniels et al.
5,068,836 A 11/1991 Steel
5,132,711 A * 7/1992 Shinada et al. ..... 347/19
5,179,389 A 1/1993 Arai et al.
5,233,369 A 8/1993 Carlotta et al.
5,247,832 A 9/1993 Umezawa et al.
5,264,831 A 11/1993 Pfeiffer
5,315,317 A 5/1994 Terasawa et al.
5,319,973 A 6/1994 Crayton et al.
5,353,631 A 10/1994 Woringer et al.
5,410,518 A 4/1995 Birkett
5,463,377 A 10/1995 Kronberg
5,473,353 A 12/1995 Soucemarianadin et al.
5,506,611 A * 4/1996 Ujita et al. ..... 347/86
5,524,486 A 6/1996 Hermann
5,583,544 A 12/1996 Stamer et al.
5,586,085 A 12/1996 Lichte
5,610,635 A 3/1997 Murray
5,616,929 A 4/1997 Hara
5,619,238 A 4/1997 Higuma et al.
5,675,367 A 10/1997 Scheffelin et al.
5,689,288 A 11/1997 Wimmer et al.
5,694,156 A * 12/1997 Hoisington et al. ..... 347/5
5,697,248 A 12/1997 Brown
5,712,667 A 1/1998 Sato
5,737,963 A 4/1998 Eckert et al.
5,747,689 A 5/1998 Hampo et al.
5,774,136 A 6/1998 Barbehenn et al.
5,788,388 A 8/1998 Cowger et al.
5,788,819 A 8/1998 Onishi et al.
5,793,705 A 8/1998 Gazis et al.
5,835,817 A * 11/1998 Bullock et al. ..... 347/19
5,841,454 A 11/1998 Hall et al.
5,877,997 A 3/1999 Fell
5,900,888 A * 5/1999 Kurosawa ..... 347/7
5,949,447 A 9/1999 Arai et al.
5,975,102 A 11/1999 Schalk
6,003,966 A 12/1999 Ahn
6,007,190 A 12/1999 Murray et al.
6,012,793 A 1/2000 Haigo
6,012,794 A * 1/2000 Nakano et al. ..... 347/7
6,024,429 A 2/2000 Coffy et al.
6,044,694 A * 4/2000 Anderson et al. ..... 73/54.41
6,050,669 A 4/2000 Yano et al.
6,089,686 A 7/2000 Thornton et al.
6,089,688 A * 7/2000 Froger et al. ..... 347/7
6,155,664 A 12/2000 Cook
6,164,744 A 12/2000 Froger et al.
6,254,212 B1 * 7/2001 Coudray et al. ..... 347/7
6,302,527 B1 10/2001 Walker
6,312,074 B1 11/2001 Walker
6,312,106 B1 11/2001 Walker
6,312,115 B1 11/2001 Hara et al.
6,344,658 B1 * 2/2002 Nakagawa et al. ..... 257/275
6,347,853 B1 * 2/2002 Kato ..... 347/7
6,361,136 B1 3/2002 Watanabe et al.
6,390,590 B1 5/2002 Hansburg
6,416,152 B1 * 7/2002 Matsuzaki et al. ..... 347/19
6,435,638 B1 8/2002 Wilson
6,438,500 B1 * 8/2002 Froger et al. ..... 702/55
6,470,744 B1 10/2002 Usui et al.
6,536,861 B1 3/2003 Usui et al.
6,799,820 B1 10/2004 Usui et al.
2002/0012015 A1 1/2002 Tsukada et al.
2002/0015068 A1 2/2002 Tsukada et al.
2002/0015084 A1 2/2002 Tsukada et al.
2002/0105555 A1 8/2002 Tsukada et al.
2002/0135623 A1 9/2002 Tsukada et al.
2002/0170353 A1 11/2002 Usui et al.
2003/0043216 A1 3/2003 Usui et al.
2003/0071862 A1 4/2003 Tsukada et al.
2003/0117450 A1 6/2003 Usui et al.
2003/0117451 A1 6/2003 Usui et al.
2003/0140694 A1 7/2003 Usui et al.

FOREIGN PATENT DOCUMENTS

EP 0 553 535 8/1993
EP 0 660 092 6/1995
EP 0 676 624 10/1995
EP 0 684 136 A2 11/1995
EP 0 684 136 A3 11/1995
EP 0803365 10/1997
EP 0 803 364 A3 6/1998
EP 0 853 236 A1 7/1998
EP 0860284 8/1998
EP 0 873 873 10/1998
EP 0 881 079 A2 12/1998
EP 0885731 12/1998
EP 0 881 079 A3 7/1999
EP 0956964 11/1999
EP 1 055 520 A1 11/2000
EP 1 088 668 4/2001
FR 2 572 519 A1 5/1999
GB 2 304 898 3/1997
JP 56-39413 4/1981
JP 56-39414 4/1981
JP 56-53078 5/1981
JP 57208260 A * 12/1982
JP 58-201027 11/1983
JP 58-205820 11/1983
JP 59-052422 4/1984
JP 56-061421 10/1984
JP 60-4820 1/1985
JP 62-95225 5/1987
JP 62-184856 8/1987
JP 63247047 10/1988
JP 63-295266 12/1988
JP 1-067530 5/1989
JP 3-038037 2/1991
JP 03-067657 3/1991
JP 03-169642 7/1991
JP 3-211907 9/1991
JP 3-218847 9/1991
JP 04135862 5/1992
JP 4-234670 8/1992
JP 5-025325 4/1993
JP 05-254142 10/1993
JP 5-318757 12/1993
JP 6-155762 6/1994
JP 06297726 10/1994
JP 07-137276 5/1995
JP 7-137291 5/1995
JP 07137291 * 5/1995
JP 8-34123 2/1996
JP 9-020013 1/1997
JP 09-029989 2/1997

| | | | |
|---|---|---|---|
| JP | 9-029991 | | 2/1997 |
| JP | 9-039263 | | 2/1997 |
| JP | 9-220216 | | 8/1997 |
| JP | 9-267488 | | 10/1997 |
| JP | 09-286121 | | 11/1997 |
| JP | 10-038662 | | 2/1998 |
| JP | 10-151753 | | 6/1998 |
| JP | 10-175312 | | 6/1998 |
| JP | 10-305590 | | 11/1998 |
| JP | 10305590 A | * | 11/1998 |
| JP | 10-323993 | | 12/1998 |
| JP | 10-323997 | | 12/1998 |
| JP | 11-010909 | | 1/1999 |
| JP | 11010909 A | * | 1/1999 |
| JP | 11020186 | | 1/1999 |
| JP | 11-048490 | | 2/1999 |
| JP | 11-277760 | | 10/1999 |
| JP | 11-334107 | | 12/1999 |
| JP | 2000-43287 | | 2/2000 |
| JP | 2000-190523 | | 7/2000 |
| JP | 2001-146030 | | 5/2001 |
| WO | WO 98/09139 | | 3/1998 |
| WO | WO 98/31548 | | 7/1998 |
| WO | WO 99/42293 | | 8/1999 |

OTHER PUBLICATIONS

Patent Abstracts of Japan, vol. 1995, No. 08, Sep. 29, 1995 & JP 07 137276 A (Canon Inc.) May 30, 1995 abstract.

Patent Abstracts of Japan vol. 1998, No. 05, Apr. 30, 1998 & JP 10 026549 A, Jan. 27, 1998 abstract.

Patent Abstracts of Japan, vol. 2000, No. 14, Mar. 5, 2001 & JP 2000 318183 A (Sony Corp.), Nov. 21, 2000 abstract.

Patent Abstracts of Japan, 02034353, vol. 014, No. 186.

Patent Abstracts of Japan, 07081290, vol. 1995, No. 06.

US 5,635,961, 06/1997, Sato (withdrawn)

* cited by examiner

PROCESS FLOW OF CONTROL MEANS WHEN POWER IS TURNED ON

PROCESS FLOW OF CONTROL MEANS DURING PRINTING

S130

PROCESS FLOW OF CONTROL MEANS DURING MAINTENANCE OF RECORDING HEAD

PROCESS FLOW OF CONTROL MEANS DURING PAPER FEED AND EJECTION

PROCESS FLOW OF CONTROL MEANS WHEN POWER IS TURNED OFF

PROCESS FLOW OF CONTROL MEANS WHEN POWER IS TURNED OFF

INK CONSUMPTION DETECTING METHOD, AND INK JET RECORDING APPARATUS

TECHNICAL FIELD

The present invention relates to a method for detecting the ink consumption condition in an ink container of an ink jet recording apparatus and an ink jet recording apparatus to which the method is applied.

BACKGROUND ART

As an ink container to which the present invention is applied, an example of an ink cartridge mounted on an ink jet recording apparatus in a removable state will be explained. An ink jet recording apparatus generally has a pressure generation means for pressurizing a pressure generation chamber, a carriage in which an ink jet recording head having a nozzle opening for jetting pressurized ink from it as ink drops is loaded, and an ink container for storing ink to be fed to the recording head via a flow path and is structured so as to realize continuous printing. The ink container is generally structured as a cartridge attached to the recording apparatus in a removable state so as to be simply exchanged by a user at the point of time when ink is consumed.

Conventionally, as a control method for controlling the ink consumption of the ink cartridge, a method for calculating the count of ink drops jetted by the recording head and the ink amount sucked at the maintenance step of the recording head by software and controlling the ink consumption by calculation and a method for attaching two electrodes for liquid level detection directly to the ink cartridge, thereby detecting the point of time when a predetermined amount of ink is consumed actually and controlling the ink consumption are known.

However, in the method for calculating the jet count of ink drops and the sucked ink amount by software and controlling the ink consumption by calculation, depending on the use environment, for example, changes in the temperature and humidity in the room, the elapsed time after opening the ink cartridge, and differences in the use frequency on the user side, the pressure in the ink cartridge and ink viscosity are changed and an unnegligible error is often caused between the calculated ink consumption and the actual consumption. In this case, a problem arises that, although there is no ink actually, ink is calculated as if it still exists and detection of ink exhaust is delayed, or reversely, although there is still plenty of ink actually, ink is calculated as ink exhaust and ink is wasted. Furthermore, a problem also arises that even if a difference is generated between the calculated ink consumption and the actual ink consumption, it is difficult to correct it halfway. Further, a problem also arises that it is difficult to feed back changes in the ink characteristics due to the use environment to measurement of the subsequent ink consumption condition. Further, a problem also arises that when the same cartridge is removed once and mounted again, the calculated count is reset once, so that the actual ink residue cannot be known at all.

On the other hand, the method for controlling the point of time of ink consumption by the electrodes can detect the actual amount at a certain point of ink consumption, thereby can control the ink residue highly reliably. However, the ink level is to be detected, thus ink must be conductive, so that the kind of ink to be used is limited. Further, a problem arises that the liquid-tight structure between the electrodes and the ink cartridge is complicated. Furthermore, as a material of the electrodes, a highly conductive and corrosion-resistant noble metal is generally used, so that a problem also arises that the manufacturing cost of ink cartridges is increased. Furthermore, the two electrodes must be mounted respectively at different positions of the ink cartridge, so that a problem also arises that the number of the manufacturing steps are increased and the manufacturing cost is increased consequently.

Further, the conventional method for controlling the ink consumption of the ink cartridge detects the ink consumption even during recording of the recording head, so that the central processing unit (CPU) of the ink jet recording apparatus is used to detect the ink consumption condition, and the time to be used for recording by the CPU is reduced, and the recording speed is lowered. Further, in an on-carriage ink cartridge which is mounted on a carriage and moves together with the carriage, when the ink consumption condition is detected at the time of recording of the recording head, the ink cartridge itself and the ink in the ink cartridge vibrate and the ink consumption condition cannot be detected accurately.

Further, when a sensor for detecting the ink residue in the ink cartridge is attached in the ink cartridge, if the ink in the ink cartridge is consumed, the sensor detects that there is no ink in the ink cartridge.

However, even when the sensor detects that there is no ink in the ink cartridge, some amount of ink may remain in the ink cartridge. For example, ink may be collected or hardened in a complicatedly-shaped part of the groove or hole. Further, when air bubbles are attached in the neighborhood of the actuator or the sensor is attached to a position slightly above the bottom of the ink cartridge, if the ink level is below the mounting position of the sensor, the sensor detects absence of ink. In this case, a user cannot effectively use ink remaining in the ink cartridge.

Furthermore, the conventional control method for ink in the ink cartridge often measures the ink consumption condition always and unnecessarily. Further, regardless of the ink residue, the conventional method measures the ink residue at a uniform measuring interval, so that a problem arises that, when the measuring interval is long, the opportunity for detecting ink end at appropriate timing is lost.

Further, during and immediately after movement of the carriage, ink in the ink cartridge is often not in a rest state. Particularly, when the ink residue is small, the ink tends to wave. When the ink in the ink cartridge waves like this, during measurement of the ink consumption condition, ink makes or does not make contact with the measuring member. Therefore, a problem also arises that, although some ink remains still, ink end is detected by mistake, or although ink is almost exhausted, presence of ink is detected by mistake.

The present invention was made with the foregoing in view and is intended to provide an ink consumption condition detection method and an ink jet recording apparatus for detecting the ink residue accurately and requiring no complicated seal structure. Another object of the present invention is to provide an ink consumption condition detection method and an ink jet recording apparatus for detecting the ink consumption condition accurately without lowering the recording speed.

Further, the present invention provides an ink consumption condition detection method and an ink jet recording apparatus for effectively using ink remaining in the ink cartridge.

Further, the present invention is intended to provide an ink consumption condition detection method and an ink jet recording apparatus for effectively measuring the ink consumption condition and properly measuring the ink consumption condition without maldetection even if the ink residue is reduced.

DISCLOSURE OF INVENTION

The present invention is an ink consumption condition detection method for detecting an ink consumption condition in an ink container loaded in an ink jet recording apparatus having a recording head for jetting ink drops, wherein said ink consumption condition in said ink container is detected using a piezo-electric device having a piezo-electric element during a non-recording state of said recording head.

Preferably, said ink consumption condition in said ink container is detected using said piezo-electric device during a maintenance operation for cleaning said recording head.

Preferably, said ink consumption condition in said ink container is detected using said piezo-electric device during an operation for feeding or ejecting a recording medium, to which ink is jetted from said recording head, to or from said recording apparatus.

Preferably, said ink consumption condition in said ink container is detected using said piezo-electric device when power of said recording apparatus is turned on.

Preferably, said ink consumption condition in said ink container is detected using said piezo-electric device during a period from turning said recording apparatus off to a stop of said recording apparatus.

Preferably, said ink container is an ink cartridge loaded on a carriage for moving said recording head back and forth in a removable state, and said ink consumption condition in said ink cartridge is detected using said piezo-electric device during a period in which said carriage is stopped.

Preferably, said ink consumption condition in said ink cartridge is detected using said piezo-electric device after a predetermined time lapses from the beginning of a stop state of said carriage.

Preferably, said piezo-electric device detects changes in acoustic impedance, thereby detects said ink consumption condition in said ink container.

Preferably, said piezo-electric element of said piezo-electric device has a vibration part, and said piezo-electric device detects changes in said acoustic impedance on the basis of counter electromotive force generated by residual vibration remaining in said vibration part, thereby detects said ink consumption condition in said ink container.

Preferably, the method further comprises the steps of: storing information of said ink consumption condition in said ink container detected by said piezo-electric device in a storage unit mounted on said ink container, reading said information of said ink consumption condition stored in said storage unit, and judging whether a detection of said ink consumption condition in said ink container should be executed or not on the basis of said read information of said ink consumption condition.

Preferably, said ink container is an ink cartridge loaded on a carriage for moving said recording head back and forth in a removable state, said method comprising: a consumption condition detection step of detecting, in a non-recording state of said recording head, said ink consumption condition in said ink cartridge by said piezo-electric device, and a reconfirming step of redetecting said ink consumption condition in said ink cartridge by said piezo-electric device after detection of absence of ink in said ink cartridge by said consumption condition detection step.

Preferably, said reconfirmation step comprises: a carriage moving step of moving said carriage after absence of ink in said ink cartridge is detected by said consumption condition detection step, and a consumption condition redetection step of redetecting said ink consumption condition in said ink cartridge in a predetermined timing.

Preferably, said carriage moving step moves said carriage at a faster speed than a speed for moving said carriage during a recording operation.

Preferably, a shock is given to said ink cartridge during moving said carriage by said carriage moving step.

Preferably, said consumption condition redetection step is executed when a predetermined time passes after said carriage moving step ends.

Preferably, said consumption condition redetection step is executed during moving said carriage by said carriage moving step.

Preferably, said carriage moving step moves said carriage back and forth, and, when said carriage almost returns and moves from a forward path to a backward path, said consumption condition redetection step redetects said ink consumption condition.

Preferably, said carriage moving step moves said carriage back and forth, and, immediately after said carriage ends moving on a forward path and starts moving on a backward path, said consumption condition redetection step redetects said ink consumption condition.

Preferably, said reconfirmation step is executed several times during moving said carriage by said carriage moving step, and presence or absence of ink in said ink cartridge is decided on the basis of detection results of said reconfirmation steps.

Preferably, said reconfirmation step is executed several times, and, when presence of ink is detected in said consumption condition redetection step more than a predetermined count, it is decided that ink exists in said ink cartridge.

Preferably, said reconfirmation step is executed several times, and presence or absence of ink in said ink cartridge is decided on the basis of a mean value of measured results of said consumption condition redetection steps.

Preferably, measuring timing of said ink consumption condition is controlled on the basis of an operation history of said ink jet recording apparatus.

Preferably, a measuring frequency is increased according to cumulation of operations of said ink jet recording apparatus.

Preferably, said cumulation of operations is a cumulative driving time of a carriage on which said recording head is loaded.

Preferably, a measurement of said ink consumption condition is executed immediately when said measuring timing of said ink consumption condition comes after a predetermined time elapses from a point of time when a carriage on which said recording head is loaded moves last.

Preferably, when said measuring timing of said ink consumption condition comes before a predetermined time elapses from a point of time when a carriage on which said recording head is loaded moves last, measurement is executed immediately after said predetermined time elapses.

Preferably, when said measuring timing of said ink consumption condition comes after a predetermined time elapses from a point of time when a carriage on which said recording head is loaded moves last, a measuring interval is shortened.

Preferably, when said measuring timing of said ink consumption condition comes before a predetermined time elapses from a point of time when a carriage on which said recording head is loaded moves last, a measuring interval is increased.

Preferably, said cumulation of operations is a cumulative driving time of said recording head.

Preferably, said cumulation of operations is a measuring count of said ink consumption condition.

Preferably, a history memory installed in said ink jet recording apparatus or said ink container stores at least one of a cumulative time of operations of said ink jet recording apparatus and a cumulative measuring count.

Preferably, said history memory further stores past measurement histories using said piezo-electric device.

Preferably, said piezo-electric device has a vibration part including said piezo-electric element, and said piezo-electric device measures a periodic peak value of a waveform of counter electromotive force generated by residual vibration remaining in said vibration part by a predetermined number of said periodic peak values from a predetermined point of time, and said piezo-electric device measures more number of said periodic peak values than said predetermined number of said periodic peak values in subsequent detection of said ink consumption condition, and thereby detects said ink consumption condition.

Preferably, said periodic peak value of said waveform of counter electromotive force is measured by increasing said predetermined number of values from said predetermined point of time in accordance with increasing of a detection count of said ink consumption condition in the ink container, and thereby said ink consumption condition is detected.

Preferably, said ink jet recording apparatus or said ink container has a storage memory, and said storage memory stores a measurement history of said ink consumption condition of said piezo-electric device.

Preferably, said ink container is an ink cartridge loaded on said ink jet recording apparatus in a removal state.

Preferably, the method further comprises a consumption condition calculation process of calculating said ink consumption condition in said ink container by calculating said ink consumption used in said ink jet recording apparatus, and said piezo-electric device detects whether an ink level in said ink container passes a measuring position level which is an installation position of said piezo-electric element and thereby detects said ink consumption condition, and said consumption condition calculation process monitors said ink consumption condition in said ink container, and, when it is judged by said consumption condition calculation process that said ink level in said ink container approaches said measuring position level, said piezo-electric device detects said ink consumption condition in said ink container.

Preferably, said ink level in said ink container is detected based on either a calculated result information of said ink consumption condition in said ink container calculated by said consumption condition calculation process or a measured result information of said ink consumption condition in said ink container measured by said piezo-electric device.

Preferably, when an ink residue on said ink level reaches a predetermined ink residue, said ink jet recording apparatus performs a peripheral operation in accordance with said ink residue.

Preferably, said predetermined ink residue is an ink residue set as ink end, and, when said ink end is detected, said ink jet recording apparatus performs a low ink processing operation.

Preferably, said ink consumption condition is not measured by said piezo-electric device until said ink residue calculated by said consumption condition calculation process reaches an amount in a neighborhood of said measuring position level.

Preferably, a measuring frequency of said ink consumption condition by said piezo-electric device is lowered until said ink residue calculated by said consumption condition calculation process reaches an amount in a neighborhood of said measuring position level.

Preferably, a measuring frequency of said ink consumption condition by said piezo-electric device is increased after said ink residue calculated by said consumption condition calculation process reaches an amount in a neighborhood of said measuring position level.

Preferably, the method further comprises a consumption condition calculation process of calculating said ink consumption condition in said ink container by calculating said ink consumption used in said ink jet recording apparatus, and said consumption condition calculation process and said detection process of said ink consumption condition by said piezo-electric device are used together, and said piezo-electric device detects whether an ink level in said ink container passes a measuring position level which is an installation position of said piezo-electric element or not, and thereby detects said ink consumption condition, and, after detecting by said piezo-electric device that said ink level passes said measuring position level, ink end or no-end is decided based on an average of a plurality of measured results of said ink consumption condition measured by said piezo-electric device.

Preferably, a measuring frequency of said piezo-electric device is lowered until first passing of said ink level through said measuring position level is measured by said piezo-electric device.

The present invention is an ink jet recording apparatus comprising: a recording head of jetting ink drops, an ink cartridge of feeding ink to said recording head, a piezo-electric device of detecting an ink consumption condition in said ink cartridge, and a control unit of controlling said piezo-electric device so as to detect said ink consumption condition when said recording head is in a non-recording state.

Preferably, said piezo-electric device detects changes in acoustic impedance, thereby detects said ink consumption condition in said ink container.

Preferably, said piezo-electric device has a vibration part including a piezo-electric element, and said piezo-electric device detects changes in said acoustic impedance on the basis of counter electromotive force generated by residual vibration remaining in said vibration part, thereby detects said ink consumption condition in said ink container.

Preferably, the apparatus further comprises a storage unit of storing said ink consumption condition in said ink cartridge which is detected by said piezo-electric device.

Preferably, said storage unit is mounted on said ink cartridge.

Preferably, said piezo-electric device has a piezo-electric element mounted on said ink cartridge.

Preferably, the apparatus further comprises a carriage moving with said recording head and said ink cartridge both of which are loaded on said carriage, said control unit controls said piezo-electric device so as to redetect said ink consumption condition in said ink cartridge after said piezo-electric device detects absence of ink in said ink cartridge when said recording head is in a non-recording state.

Preferably, said control unit moves said carriage after detection of absence of ink in said ink cartridge by said piezo-electric device and controls said piezo-electric device so as to redetect said ink consumption condition in said ink cartridge in predetermined timing.

Preferably, the apparatus further comprises a shock unit of giving a shock to said ink cartridge during movement of said carriage.

BRIEF DESCRIPTION OF DRAWINGS

FIG. 14 is a drawing showing the process flow when the recording apparatus is turned on.

BEST MODE FOR CARRYING OUT THE INVENTION

The present invention will be explained in detail hereunder using the embodiments of the present invention. The following embodiments are not limited to the invention relating to the claims and all the combinations of the characteristics explained in the embodiments are not always necessary for the solving means of the invention.

The basic concept of the ink detection method of the piezo-electric device used in the present invention is to detect the liquid (ink) conditions (presence of a liquid in the ink container, liquid amount, liquid level, liquid kind, and liquid composition are included) in the ink container using the vibration phenomenon. With respect to detection of the liquid conditions in the ink container using a concrete vibration phenomenon, some methods can be considered. For example, there is a method available for generating elastic waves in an ink container by an elastic wave generation means, receiving the reflected waves from the liquid level or the opposite wall, thereby detecting a medium in the ink container and changes in the condition thereof. Further, separately from this, there is another method available for detecting changes in the acoustic impedance from vibration characteristics of a vibrating object. As a method for using changes in the acoustic impedance, there are a method for vibrating the vibration part of a piezo-electric device (actuator) having a piezo-electric element, measuring counter electromotive force generated by residual vibration remaining in the vibration part thereafter, thereby detecting changes in the acoustic impedance by detecting the amplitude of the resonance frequency or counter electromotive force waveform and a method for measuring the impedance characteristic or admittance characteristic of a liquid by a measuring instrument, for example, an impedance analyzer such as a transmission circuit and measuring changes in the current and voltage or changes due to the frequency of the current or voltage when vibration is given to the liquid.

Installation of the piezo-electric device for measuring the ink consumption condition in the ink cartridge in this embodiment will be explained hereunder.

FIGS. 1 to 4 show an example of an ink cartridge that the ink consumption condition is measured by using the piezo-electric device as an "elastic wave generation means" and FIGS. 5 to 8C show an example of an ink cartridge that the ink consumption condition is measured by using the piezo-electric device as an "actuator". Hereinafter, an example of measurement of the ink consumption condition in the ink cartridge will be explained. However, the present invention is not limited to it and the present invention can be used generally for measurement of the ink consumption condition in the ink container.

Figure 1:
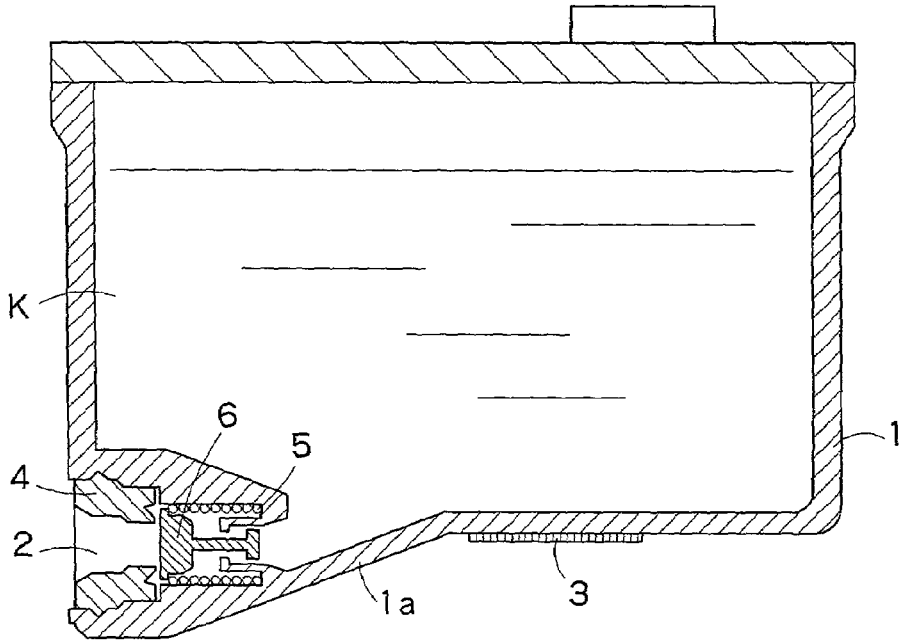
FIG. 1 is a drawing showing an example of an ink cartridge for one color, for example, black ink.

FIG. 1 is a sectional view of one embodiment of an ink cartridge used for mono color, for example, black color ink to which the present invention is applied. An ink cartridge of FIG. 1 is based on a method of detecting a position of a liquid level within the ink container and the presence and absence of the liquid (ink) by receiving a reflected wave of an elastic wave out of the above-described methods. As means for generating an elastic wave and receiving the same, elastic wave generation means 3 is employed. In a container 1 for housing the ink, an ink supplying opening 2 which is joined to an ink supplying needle of a recording apparatus is provided. On the outer side of a bottom surface 1*a* of the container 1, the elastic wave generation means 3 is mounted so that the elastic wave generation means 3 can transmit an elastic wave to the ink of the interior via the container.

The elastic wave generation means 3 is provided at somewhat upper position than that of the ink supplying opening 2 so that the medium of transmission of the elastic wave changes from the ink to gas at the stage where the ink K is almost completely consumed, specifically, at the point in time when it is an ink near end. It should be noted that receiving means may be provided separately and the elastic wave generation means 3 may be used only as generation means.

Figure 3:
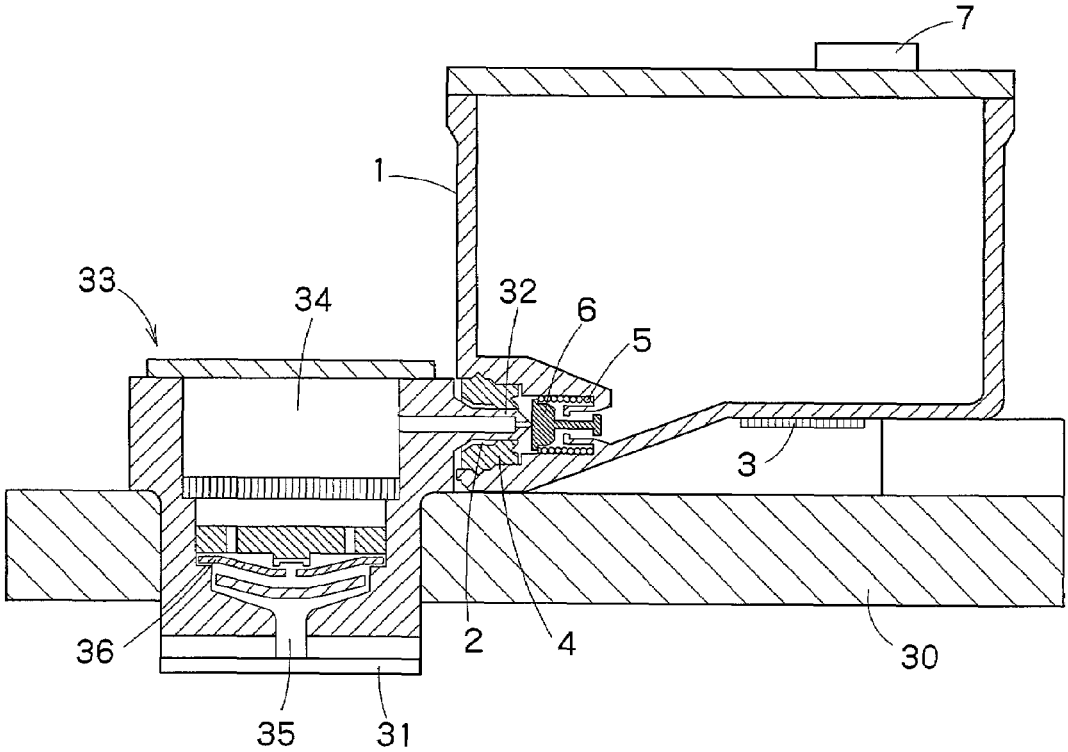
FIG. 3 is a drawing showing an example of an ink jet recording apparatus suited to the ink cartridges shown in FIGS. 1 and 2.

A packing 4 and a valve element 6 are provided in the ink supplying opening 2. As shown in FIG. 3, the packing 4 engages in the ink supplying needle 32 in a fluid-tight manner, which communicates with a recording head 31. The valve element 6 is always contacted with the packing 4 by a spring 5. When the ink supplying needle 32 is inserted, the valve element 6 is pushed by the ink supplying needle 32 and opens an ink pass, the ink within the container 1 is supplied to the recording head 31 via the ink supplying opening 2 and the ink supplying needle 32. On the upper wall of the container 1, semiconductor storage means 7 in which information concerning with the ink within the ink cartridge is stored is mounted.

Figure 2:
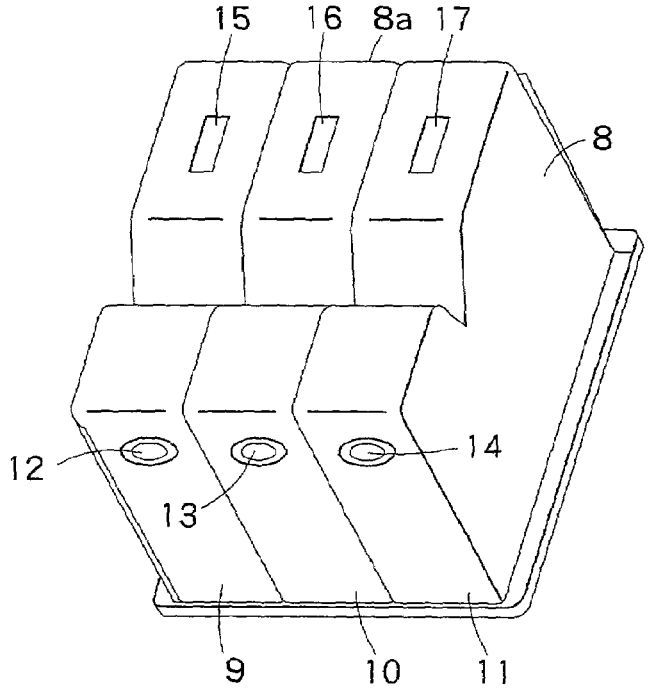
FIG. 2 is a drawing showing an example of ink cartridges for storing a plurality of kinds of ink.

FIG. 2 is a perspective view seen from the backside showing one example of an ink cartridge for housing a plurality of kinds of inks. A container 8 is divided into three ink chambers 9, 10 and 11 by partition walls. In each ink chamber, ink supplying openings 12, 13 and 14 are formed. On the bottom surface 8*a* of the respective ink chambers 9, 10 and 11, elastic wave generation means 15, 16 and 17 are mounted so that these means can transmit an elastic wave to the ink contained in the respective ink chambers via the container 8.

FIG. 3 is a sectional view showing an embodiment of the major parts of an ink jet recording apparatus suitable for the ink cartridge shown in FIGS. 1 and 2. A carriage 30 which is capable of reciprocating in the width direction of a recording paper, which is equipped with a sub tank unit 33, and a recording head 31 is provided on the lower surface of the sub tank unit 33. Moreover, an ink supplying needle 32 is provided on the side of the ink cartridge mounted surface of the sub tank unit 33.

Figure 4:
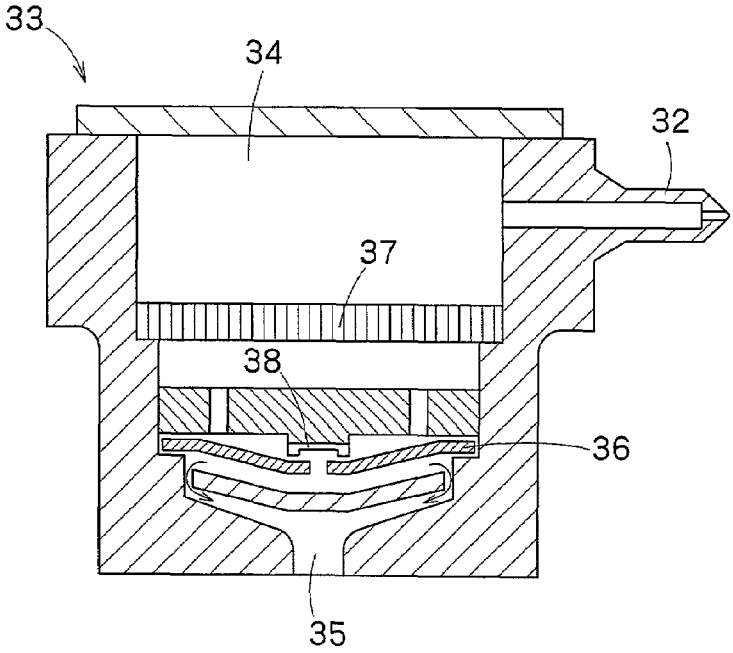
FIG. 4 is a drawing showing a detailed section of a sub-tank unit 33.

FIG. 4 is a sectional view showing the details of the sub tank unit 33. The sub tank unit 33 has an ink supplying needle 32, an ink chamber 34, a film valve 36 and a filter 37. The ink supplied from the ink cartridge via the ink supplying needle 32 is contained within the ink chamber 34. The film valve 36 is designed so that the valve is opened and closed by a difference of the pressure between the ink chamber 34 and an ink supplying path 35. It is configured so that the ink supplying path 35 communicates with the recording head 31 and therefore the ink is supplied to the recording head 31.

As shown in FIG. 3, when the ink supplying opening 2 of the ink cartridge 1 is inserted to and communicated with the ink supplying needle 32 of the sub tank unit 33, the valve element 6 is backed against the spring 5, an ink pass is formed, and the ink within the container 1 flows into the ink chamber 34. At the stage where the ink is filled in the ink chamber 34, a nozzle opening of the recording head 31 is negatively pressurized and the ink chamber 34 is filled with the ink, and subsequently a recording operation is carried out.

When the ink is consumed in the recording head 31 by the recording operation, since the pressure on the downstream side of the film valve 36 is lowered, the film valve 36 is separated from the valve element 38 and the valve is opened as shown in FIG. 4. By opening the film valve 36, the ink in the ink containing chamber 34 flows into the recording head 31 via the ink supplying path 35. Accompanying with inflow of the ink into the recording head 31, the ink in the ink cartridge 1 flows into the sub tank unit 33 via the ink supplying needle 32.

During the operation of the recording apparatus, a drive signal is supplied to the elastic wave generation means 3 at a certain cycle. An elastic wave generated by the elastic wave generation means 3 propagates through the bottom surface la of the container 1, transmitted to the ink and propagated through the ink.

The elastic wave generation means 3 is attached on the container 1, thereby being capable of giving the remaining detection function to the ink cartridge itself. According to the present invention, since embedding of the electrode for detecting a liquid level at the time when the container 1 is molded is not needed, an injection molding step is simplified, a liquid leakage from the electrode embedded region is not seen, and the reliability of an ink cartridge can be enhanced.

The aforementioned is an example of measurement of the ink consumption condition in the ink cartridge using the "elastic wave generation means" which is a configuration of the piezo-electric device.

Next, an example of measurement of the ink consumption condition in the ink cartridge using the "actuator" which is another configuration of the piezo-electric device will be explained. When the actuator is to be used, to facilitate mounting and demounting on and from the ink cartridge, it is desirable to use a mounting structure such as a "module body".

The aforementioned "module body" is not limited to mounting of the actuator and may be used to mount other piezo-electric devices. Hereunder, a module body for facilitating mounting of the actuator on the ink cartridge will be explained.

Figure 5:
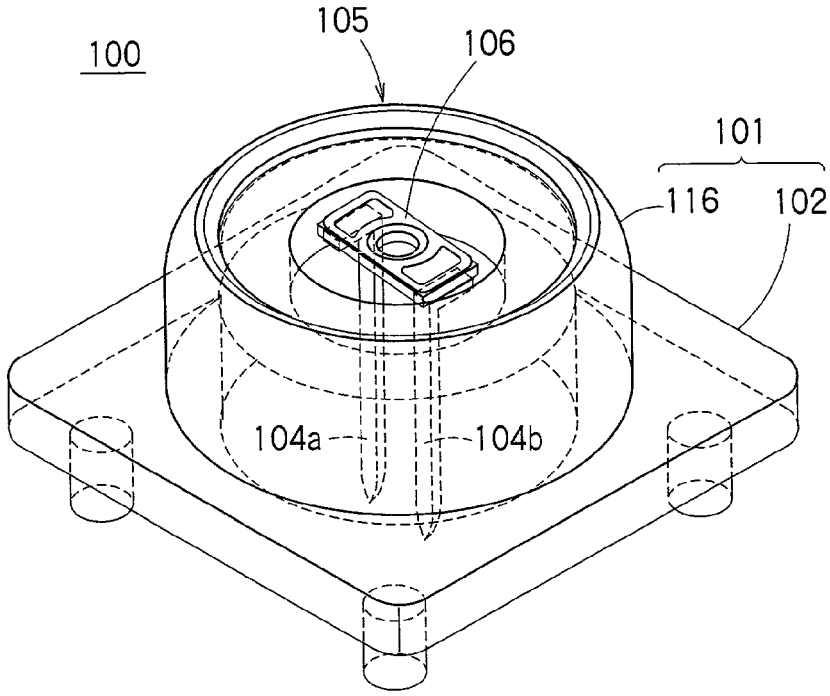
FIG. 5 is a perspective view showing a module body 100.

FIG. 5 is a perspective view showing a configuration integrally forming the actuator 106 as a mounting module body 100. The module body 100 is equipped on the predetermined location of the container 1. The module body 100 is configured so that it detects a consuming state of the liquid within the container 1 by detecting at least a change of acoustic impedance in the ink liquid. The module body 100 of the present embodiment is configured such that a circular cylinder portion 116 containing the actuator 106 for oscillating by a drive signal is mounted on the base 102 whose plane is approximately rectangular. Since it is configured so that the actuator 106 of the module body 100 cannot be contacted from the external when the module body 100 is equipped on the ink cartridge, the actuator 106 can be protected from contacting it from the external. It should be noted that an edge of tip side of the circular cylinder portion 116 is formed in a round shape, and it is easily interfitted when it is equipped in the hole formed on the ink cartridge.

Figure 6:
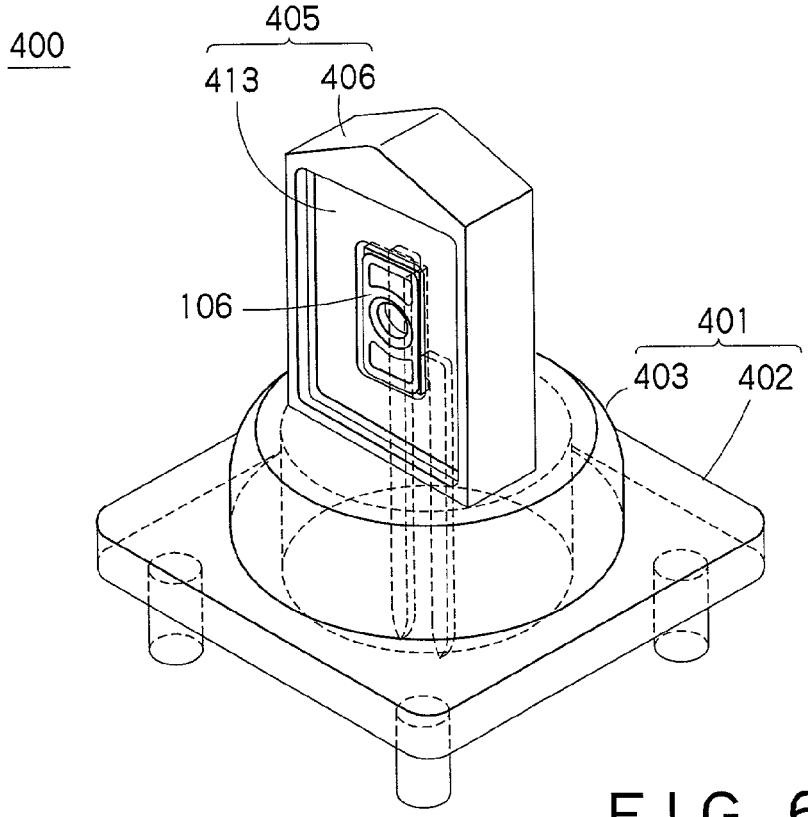
FIG. 6 is a drawing showing another example of the module body 100.

FIG. 6 is a perspective view showing another embodiment of a module body 400. In a module body 400 of the present embodiment, the cylindrical pedestal 403 is formed on the base 402 whose plane is approximately square and rounded off. Furthermore, the actuator 106 is arranged on the side wall of the planar factor 406 stood on the cylindrical pedestal 403. The convex 413 is formed on the surface of the planar factor 406 on which the actuator 106 is mounted. It should be noted that the tip of the planar factor 406 is beveled at the predetermined angle and it is easily fitted when it is mounted in the hole formed in the ink cartridge.

Figure 7:
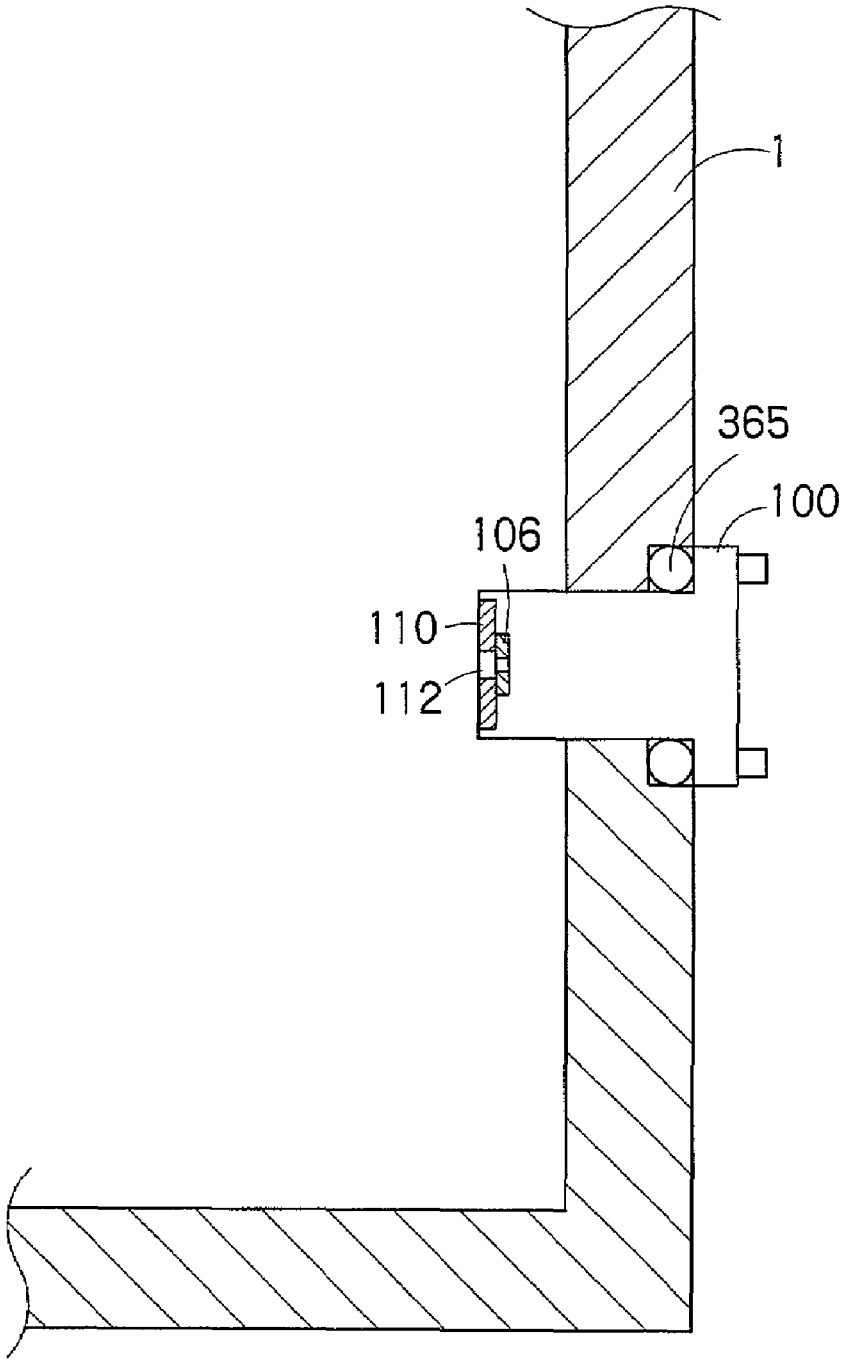
FIG. 7 is a drawing showing an example of the section of the module 100 shown in FIG. 5 which is mounted in an ink container 1.

FIG. 7 is a sectional view in the neighborhood of the bottom of the ink container when the module body 100 shown in FIG. 5 is mounted on the ink container 1. The module body 100 is mounted so as to pass through the side wall of the ink container 1. On the junction surface between the side wall of the ink container 1 and the module body 100, an O-ring 365 is installed and maintains the liquid tightness between the module body 100 and the ink container 1. The module body 100 preferably has a cylindrical part so as to be sealed by the O-ring. When the end of the module body 100 is inserted into the ink container 1, ink in the ink container 1 makes contact with the actuator 106 via a through hole 112 of a plate 110. The resonance frequency of the residual vibration of the actuator 106 is changed depending on a liquid or gas existing around the vibration part of the actuator 106, so that the ink consumption condition can be detected using the module body 100. Not only the module body 100 but also the module body 400 shown in FIG. 6 may be mounted on the ink container 1 so as to detect the presence of ink. Further, the mounting position of the module body on the ink container such as the ink cartridge for mounting the piezo-electric device is not limited to the position shown in the drawing. Further, a plurality of piezo-electric devices may be mounted.

The above is the explanation of the module body for facilitating mounting of the actuator on the ink cartridge. Next, a circuit substrate for mounting the actuator used in this embodiment and the semiconductor storage means which is an example of an operation recording memory of the ink jet recording apparatus properly on the ink cartridge will be explained.

Figure 8A:
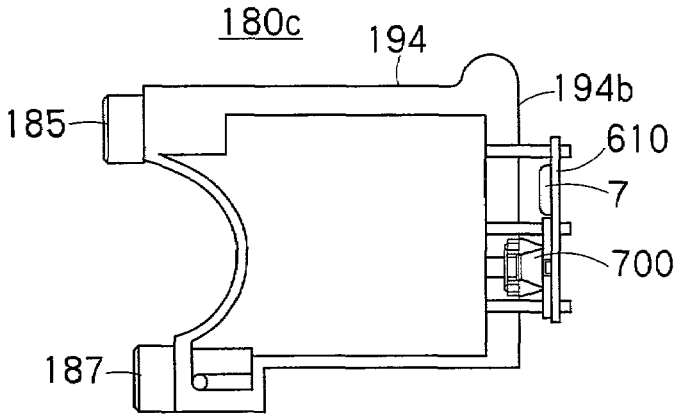
FIGS. 8A, 8B and 8C are drawings showing another examples of an ink cartridge 180.
Figure 8B:
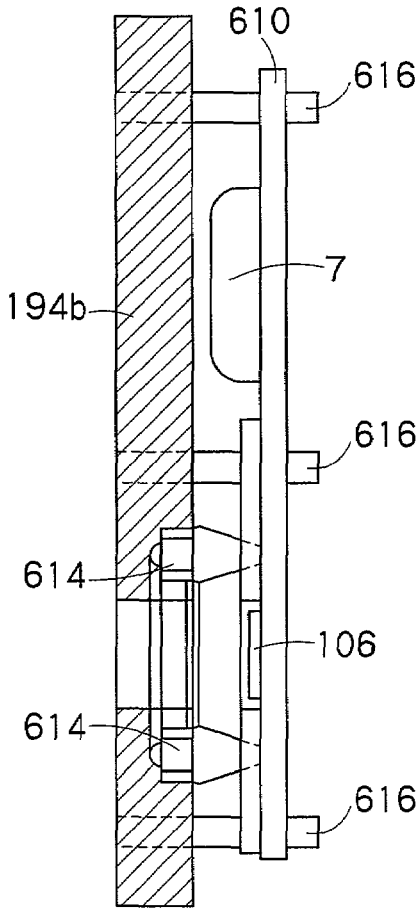
Figure 8C:
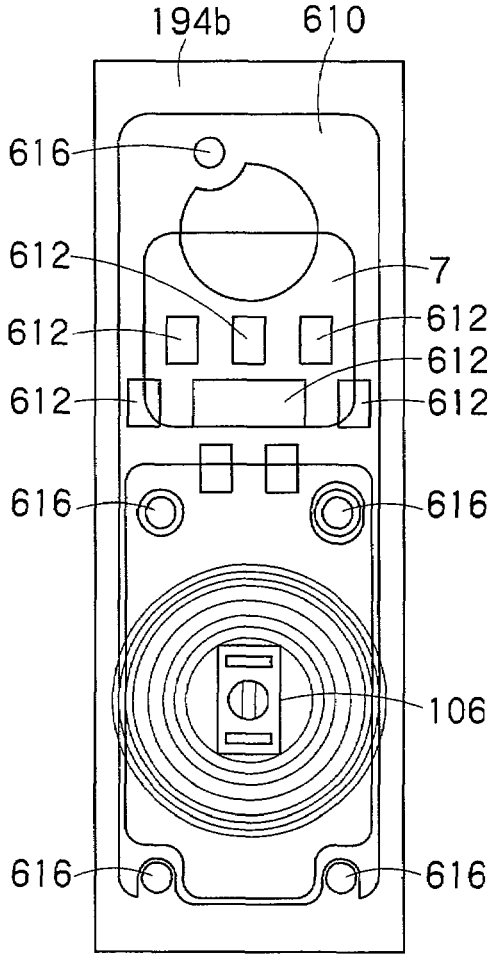

FIG. 8A, FIG. 8B and FIG. 8C show still another embodiment of the ink cartridge. FIG. 8A is a sectional view of an ink cartridge 180C, FIG. 8B is an enlarged sectional view of the side wall 194*b* of the ink cartridge 180C shown in FIG. 8A and FIG. 8C is a perspective view seen from its front. As to the ink cartridge 180C, the semiconductor storage means 7 and the actuator 106 are formed on the same circuit substrate 610. As shown in FIG. 8B and FIG. 8C, the semiconductor storage means 7 is formed on the upper portion of the circuit substrate 610, the actuator 106 is formed on the lower portion of the semiconductor storage means 7 in the same circuit substrate 610.

A special form O-ring 614 as surrounding the actuator 106 is mounted on the side wall 194*b*. On the side wall 194*b*, multiple swaging portions 616 for joining the circuit substrate 610 to the ink container 194 are formed. The circuit substrate 610 is joined to the ink container 194 by the swaging portion 616, and the special form O-ring 614 is pushed on the circuit substrate 610, thereby maintaining the external and internal of the ink cartridge in a fluid-tight manner while enabling the oscillating region of the actuator 106 to contact with the ink.

A terminal 612 is formed on the semiconductor storage means 7 and nearby the semiconductor storage means 7. The terminal 612 receives and transmits a signal between the semiconductor storage means 7 and the externals such as the ink jet recording apparatus. The semiconductor storage means 7 may be, for example, composed of a semiconductor memory capable of being programmable such as EEPROM and the like. Since the semiconductor storage means 7 and the actuator 106 are formed on the same circuit substrate 610, when the actuator 106 and the semiconductor storage means 7 are mounted on the ink cartridge 180C, only one mounting processing step is required. Moreover, the work processing steps at the time of manufacturing and recycling the ink cartridge 180C are simplified. Furthermore, since the number of the parts is reduced, the manufacturing cost of the ink cartridge 180C can be reduced.

The actuator 106 detects an ink consuming state within the ink container 194. The semiconductor storage means 7 stores ink information such as ink remaining volume detected by the actuator 106. Specifically, the semiconductor storage means 7 stores information concerning with property parameters such as ink and an ink cartridge employed at the time of detecting.

Now, the principle of a liquid level detection by an actuator will be described below.

In order to detect a change of acoustic impedance of the medium, an impedance property or admittance property of the medium is measured. In the case where an impedance property or admittance property is measured, for example, a transmission circuit can be utilized. A transmission circuit applies a certain voltage to the medium and measures the electric current supplying to the medium by changing the frequency. Or, a transmission circuit supplies a certain electric current to the medium and measures the voltage applying to the medium by changing the frequency. A change of current value or voltage value measured in the transmission circuit indicates a change of acoustic impedance. Moreover, a change of frequency fm whose current value or voltage value becomes maximum or minimum indicates a change of acoustic impedance.

Separate from the above-described method, an actuator can detect a change of acoustic impedance of a liquid by employing only a change of resonance frequency. As a method of utilizing a change of acoustic impedance of a liquid, there is a method that, in the case where resonance frequency is detected by measuring a counter electromotive force generated by a residual oscillation remaining in an oscillating section after oscillating the oscillating section of an actuator, a piezoelectric element can be utilized. A piezoelectric element is an element for generating a counter electromotive force by residual oscillation remaining in an oscillating section of the actuator, a largeness of a counter electromotive force by an amplitude of the oscillating section of the actuator. Therefore, the larger the amplitude of the oscillating section of the actuator is, the easier it is detected. Moreover, a cycle of changing the largeness of counter electromotive force is changed by frequency of the residual oscillation in the oscillating section of the actuator. Therefore, a frequency of the oscillating section of the actuator corresponds to a frequency of a counter electromotive force. By the way, resonance frequency is referred to a frequency in resonance state of the oscillating section of the actuator and the medium contacted with the oscillating section.

In order to obtain resonance frequency fs, Fourier transform is performed to a waveform obtained by measuring a counter electromotive force when the oscillating section and the medium are in a state of resonance. Since an oscillation of an actuator accompanies with not only a deformation in one direction but also a variety of deformations such as deflection, extension and the like, it has a variety of frequencies including the resonance frequency fs. Hence, the resonance frequency fs is determined by performing Fourier transform to a waveform of the counter electromotive force when the piezoelectric element and the medium are in a state of resonance and specifying the most predominant frequency component.

A frequency fm denotes a frequency at the time when the admittance of the medium is maximum or the impedance of the medium is minimum. Supposing resonance frequency is fs, frequency fm generates subtle error with respect to resonance frequency fs by dielectric loss, or mechanical loss of the medium. However, since it is troublesome to lead resonance frequency fs from the frequency fm actually measured, in general, frequency fm is replaced by resonance frequency and used. Where, the actuator 106 can detect at least acoustic impedance by inputting an output of the actuator 106 into the transmission circuit.

It has been proved by the experiment that there is almost no difference between resonance frequency specified by a method of measuring impedance property or admittance property of the medium and measuring frequency fm and a resonance frequency specified by a method of measuring resonance frequency fs by measuring a counter electromotive force generated by residual oscillation in the oscillating section of an actuator.

Figure 9C:
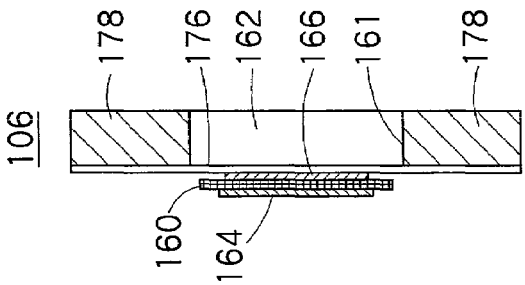
FIGS. 9A, 9B and 9C are drawings showing details of an actuator 106 which is an example of a piezo-electric device.
Figure 9A:
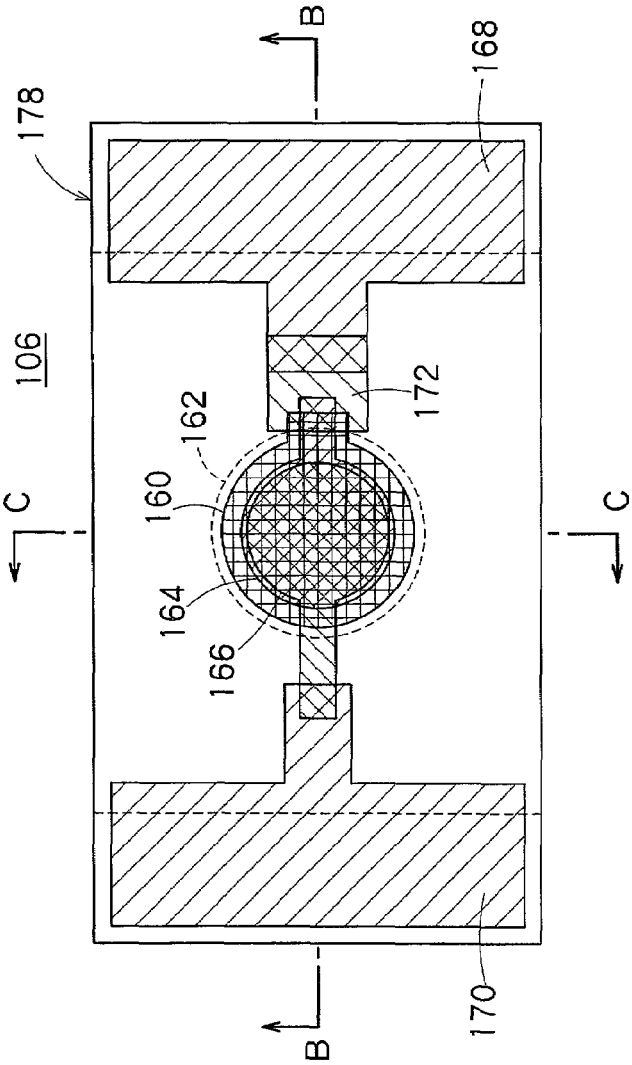
Figure 9B:
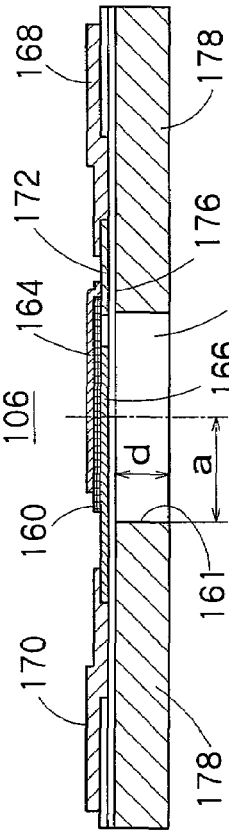
Figure 10:
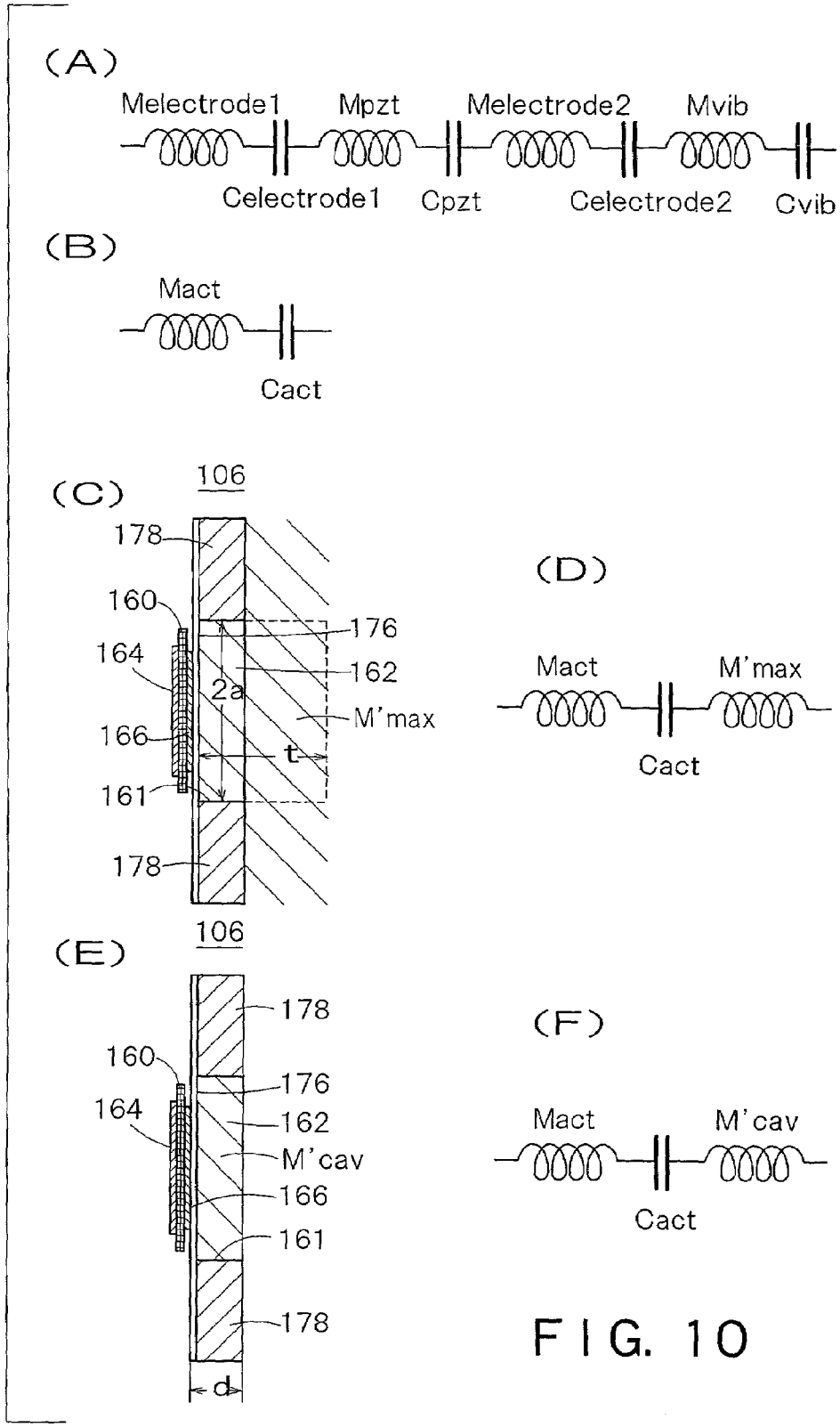
FIG. 10 is a drawing showing the section of the actuator 106, the vibration part of the actuator 106, and the equivalent circuit of a cavity 162.

FIG. 9A, FIG. 9B, FIG. 9C and FIG. 10 show the details and equivalent circuit of the actuator 106 which is one embodiment of a piezoelectric device. An actuator referred to herein is employed in a method of detecting at least the change of acoustic impedance and detecting a consumption state of a liquid (ink) within the ink container. Particularly, it is employed in a method of detecting at least the change of acoustic impedance by detecting resonance frequency from the remaining oscillation and detecting a consumption state of a liquid within the ink container. FIG. 9A is an enlarged plan view of the actuator 106. FIG. 9B shows a section taken along the line B—B. FIG. 9*c* shows a section taken along the line C—C. Furthermore, FIG. 10(A) and FIG. 10(B) show the equivalent circuits of the actuator 106. Moreover, FIG. 10(C) and FIG. 10(D) show the peripherals including the actuator 106 and its equivalent circuit when the ink is filled within the ink cartridge, respectively, and FIG. 10(E) and FIG. 10(F) show the peripherals including the actuator 106 and its equivalent circuit when the ink is absent within the ink cartridge, respectively.

The actuator 106 has a substrate 178 having a circular opening 161 at approximate center of it, an oscillation plate 176 arranged on one of the faces (hereinafter, referred to as surface) of the substrate 178 so as to cover the opening 161, a piezoelectric layer arranged on the side of the surface of the oscillation plate 176, an upper portion electrode 164 and a lower portion electrode 166 sandwiching the piezoelectric layer 160 from the both sides, an upper portion electrode terminal 168 for electrically coupling to the upper portion electrode 164, a lower portion electrode terminal 170 for electrically coupling to the lower portion electrode 166, and an auxiliary electrode 172 provided and arranged between the upper portion electrode 164 and the upper portion electrode terminal 168 and electrically coupling both of these. The piezoelectric layer 160, the upper portion electrode 164 and the lower portion electrode 166 have a circular portion as a major portion, respectively. The respective circular portions of the piezoelectric layer 160, the upper portion electrode 164 and the lower portion electrode 166 forms the piezoelectric elements.

The oscillation plate 176 is formed so as to cover the opening 161 on the surface of the substrate 178. The cavity 162 is formed by the portion facing the opening 161 of the oscillation plate 176 and the opening 161 of the surface of the substrate 178. The face of the contrary side (hereinafter, referred to as reverse face) of a piezoelectric element of the substrate 178 faces the ink container side, the cavity 162 is configured so that the cavity 162 contacts with a liquid. The oscillation plate 176 is mounted with respect to the substrate 178 in a fluid-tight manner so that even if a liquid enters within the cavity 162, the liquid does not leak to the surface side of the substrate 178.

The lower portion electrode 166 is located on the surface of the oscillation plate 176, that is to say, on the face of the contrary side of the ink container, and it is mounted so that the center of the circular portion which is the major portion of the lower portion electrode 166 and the center of the opening 161 are approximately consistent with each other. It should be noted it is set so that an area of the circular portion of the lower portion electrode 166 is smaller than that of the opening 161. On the other hand, on the surface side of the lower portion electrode 166, the piezoelectric layer 160 is formed so that the center of its circular portion and the center of the opening 161 are approximately consistent with each other. It is set so that an area of the circular portion of the piezoelectric layer 160 is smaller than that of the opening 161 and larger than that of the circular portion of the lower portion electrode 166.

On the other hand, on the surface side of the piezoelectric layer 160, the upper portion electrode 164 is formed so that the center of the circular portion which is the major portion of it and the center of the opening 161 are approximately consistent with each other. It is set so that an area of the circular portion of the upper portion electrode 164 is smaller than those of the circular portion of the opening 161 and the piezoelectric layer 160 and larger than that of the circular portion of the lower portion electrode 166.

Therefore, the major portion of the piezoelectric layer 160 has a structure so that the major portion of it is sandwiched from the front face side and back face side by the major portion of the upper portion electrode 164 and the major portion of the lower portion electrode 166, respectively, and the piezoelectric layer 160 can be effectively deformed and driven. The circular portions which are the major portions of the piezoelectric layer 160, the upper portion electrode 164 and the lower portion electrode 166, respectively, form piezoelectric elements in the actuator 106. As described above, the piezoelectric element contacts with the oscillation plate 176. Moreover, the largest area is the area of the opening 161 among the circular portion of the upper portion electrode 164, the circular portion of the piezoelectric layer 160, the circular portion of the lower portion electrode 166 and the opening 161. Owing to this structure, the actually oscillating region out of the oscillation plate 176 is determined by the opening 161. Moreover, since the circular portion of the upper portion electrode 164, the piezoelectric layer 160 and the circular portion of the lower portion electrode 166 are smaller than that of the opening 161, the oscillation plate 176 is more easily oscillating. Moreover, when comparing the circular portion of the circular portion of the upper portion electrode 164 and the lower portion electrode 166 for electrically connecting with the piezoelectric layer 160, the circular portion of the lower portion electrode 166 is smaller. Therefore, the circular portion of the lower portion terminal 166 determines the portion of the piezoelectric layer 160 where the piezoelectric effect is generated.

The center of the circular part of the piezo-electric layer 160, the upper electrode 164, and the lower electrode 166 forming the piezo-electric element almost coincides with the center of the opening 161. Further, the center of the circular opening 161 for deciding the vibration part of the diaphragm 176 is installed almost at the center of the actuator 106. Therefore, the center of the vibration part of the actuator 106 almost coincides with the center of the actuator. Further, the main part of the piezo-electric element and the vibration part of the diaphragm 176 have a circular shape, so that the vibration part of the actuator 106 has a shape symmetrical to the center of the actuator 106.

Since the vibration part has a shape symmetrical to the center of the actuator 106, unnecessary vibration caused by the unsymmetrical structure can be prevented from excitation. Therefore, the detection accuracy of resonance frequency is improved. Further, the vibration part has a shape symmetrical to the center of the actuator 106, so that it can be manufactured easily and variations for each piezo-electric element can be made smaller. Therefore, variations in the resonance frequency are made smaller. Further, the vibration part has an isotropic shape, so that at the time of adhesion, it is hardly affected by variations in fixing. It is evenly adhered to the ink container. Therefore, the mounting capacity of the actuator 106 on the ink container is good.

Further, the vibration part of the diaphragm 176 has a circular shape, so that in the resonance mode of the residual vibration of the piezo-electric layer 160, the low degree, for example, linear resonance mode is dominant and a single peak appears. Therefore, the peak and noise can be distinguished clearly from each other, so that the resonance frequency can be detected clearly. Further, when the area of the vibration part of the circular diaphragm 176 is increased, the difference in the amplitude of the resonance frequency due to the amplitude of the counter electromotive force waveform and the presence of a liquid is increased and the detection precision of the resonance frequency can be improved more.

The displacement due to vibration of the diaphragm 176 is larger by far than the displacement due to vibration of the substrate 178. The actuator 106 has a two-layer structure of the substrate 178 of small compliance, that is, hardly displaced due to vibration and the diaphragm 176 of large compliance, that is, easily displaced due to vibration. By this two-layer structure, the actuator 106 is surely fixed to the ink container by the substrate 178 and the displacement of the diaphragm 176 due to vibration can be increased, so that the difference in the amplitude of the resonance frequency due to the amplitude of the counter electromotive force waveform and the presence of a liquid is increased and the detection precision of the resonance frequency can be improved. Further, since the compliance of the diaphragm 176 is large, the attenuation of vibration is reduced and the detection precision of the resonance frequency can be improved. Further, the node of vibration of the actuator 106 is positioned in the outer peripheral part, that is, in the neighborhood of the edge of the opening 161.

The upper electrode terminal 168 is formed on the surface side of the diaphragm 176 so as to be electrically connected to the upper electrode 164 via the auxiliary electrode 172. On the other hand, the lower electrode terminal 170 is formed on the surface side of the diaphragm 176 so as to be electrically connected to the lower electrode 166. The upper electrode 164 is formed on the surface side of the piezo-electric layer 160, so that in the middle of connection to the upper electrode terminal 168, the upper electrode 164 must have a level difference equal to the sum of the thickness of the piezo-electric layer 160 and the thickness of the lower electrode 166. It is difficult to form this level difference only by the upper electrode 164, and even if it is possible, the connection condition between the upper electrode 164 and the upper electrode terminal 168 becomes weaker, and there is a danger of cutting. Therefore, the upper electrode 164 and the upper electrode terminal 168 are connected using the auxiliary electrode 172 as an auxiliary member. By doing this, the piezo-electric layer 160 and the upper electrode 164 are structured so as to be supported by the auxiliary electrode 172, and desired mechanical strength can be obtained, and the upper electrode 164 and the upper electrode terminal 168 can be connected surely.

Further, the piezo-electric element and the vibration area of the diaphragm 176 facing the piezo-electric element are the vibration part of the actuator 106 which actually vibrates. Further, the members included in the actuator 106 are preferably calcined mutually, thereby formed integratedly. By integrated forming of the actuator 106, the actuator 106 can be handled easily. Furthermore, when the strength of the substrate 178 is increased, the vibration characteristic is improved. Namely, when the strength of the substrate 178 is increased, only the vibration part of the actuator 106 vibrates and the parts of the actuator 106 other than the vibration part do not vibrate. Further, to prevent the parts of the actuator 106 other than the vibration part from vibration, the strength of the substrate 178 is increased, though it can be realized by making the piezo-electric element of the actuator 106 thinner and smaller and making the diaphragm 176 thinner.

As a material of the piezo-electric 160, it is preferable to use zirconium acid titanate (PZT), zirconium acid titanate lantern (PLZT), or a lead-less piezo-electric film using no lead and as a material of the substrate 178, it is preferable to use zirconia or alumina. Further, for the diaphragm 176, it is preferable to use the same material as that of the substrate 178. For the upper electrode 164, the lower electrode 166, the upper electrode terminal 168, and the lower electrode terminal 170, a conductive material, for example, a metal such as gold, silver, copper, platinum, aluminum, or nickel can be used.

The actuator 106 structured as mentioned above can be applied to a container for storing a liquid. For example, it can be mounted on an ink cartridge used for an ink jet recording apparatus or a container for storing a cleaning liquid for cleaning a recording head.

The actuator 106 shown in FIGS. 9A, 9B, 9C, and 10 is mounted in a predetermined location of the ink container so as to allow the cavity 162 to make contact with a liquid contained in the ink container. When the ink container is fully filled with a liquid, the inside and outside of the cavity 162 are filled with a liquid. On the other hand, when the liquid in the ink container is consumed and the liquid level drops below the mounting position of the actuator, a state that there is no liquid in the cavity 162 or a liquid remains only in the cavity 162 and gas exists outside the cavity appears. The actuator 106 detects at least a difference in the acoustic impedance caused by changes in this state. By doing this, the actuator 106 can detect a state that the ink container is fully filled with a liquid or a state that a fixed amount or more of liquid is consumed.

Furthermore, the actuator 106 can detect also the liquid kind in the ink container.

Now, the principle of a liquid level detection by an actuator will be described below.

In order to detect a change of acoustic impedance of the medium, an impedance property or admittance property of the medium is measured. In the case where an impedance property or admittance property is measured, for example, a transmission circuit can be utilized. A transmission circuit applies a certain voltage to the medium and measures the electric current supplying to the medium by changing the frequency. Or, a transmission circuit supplies a certain electric current to the medium and measures the voltage applying to the medium by changing the frequency. A change of current value or voltage value measured in the transmission circuit indicates a change of acoustic impedance. Moreover, a change of frequency fm whose current value or voltage value becomes maximum or minimum indicates a change of acoustic impedance.

Separate from the above-described method, an actuator can detect a change of acoustic impedance of a liquid by employing only a change of resonance frequency. As a method of utilizing a change of acoustic impedance of a liquid, there is a method that in the case where resonance frequency is detected by measuring a counter electromotive force generated by a residual oscillation remaining in an oscillating section after the oscillating section of an actuator, for example, a piezoelectric element can be utilized. A piezoelectric element is an element for generating a counter electromotive force by residual oscillation remaining in an oscillating section the actuator, a largeness of a counter electromotive force is changed by an amplitude of the oscillating section of the actuator. Therefore, the larger the amplitude of the oscillating section of the actuator is, the easier it is detected. Moreover, a cycle of changing the largeness of counter electromotive force is changed by frequency of the residual oscillation in the oscillating section of the actuator. Therefore, a frequency of the oscillating section of the actuator corresponds to a frequency of a counter electromotive force. By the way, resonance frequency is referred to a frequency in resonance state of the oscillating section of the actuator and the medium contacted with the oscillating section.

In order to obtain resonance frequency fs, Fourier transform is performed to a waveform obtained by measuring a counter electromotive force when the oscillating section and the medium are in a state of resonance. Since an oscillation of an actuator accompanies with not only a deformation in one direction but also a variety of deformations such as deflection, extension and the like, it has a variety of frequencies including the resonance frequency fs. Hence, the resonance frequency fs is determined by performing Fourier transform to a waveform of the counter electromotive force when the piezoelectric element and the medium are in a state of resonance and specifying the most predominant frequency component.

A frequency fm denotes a frequency at the time when the admittance of the medium is maximum or the impedance of the medium is minimum. Supposing resonance frequency is fs, frequency fm generates subtle error with respect to resonance frequency fs by dielectric loss, or mechanical loss of the medium. However, since it is troublesome to lead resonance frequency fs from the frequency fm actually measured, in general, frequency fm is replaced by resonance frequency and used. Where, the actuator 106 can detect at least acoustic impedance by inputting an output of the actuator 106 into the transmission circuit.

It has been proved by the experiment that there is almost no difference between resonance frequency specified by a method of measuring impedance property or admittance property of the medium and measuring frequency fm and a resonance frequency specified by a method of measuring resonance frequency fs by measuring a counter electromotive force generated by residual oscillation in the oscillating section of an actuator.

The oscillating region of the actuator 106 is a portion composed of the cavity 162 determined by the opening 161 out of the oscillation plate 176. In the case where the ink container is sufficiently contained with the liquid, the cavity 162 is filled with a liquid, the oscillating region contacts with the liquid within the ink container. On the other hand, in the case where the ink container is not filled with the liquid, the oscillating region contacts with the liquid remained in the cavity within the container, or the oscillating region does not contact with the liquid, and contacts with gas or vacuum.

In the actuator 106 of the present invention, the cavity 162 is provided, owing to this, it is designed so that, in the oscillating region of the actuator 106, a liquid within the ink container remains. The reasons why are the following.

Depending on mounting position and mounting angle to the ink container of the actuator, the liquid may be attached to the oscillating region of the actuator although the liquid level of the liquid within the ink container is lower than the mounting position of the actuator. In the case where the actuator detects the presence or absence of the liquid only by the presence or the absence of the liquid in the oscillating region, the liquid attached to the oscillating region of the actuator hinders it from precisely detecting the presence or absence of the liquid.

For example, in a state where the liquid level is lower than the mounting position of the actuator, if the ink container is swung by reciprocating movement of the carriage and the like, the liquid is waved and the liquid droplets are attached to the oscillating region, the actuator erroneously determines that the liquid sufficiently exists within the ink container. Therefore, to the contrary, by positively providing a cavity designed to precisely detect the presence or absence of the liquid even in the case where the liquid remains there, if the ink container is swung and the liquid level is waved, malfunction of the actuator can be prevented. In this way, by employing an actuator having a cavity, malfunction can be prevented.

Moreover, as shown in FIG. 10(E), the case where the liquid is absent within the ink container and the liquid within the ink container remains in the cavity 162 of the actuator 106 is made as threshold. Specifically, in the case where the liquid is absent on the periphery of the cavity 162 and the liquid within the cavity is less than this threshold, the absence of the ink is determined, in the case where the liquid is present on the periphery of cavity 162 and the liquid is more than this threshold, the presence of the ink is determined. For example, in the case where the actuator 106 is mounted on the side wall of the ink container, the case where the liquid within the ink container is lower than the mounting position of the actuator is determined as the case where the ink is absent, and the case where the liquid within the ink container is higher than the mounting position of the actuator is determined as the case where the ink is present. In this way, by providing the threshold, even in the case where the ink within the cavity is dried and the ink is absent is also determined as the case where the ink is absent, the case where the ink is absent within the cavity and where the ink is attached to the cavity by the swinging of the carriage and the like can be determined as the case where the ink is absent because it does not exceed over the threshold.

Now, an operation and the principle of detecting a state of the liquid within the ink container from the resonance frequency of the medium and the oscillating section of the actuator 106 by measurement of a counter electromotive force with reference to FIG. 9A, FIG. 9B, FIG. 9C and FIG. 10 will be described below. In the actuator 106, a voltage is applied to the upper portion electrode 164 and the lower portion electrode 166 via the upper portion electrode terminal 168 and the lower electrode terminal 170. Out of the areas of the piezoelectric layer 160, the electric field is generated in the portion sandwiched between the upper portion electrode 164 and the lower portion electrode terminal 166, respectively. The piezoelectric layer 160 is deformed by its electric field. The oscillating region out of the oscillation plate 176 is deflected and vibrated by the piezoelectric layer 160 being deformed. After the piezoelectric layer 160 is deformed, for a while, the deflected oscillation remains in the oscillating section of the actuator 106.

A residual oscillation is a free oscillation of the oscillating section of the actuator 106 and the medium. Therefore, the resonance state of the oscillating section and the medium can be easily obtained after the voltage is applied by converting the voltage applied to the piezoelectric layer 160 into a pulse waveform or rectangular wave. The residual oscillation also deforms even the piezoelectric layer 160 in order to make the oscillating section of the actuator 106. Therefore, the piezoelectric layer 160 generates a counter electromotive force. Its counter electromotive force is detected via the upper portion electrode 164, the lower portion electrode 166, the upper portion electrode terminal 168 and the lower portion electrode terminal 170. A state of the liquid within the ink container can be detected since resonance frequency can be specified by the detected counter electromotive force.

In general, resonance frequency fs is represented as follows:

$$fs=1/(2*\pi*(M*C_{act})^{1/2}) \quad \text{(Expression 1)}$$

wherein M denotes the sum of inertance $M_{act}$ of the oscillating section and additive inertance M' and $C_{act}$ denotes compliance of the oscillating section.

FIG. 9C is a sectional view of the actuator 106 when the ink does not remain in the cavity in the present embodiment. FIG. 10(A) and FIG. 10(B) are the oscillating section of the actuator 106 and the equivalent circuit of the cavity 162 when the ink does not remain in the cavity.

M act denotes the product of the thickness of the oscillating section and the density of the oscillating section which is divided by the area of the oscillating section, and further in detail, as shown in FIG. 10(A), is represented as:

$$M\ \text{act}=M\ \text{pzt}+M\ \text{electrode1}+M\ \text{electrode2}+M\ \text{vib} \quad \text{(Expression 2)}$$

wherein M pzt is the product of the thickness of the piezoelectric layer 160 in the oscillating layer 160 and the density of the piezoelectric layer 160 which is divided by the area of the piezoelectric layer 160, M electrode1 denotes the product of the thickness of the upper portion electrode 164 and the density of the upper portion electrode 164 in the oscillating section which is divided by the area of the upper portion electrode 164, M electrode2 denotes the product of the thickness of the lower portion electrode 166 and the density of the lower portion electrode 166 in the oscillating section which is divided by the area of the lower portion electrode 166, and M vib denotes the product of the thickness of the oscillation plate 176 in the oscillating section and the density of the oscillation plate 176 which is divided by the area of the oscillating region. However, it is preferable that in the present embodiment, the respective areas of the piezoelectric layer 160, the upper portion electrode 164, the lower portion electrode 166 and the oscillating region of the oscillation plate 176 have relationships of being larger and smaller between them as described above, mutual difference of the area is minute so that M act can be calculated from the thickness, density, and area as the entire oscillation portion. Moreover, in the present embodiment, it is preferable that the portions except for these major portion which is circular portion is minute to the degree of being negligible in the piezoelectric layer 160, the upper portion electrode 164 and the lower portion electrode 166.

Therefore, in the actuator 106, M act denotes the sum of the respective inertance of the oscillating regions out of the upper portion electrode 164, the lower portion electrode 166, the piezoelectric layer 160 and the oscillation plate 176. Moreover, compliance C act denotes the compliance of the portion formed by the oscillating region out of the upper portion electrode 164, the lower portion electrode 166, the piezoelectric layer 160 and the oscillation plate 176.

It should be noted that FIG. 10(A), FIG. 10(B), FIG. 10(D) and FIG. 10(F) show equivalent circuits of the oscillating section of the actuator 106 and the cavity 162, however, in these equivalent circuits, C act denotes a compliance of the oscillating section of the actuator 106. C pzt, C electrode1, C electrode2, and C vib denotes respective compliances of the piezoelectric layer 160, the upper portion electrode 164, the lower portion electrode 166 and the oscillation plate 176 in the oscillating section. C act is represented by the following equation 3.

$$1/C\ \text{act}=(1/C\ \text{pzt})+(1/C\ \text{electrode1})+(1/C\ \text{electrode2})+(1/C\ \text{vib}) \quad \text{(Expression 3)}$$

By Expression 2 and Expression 3, FIG. 10(A) can be represented as FIG. 10(B).

Compliance C act denotes volume capable of receiving the medium generated by deformation occurred at the time when a pressure is added on one unit area of the oscillating section. Moreover, it can be said that compliance C act denotes the easiness of deformation.

FIG. 10(C) shows a sectional view of the actuator 106 in the case where the liquid is sufficiently contained in the ink container and the liquid is filled on the periphery of the oscillating region of the actuator 106. M'max of the FIG. 10(C) denotes the maximum value of the additive inertance in the case where the liquid is sufficiently contained in the ink container and the liquid is filled on the periphery of the oscillating region of the actuator 106. M' max is represented by, $$M'\max=(\pi^*/(2^*k^3))^*(2^*(2^*k^*a)^3/(3^*\pi))/(\pi^*a^2)^2 \quad \text{(Expression 4)}$$

Wherein a denotes diameter of the oscillating section and denotes density of the medium and k denotes wave number. It should be noted that Expression 4 holds in the case where the oscillating region of the actuator 106 is a circular shape of the diameter a. An additive inertance M' denotes a volume indicating the apparent increase of mass of the oscillating section. As understood from Expression 4, M'max is largely changed by diameter a of the oscillating section and density of the medium.

Wave number k is represented by:

$$k=2^*\pi^*f\,\mathrm{act}/c \quad \text{(Expression 5)}$$

wherein f act denotes a resonance frequency of the oscillating section at the time when the liquid does not contact with and c denotes a speed of sound which propagates through the medium.

FIG. 10(D) shows the oscillating section of the actuator 106 and equivalent circuit of the cavity 162 in the case of FIG. 10(C) in which the liquid is sufficiently contained in the ink container and the liquid is filled on the periphery of the oscillating region of the actuator 106.

FIG. 10(E) shows a sectional view of the actuator 106 in the case where the liquid of the ink container is consumed, the liquid is absent on the periphery of the oscillating region of the actuator 106 but the liquid remains within the cavity 162 of the actuator 106. Expression 4 represents maximum inertance M'max determined from the density ρ of the link for example in the case where the ink container is filled with the liquid. On the other hand, in the case where the liquid within the ink container is consumed, and the liquid on the periphery of the oscillating region of the actuator 106 becomes gas or vacuum while the liquid remains within the cavity 162, it is represented by the following:

$$M'=\rho^*t/S \quad \text{(Expression 6)}$$

Wherein t denotes thickness of the medium involved with oscillation and S denotes an area of the oscillating region of the actuator 106. In the case where the oscillating region is a circular shape of diameter a, $S=\pi^*a^2$holds. Therefore, an additive inertance M' adheres to Expression 4 in the case where the liquid is sufficiently contained in the ink container and the liquid is filled on the periphery of the oscillating region of the actuator 106. On the other hand, in the case where the liquid is consumed and the liquid on the periphery of the oscillating region of the actuator 106 becomes gas or vacuum while the liquid remains within the cavity 162, adhere to Expression 6.

Now, as shown in FIG. 10(E), an additive inertance M' in the case where the liquid of the ink container is consumed, the liquid is absent on the periphery of the oscillating region of the actuator 106 but the liquid remains within the cavity 162 of the actuator 106 is defined as M'cav, and M'cav is discriminated from an additive inertance M'max in the case where the liquid is filled on the periphery of the oscillating region of the actuator 106.

FIG. 10(F) shows the oscillating section of the actuator 106 and equivalent circuit of the cavity 162 in the case of FIG. 10(E) in which the liquid of the ink container is consumed, the liquid is absent on the periphery of the oscillating region of the actuator 106 but the liquid remains within the cavity 162 of the actuator 106.

Now, parameters involved with a state of the medium are density ρ of the medium and thickness t of the medium in Expression 6. In the case where the liquid is sufficiently contained in the ink container, the liquid contacts with the oscillating section of the actuator 106, and in the case where the liquid is sufficiently contained within the ink container, the liquid remains within the cavity, or gas or vacuum contacts with the oscillating section of the actuator 106. The liquid on the periphery of the actuator 106 is consumed, and if an additive inertance in the processing for moving from M'max of FIG. 10(C) to M'cav of FIG. 10(E) is defined as M'var, since thickness t of the medium is changed depending on the containing state of the liquid of the ink container, an additive inertance M'var is changed, and resonance frequency fs is also changed. Therefore, the presence or absence of the liquid of the ink container can be detected by specifying the resonance frequency fs. Now, M'cav is represented by employing Expression 6 and substituting the depth d of the cavity into t of Expression 6.

$$M'\mathrm{cav}=\rho^*d/S \quad \text{(Expression 7)}$$

Moreover, even if the media are different kinds of liquids with each other, since densities ρ are different from the difference of the components, an additive inertance M' is changed, and resonance frequency fs is also changed. Therefore, the presence or absence of the liquid of the ink container can be detected by specifying resonance frequency fs. It should be noted that in the case where only any one of the ink or the air contacts with the oscillating section of the actuator 106 and these are not mixed up, the difference of M' can be detected even if calculated by Expression 4.

Figure 11A:
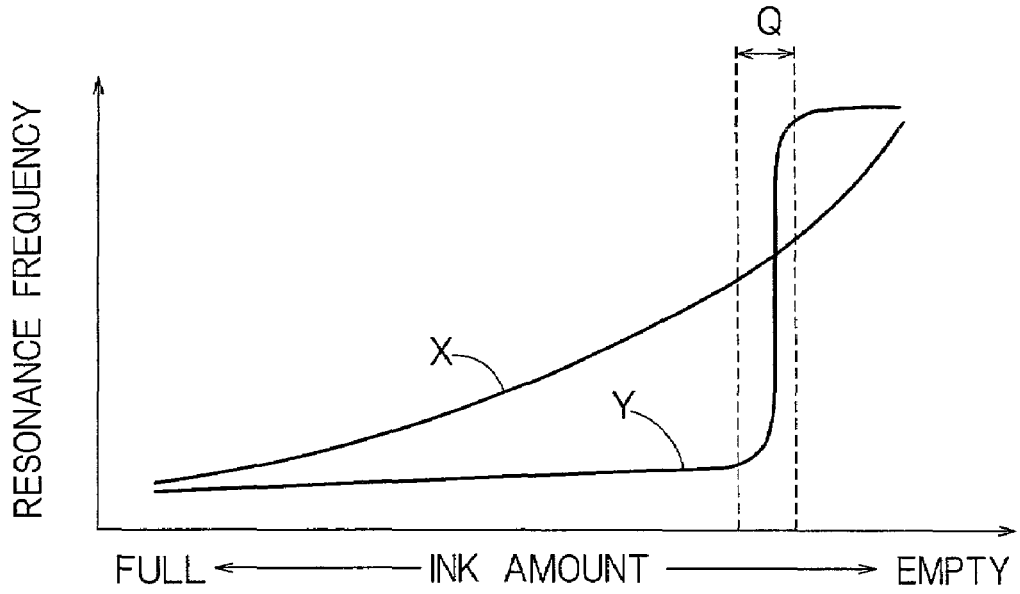
FIGS. 11A and 11B are graphs showing the relations between the ink amount and density in an ink container and the resonance frequencies fs of ink and the vibration part.

FIG. 11A is a graph showing the relationship between a volume of the ink within the ink tank and resonance frequency fs of the ink and the oscillating section. Now, the ink will be described as one embodiment of a liquid below. Axis of ordinates indicates resonance frequency fs, and axis of abscissas indicates a volume of the ink. When the ink components are consistent, resonance frequency fs rises accompanying with lowering of the remaining ink volume.

In the case where the ink is sufficiently contained in the ink container and the ink is filled on the periphery of the oscillating region of the actuator 106, the maximum additive inertance M'max is a value represented by Expression 4. On the other hand, in the case where the ink is consumed and the ink is not filled on the periphery of the oscillating region of the actuator 106 while the ink remains within the cavity 162, the additive inertance M'var is calculated on the thickness of the medium by Expression 6. Since t in Expression 6 denotes thickness of the medium involving with the oscillation, by making d of the cavity of the actuator 106 (see FIG. 9B) smaller, specifically, by making the substrate 178 sufficiently thinner, the processing in which the ink is step by step consumed can be detected (see FIG. 10(C)). Where, t ink is defined as thickness of the ink involving with the oscillation, and t ink–max is defined as t ink in M'max. For example, the actuator 106 is arranged on the bottom surface of the ink cartridge in an approximately parallel with the ink liquid level. When the ink is consumed and the ink liquid level arrives at the height lower by the portion oft ink-max from the actuator 106, M'var is gradually changed adhere to Expression 6, and resonance frequency fs is gradually changed adhere to Expression 1. Therefore, as far as the ink liquid level exists within the range of t, the actuator 106 can detect a consuming state of the ink step by step.

Moreover, by making the oscillating region of the actuator 106 larger or longer and arranging it in a longitudinal direction, S in Expression 6 is changed adhere to the liquid level position due to the ink consumption. Therefore, the actuator 106 can detect the processing in which the ink is consumed step by step. For example, the actuator 106 is arranged on the side wall of the ink cartridge in an approximately perpendicular to the ink liquid level. When the ink is consumed and the ink liquid level arrives at the oscillating region of the actuator 106, since the additive inertance M' is reduced accompanied with lowering of the liquid level, resonance frequency fs is increased step by step. Therefore, as far as the ink liquid level exists within the range of a radius 2*a* of the cavity 162 (see FIG. 10(C)), the actuator 106 can detect a consuming state of the ink step by step.

Curve X of the FIG. 11A denotes relationship between a volume of the ink contained within the ink tank and resonance frequency fs of the ink and the oscillating section in the case where the cavity 162 of the actuator 106 is sufficiently made shallow or in the case where the oscillating region of the actuator 106 is made larger or longer. It can be understood that resonance frequency of the ink and the oscillating section is appeared to be changed step by step as a volume of the ink is reduced within the ink tank.

More particularly, the case where that the processing in which the ink is consumed step by step can be detected is a case where a liquid and gas having different densities with each other both exist and involves with the oscillation. As the ink is consumed step by step, as to the media involving with the oscillation on the periphery of the oscillating region of the actuator 106, the gas is increased while the liquid is reduced. For example, in the case where the actuator 106 is arranged in parallel with the ink liquid level, and when t ink is smaller than t ink-max, the media involving with the oscillation of the actuator 106 include both the ink and the gas. Therefore, supposing an area S of the oscillating region of the actuator 106, a state of being less than M'max of Expression 4 is represented by additive masses of the ink and the gas as the following:

$$M'=M'\text{air}+M'\text{ink}=\rho\text{air}*t\ \text{air}/S+\rho\text{ink}*t\ \text{ink}/S \qquad \text{(Expression 8)}$$

wherein M'air denotes inertance of the air, and M'ink denotes inertance of the ink, ρ air denotes density of the air, and ρ ink denotes density of the ink, and Tt air denotes thickness of the air involving with the oscillation, and t ink denotes thickness of the ink involving with the oscillation. Out of the media involving with the oscillation on the periphery of the oscillating region of the actuator 106, as the liquid is reduced and the air is increased, t air is increased and t ink is reduced in the case where the actuator 106 is arranged in an approximately parallel with the ink liquid level, thereby M'var is reduced step by step and resonance frequency is increased step by step. Therefore, a volume of the ink remaining within the ink tank or the consuming volume of the ink can be detected. It should be noted that the reason why Expression 7 is an equation involving only with density of the liquid is because the case where the density of the air is small as negligible is supposed.

In the case where the actuator 106 is arranged in an approximately perpendicular to the ink liquid level, parallel equivalent circuits (not shown) of the region where the medium involving with the oscillation of the actuator 106 is only the ink and the region where the medium involving with the oscillation of the actuator 106 is only the air out of the oscillating region of the actuator 106 are considered. Supposing that the region where an area of the medium involving with the oscillation of the actuator 106 is only the ink is S ink, and the region where an area of the medium involving with the oscillation of the actuator 106 is only the air is S air:

$$1/M'=1/M'\text{air}+1/M'\text{ink}=S\ \text{air}/(\rho\text{air}*t\ \text{air})+S\ \text{ink}/(\rho\text{ink}*t\ \text{air}) \qquad \text{(Expression 9)}$$

It should be noted that Expression 9 is applied in the case where the ink is not held in the cavity of the actuator 106. In the case where the ink is held in the cavity of the actuator 106, it can be calculated by Expression 7, Expression 8 and Expression 9.

On the other hand, in the case where the substrate 178 is thick, specifically, the depth d of the cavity 162 is deep, d is comparatively close to the thickness t ink-max of the medium, or in the case where an actuator whose oscillating region is very small compared to the height of the ink container is employed, actually whether or not the ink liquid level is higher position or lower position than the mounting position of the actuator, rather than detecting the processing in which the ink is reduced step by step. In other words, the presence or absence of the ink in the oscillating region of an actuator is detected. For example, curve Y of FIG. 11A denotes relationship between a volume of the ink within the ink tank in the case of small circular oscillating region and resonance frequency fs of the ink and the oscillating section. In the range of a volume of the ink Q prior to and after the ink liquid level within the ink tank passes through the mounting position of the actuator, the appearance that resonance frequency fs of the ink and the oscillating section is dramatically changed is indicated, thereby being capable of detecting whether or not the predetermined volume of the ink within the ink tank remains.

The method for detecting the presence of a liquid using the actuator 106 detects the presence of ink by direct contact of the diaphragm 176 with a liquid, so that, as compared with the method of calculation of the ink consumption by software, the detection precision is high. Further, the method for detecting the presence of ink by the conductivity using the electrode is adversely affected by the mounting position on the ink container and ink kind, while the method for detecting the presence of a liquid using the actuator 106 is not affected by the mounting position on the ink container and ink kind. Further, both oscillation and detection of the presence of a liquid can be executed using a single actuator 106, so that, as compared with the method for executing oscillation and detection of the presence of a liquid using different sensors, the number of sensors to be attached to the ink container can be reduced. Therefore, the ink container can be manufactured at a low price. Further, when the vibration frequency of the piezo-electric layer 160 is set in the non-audible range, the sound generated during operation of the actuator 106 can be made quiet.

Figure 11B:
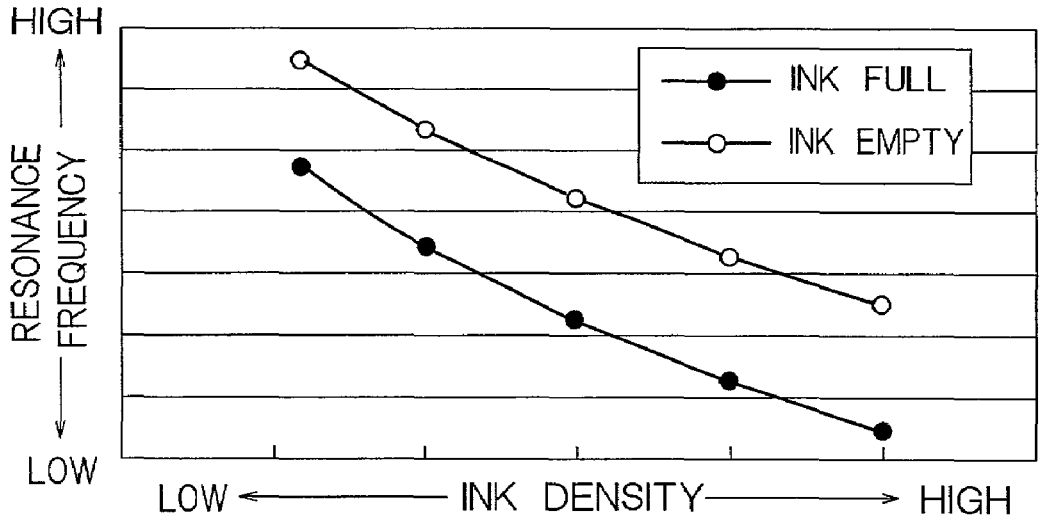

FIG. 11B shows the relationship between the density of the ink in curve Y of FIG. 11A and resonance frequency fs of the ink and oscillating section. An ink is exemplified as a liquid. As shown in FIG. 11B, as the density of the ink is increased, the additive inertance is increased, therefore, resonance frequency fs is lowered. Specifically, resonance frequencies are different depending upon kinds of inks. Therefore, by measuring resonance frequency fs, when the ink is refilled, whether or not the ink having different density is mixed is checked.

Specifically, it is possible to distinguish an ink tank containing an ink of one kind from an ink tank containing an ink of another kind.

Subsequently, conditions in which a state of the liquid when the size and shape of the cavity is set so that the liquid remains within the cavity 162 of the actuator 106 even if the liquid within the ink container is hollow can be precisely detected will be described in detail below. If the actuator 106 can detect a state of the liquid in the case where the liquid is filled within the cavity 162, it can detect a state of the liquid even in the case where the liquid is not filled within the cavity 162.

Resonance frequency fs is a function of inertance M. Inertance M is the sum of inertance M act and additive inertance M', where the additive inertance involves with a state of the liquid. Additive inertance M' is a volume indicating the apparent increase of mass of the oscillating section by the action of the medium nearby the oscillating section. Specifically, that is referred to a increment of mass of the oscillating section by apparently absorbing the medium by the oscillation of the oscillating section.

Accordingly, in the case where M'cav is larger than M'max in Expression 4, the apparently absorbed medium is all the liquid remaining within the cavity 162 and gas within the ink container or vacuum. At that time, since M' is not changed, resonance frequency fs is not changed neither. Therefore, the actuator 106 cannot detect a state of the liquid within the ink container.

On the other hand, in the case where M'cav is smaller than M'max in Expression 4, the apparently absorbed media are the remaining liquid within the cavity 162 and the gas or vacuum within the ink container. At that time, since M' is changed differently from a state where the liquid is filled within the ink container, resonance frequency fs is changed. Therefore, the actuator 106 can detect a state of the liquid within the ink container.

Specifically, in the case where the liquid within the ink container is in a state of being empty and the liquid remains within the cavity 162 of the actuator 106, the conditions in which the actuator 106 can precisely detect a state of the liquid is that M'cav is smaller than M'max. It should be noted that the conditions M'max>M'cav in which the actuator 106 can precisely detect a state of the liquid is not involved with the shape of the cavity 162.

Where M'cav is mass of the liquid having an approximately equivalent to the volume of the cavity 162. Accordingly, from the inequality of M'max>M'cav, the conditions in which the actuator 106 can precisely detect a state of the liquid can be represented as conditions for the volume of the cavity 162. For example, suppose that diameter of the opening 161 of the circular cavity 162 is a, and the depth of the cavity 162 is d, $$M'\mathrm{max} > \rho * d/\pi a^2 \qquad \text{(Expression 10)}$$

Expression 10 is expanded, the following conditions are found:

$$a/d > 3 * \pi/8 \qquad \text{(Expression 11)}$$

It should be noted that Expression 10, Expression 11 hold as far as shape of the cavity 162 is circular. When Expression of M'max in the case where it is not circular is employed and substituting its area into $\pi a^2$ in Expression 10, the relationship between dimensions such as width and length of the cavity and the depth of the cavity is led.

Therefore, the actuator 106 having the cavity 162 whose dimensions are the radius a of the opening 161 and the depth d of the cavity 162 which satisfies Expression 11 can detect a state of the liquid without malfunctions even in the case where the liquid within the ink container is empty and the liquid remains within the cavity 162.

Since additive inertance M' has influence on acoustic impedance property, it can be said that a method of measuring a counter electromotive force generated by the actuator 106 due to the residual oscillation detects at least a change of acoustic impedance.

Moreover, according to the present embodiment, the actuator 106 generates an oscillation and measures a counter electromotive force generated in the actuator 106 due to the subsequently occurred residual oscillation. However, it is not always necessary that the oscillating section of the actuator 106 gives the oscillation to the liquid by oscillation itself due to the drive voltage. Specifically, if the oscillating section itself does not oscillate, the piezoelectric layer 160 is deflected and deformed by oscillating with the liquid in a certain range in which the oscillating section contacts with the liquid. This residual oscillation causes the piezoelectric layer 160 to generate a counter electromotive force voltage and transmits its counter electromotive force voltage to the upper portion electrode 164 and the lower portion electrode 166. A state of the medium may be detected by utilizing this phenomenon. For example, in an ink jet recording apparatus, a state of the ink tank or the ink within it may be detected by utilizing the oscillation occurred on the periphery of the oscillating section of an actuator generated by the oscillation due to the reciprocating movement of the carriage by scanning of the recording head at the time when it is recording.

Figure 12A:
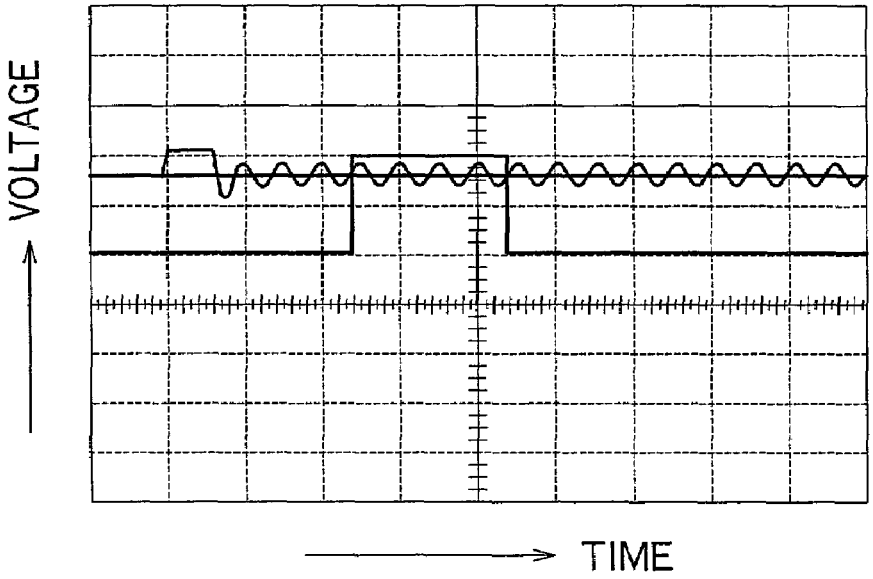
FIGS. 12A and 12B are drawings showing the measuring methods for the waveform of residual vibration of the actuator 106 after vibration of the actuator 106 and residual vibration.
Figure 12B:
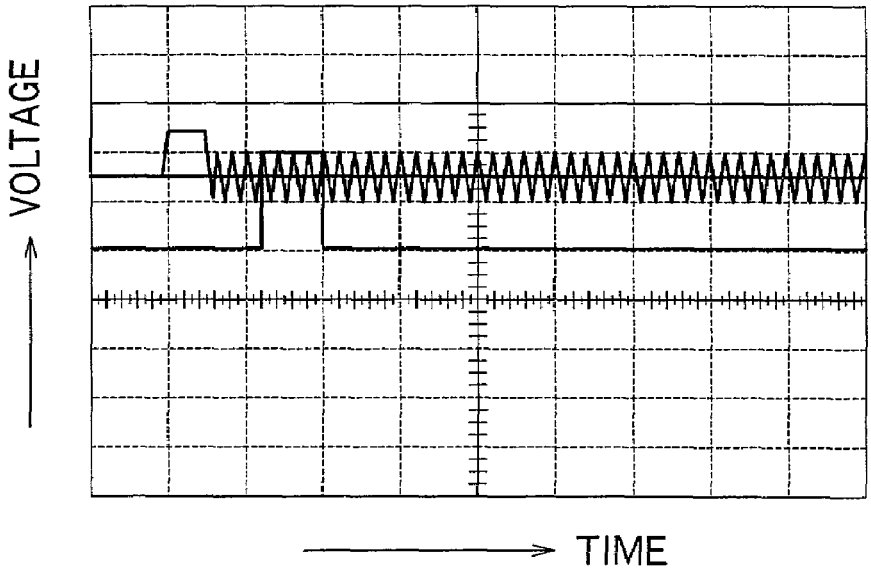

FIG. 12A and FIG. 12B show a waveform of the residual oscillation and a method of measuring the residual oscillation of the actuator 106 after the actuator 106 is made vibrated. Up and down of the ink liquid level in the mounting position level of the actuator 106 within the ink cartridge can be detected by a change of frequency of the residual oscillation and a change of the amplitude after the actuator 106 oscillates. In FIG. 12A and FIG. 12B, axis of ordinates indicates a voltage of a counter electromotive force generated by the residual oscillation of the actuator 106 and axis of abscissa indicates a time. A waveform of analogue signal of voltage as shown in FIG. 12A and FIG. 12B is generated by the residual oscillation of the actuator 106. Next, the analogue signal is converted into a digital numeric value corresponding to the frequency of the signal.

In the embodiment shown in FIG. 12A and FIG. 12B, the presence or absence of the ink is detected by measuring a time period generated by four pieces of pulse from fourth pulse to eighth pulse of the analogue signal.

More particularly, after the actuator 106 oscillates, the times that the reference voltage previously set is crossed from the lower voltage side to the higher voltage side are counted. Digital signal in the range from the fourth count to the eighth count is formed as High, a time period spanning from the fourth count to the eighth count is measured by the predetermined clock pulse.

FIG. 12A shows a waveform at the time when the ink liquid level exists at higher level than the mounting position level of the actuator 106. On the other hand, FIG. 12B shows a waveform at the time when the ink is absent at the mounting position level of the actuator 106. Comparing FIG. 12A and FIG. 12B, the waveform in FIG. 12A is longer than the waveform in FIG. 12B in the time span from the fourth count to the eighth count. In other words, time spans from the fourth count to the eighth count are different depending on the presence or absence of the ink. An ink consuming state can be detected by utilizing these differences of the time spans. The reason why the counting from the fourth count of the analogue waveform is started is because it should be started after the oscillation of the actuator 106 is stable. The counting from the fourth count is only an embodiment, the counting may be started from an optional ordinal number of count. Here, a signal from the fourth count to the eighth count is detected, and a time span from the fourth count to the eighth count is measured, thereby finding resonance frequency. A clock pulse is preferably a pulse of clock equivalent to a clock for controlling a semiconductor and the like mounted on the ink cartridge. It should be noted that it is not necessary to measure a time span until the eighth count and it may count until an optional ordinal number of count. In FIG. 12A and FIG. 12B, a time span from the fourth count to the eighth count is measured, however, a time span within the different counts of interval may be measured according to a circuit configuration in which the frequency is detected.

For example, in the case where the quality of the ink is stable and variation of the amplitude between the peaks are small, in order to speed up the detection rate, resonance frequency may be found by detecting a time span from the fourth count to the sixth count. Moreover, in the case where the quality of the ink is unstable and the variation of the amplitude of the pulse is large, in order to precisely detect the residual oscillation, a time span from the fourth count to twelfth count may be detected.

Moreover, as another embodiment, wave number of voltage waveform of counter electromotive force in the predetermined period may be counted (not shown). By this method, resonance frequency can be also found. More particularly, after the actuator 106 oscillates, a digital signal is made High only in the predetermined period, the predetermined reference voltage is crossed from the lower voltage side to the higher voltage side. The presence or absence of the ink can be detected by measuring its number of count.

Furthermore, as it is understood by comparing FIG. 12A and FIG. 12B, in the case where the ink is filled within the ink cartridge, and in the case where the ink is absent within the ink cartridge, the amplitudes of the counter electromotive forces are different. Accordingly, an ink consuming state within the ink cartridge may be detected by measuring an amplitude of a counter electromotive force. More particularly, for example, the reference voltage is set between the vertex of a counter electromotive force of FIG. 12A and the vertex of a counter electromotive force of FIG. 12B. After the actuator 106 oscillates, a digital signal is made High, in the case where the counter electromotive force crosses the reference voltage, the absence of the ink is determined. In the case where the counter electromotive force does not cross the reference voltage, the presence of the ink is determined.

Figure 13:
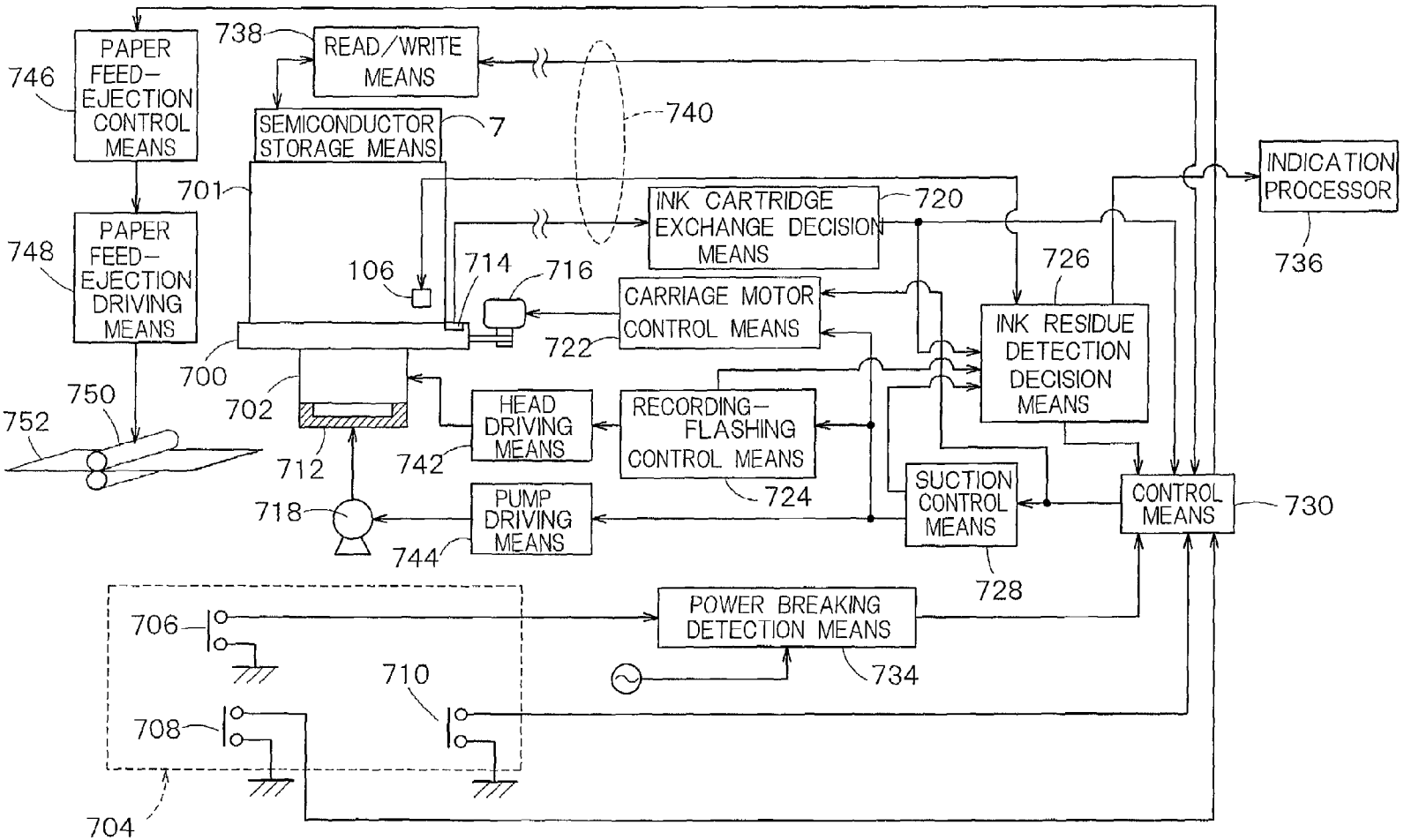
FIG. 13 is a block diagram showing the control mechanism of an ink jet recording apparatus of an embodiment of the present invention.

FIG. 13 is a block diagram showing a control mechanism of the ink jet recording apparatus of the present invention. The ink jet recording apparatus of the present invention has a recording head 702 for jetting ink drops on a recording paper 752 and recording data, a carriage 700 for moving the recording head 702 back and forth in the width direction (main scanning direction) of the recording paper 752, and an ink cartridge 701 mounted on the carriage 700 for feeding ink to the recording head 702. The carriage 700 is connected to a carriage driving motor 716. When the carriage driving motor 716 is driven, the carriage 700 and the recording head 702 move back and forth in the width direction of the recording paper 752. Upon receipt of control from a control means 730, a carriage motor control means 722 controls the carriage driving motor 716, moves the carriage 700 back and forth for printing, and moves the recording head 702 to the position of a cap 712 at the time of the jet recovery operation.

The ink jet recording apparatus further has a paper feed mechanism 750 for moving the recording paper 752 perpendicularly to the scanning direction of the recording head 702, feeding the form to the recording head 702, or ejecting the recording paper 752 from the recording head. The paper feed mechanism 750 is driven by a paper feed-ejection driving means 748. A paper feed-ejection control means 746 controls the paper feed-ejection driving means 748 on the basis of a signal of the control means 730 and executes paper feed or paper ejection.

Further, on the ink cartridge 701, an actuator 106 for detecting the ink consumption condition in the ink cartridge 701 is mounted. With respect to the actuator 106, it is preferable to use an actuator having the configuration shown in FIGS. 9A, 9B, and 9C. The ink consumption condition detected by the actuator 106 is output to an ink residue detection decision means 726 and the ink residue detection decision means 726 decides the ink residue on the basis of the detection result of the actuator 106. Further, the ink residue detection means 726 calculates the ink amount consumed by the whole recording apparatus from the number of ink drops jetted by the printing operation and flashing operation and the ink amount consumed by the charging operation and cleaning operation. The ink residue detection decision means 726 corrects the calculated ink amount on the basis of the detection result of the actuator 106 and decides the ink amount remaining in the ink cartridge 701. When the ink residue detection decision means 726 decides that there is no ink in the ink cartridge 701, it lets an indication processor 736 indicate no ink. The indication processor 736 indicates information corresponding to the actuator 106 detecting the presence of a liquid in the ink container 1. For indication of information, a display and a speaker are used.

On the ink cartridge 701, a semiconductor storage means 7 which is a memory electrically rewritable is mounted in a removable state. The semiconductor storage means 7 stores information on ink, particularly on the ink consumption amount. In addition, information on ink necessary to realize proper recording, for example, a date code such as the manufacturing date of ink, an ink material, and a removal count is stored. The semiconductor storage means 7 is connected to a read/write control means 738. The read/write control means 738 is connected to the controller 730 with a flexible cable 740. The control means 730 writes the information of the ink residue in the ink cartridge 701 detected by driving the actuator 106 by the ink residue detection decision means 726 in the semiconductor storage means 7 using the read/write means 738.

An ink cartridge exchange decision means 720 receives a signal from a switch 714 pressed by the ink cartridge 701 on the position of the carriage 700 opposite to the ink cartridge 701, that is, on the cartridge receiving surface of the carriage 700 in this embodiment and detects mounting and removal of the ink cartridge 701.

The ink jet recording apparatus loads the cap 712 for sealing the recording head 702 in the non-recording area. The cap 712 is connected to a suction pump 718 via a tube, receives negative pressure, jets ink from all the nozzles of the recording head 702, thereby cleans the nozzle openings of the recording head 702. A suction control means 728 receives control by the control means 730, seals the recording head 702 by the cap 712, controls the suction force and suction time of the suction pump 718 by a pump driving means 744, and forcibly ejects ink from the recording head 702 for recovery of the ink jet capacity. Further, the suction control means 728, when the ink cartridge 701 is exchanged, sucks ink from the ink cartridge 701 into the recording head 702, thereby fills the recording head 702 with ink, and puts the recording head 702 into a printable state.

A recording-flashing control means 724 outputs a driving signal for jetting ink drops to the recording head 702 by a head driving means 742 and makes the recording head 702 execute printing. Further, the recording-flashing control means 724 outputs the same driving signal as the aforementioned to the recording head 702 existing in the flashing position such as capping, makes the recording head 702 jet ink drops from all the nozzle openings, thereby makes it jet increased-viscosity ink into the ink receiver. By this flashing operation, clogs of the nozzle openings of the recording head 702 can be cleaned.

The ink jet recording apparatus has an operation panel 704 for operating the ink jet recording apparatus from outside. On the operation panel 704, a power switch 706 for turning the power on or off, an ink cartridge exchange command switch 708 for operating a command for exchanging the ink cartridge 701, and a head cleaning command switch 710 for operating a command for cleaning the recording head 702 are arranged. A power breaking detection means 734 detects the on or off state of the power switch 706 and outputs a signal indicating the state, and when a power off command is executed by the power switch 706, executes a predetermined power breaking process, and then stops supply of power to the equipment.

The control means 730 receives signals from the ink cartridge exchange command switch 708 of the operation panel 704, the cleaning command switch 710, the power breaking detection means 734, and the ink residue detection decision means 726 and controls the operations such the power on process, power off process, cleaning process, ink residue checking process, printing process, and ink cartridge exchange process. Further, the control means 730, at the time of turning on power, in a print stop state, or at the time of turning off power, drives the actuator 106, decides the ink consumption by the ink residue detection decision means 726, and writes the information of ink consumption into the semiconductor storage means 7.

Next, the operation of the ink jet recording apparatus will be explained. When the power is turned on by the operation of the power switch 706, the control means 730 reads the information of ink consumption in the ink cartridge 701 from the semiconductor storage means 7. Next, the control means 730 judges whether cleaning of the recording head 702 is necessary and when maintenance of the head is necessary, executes maintenance such as head cleaning. The head cleaning includes the flashing operation and cleaning operation. After end of maintenance, the control means 730 controls the ink residue detection decision means 726, drives the actuator 106, and detects the ink residue in the ink cartridge 701.

When the non-recording state is continued for a predetermined time after stopping of the carriage 700 and the recording head 702, the control means 730 controls the ink residue detection decision means 726, drives the actuator 106, and detects the ink residue in the ink cartridge 701. When a print signal is input, the recording head 702 executes printing under control of the control means 730. Ink drops jetted from the recording head 702 during printing is calculated as an ink residue by the ink residue detection decision means 726.

When the control means 730 detects the line feed operation, page feed operation, paper feed-ejection operation, or forcible print stop due to issuing of a print stop command by a user during printing, the control means 730 controls the ink residue detection decision means 726, drives the actuator 106, and detects the ink residue in the ink cartridge 701.

When the printing operation is continued for a predetermined time, the control means 730 moves the carriage 700, thereby sets the recording head 702 at the position of the cap 712, and executes the maintenance operation of the recording head 702. The control means 730 drives the head driving means 742 by the recording-flashing control means 724 as a maintenance operation and jets ink of a predetermined number of ink drops from the recording head 702. By this flashing operation, an ink of increased viscosity is ejected in the neighborhood of the nozzle opening of the recording head 702 and clogging is prevented. Ink drops ejected by the flashing operation are calculated as an ink consumption by the ink residue detection decision means 726.

Hereafter, printing is continued in this way. However, when clogging cannot be eliminated by the flashing operation and dot omission is detected by visual check of a user or by the dot omission detection means, cleaning is executed as a maintenance operation of the recording head 702.

By an operation of the cleaning command switch 710 by a user, the control means 730 moves the recording head 702 to the position of the cap 712, then drives the suction pump 718, and sucks ink form the recording head 702. Negative pressure is acted on the nozzle opening of the recording head 702 by the suction pump 718, and ink in the recording head 702 is forcibly ejected into the cap 712, and the recording head 702 is cleaned. The ink amount consumed by this cleaning is calculated as an ink consumption by the ink residue detection decision means 726. Further, the ink residue detection decision means 726 drives the actuator 106 during cleaning and detects the ink residue in the ink cartridge 701. The ink residue detection decision means 726 corrects the ink consumption obtained by calculation on the basis of the ink residue detected by the actuator 106.

When the printing ends and the power switch 706 is turned off, a signal indicating power off is output from the power breaking detection means 734 to the control means 730. The control means 730 moves the carriage 700 by the carriage motor control means 722 and seals the recording head 702 by the cap 712. Next, the ink residue detection decision means 726 drives the actuator 106 and detects the ink residue in the ink cartridge 701. The control means 730 writes the ink consumption detected by the ink residue detection decision means 726 into the semiconductor storage means 7 by the read/write means 738. At the point of time when the end of writing of the ink residue information into the semiconductor storage means 7 is ascertained, the power breaking means 734 stops supply of power to the whole equipment.

As mentioned above, the ink jet recording apparatus of this embodiment, in the non-recording state of the recording head 702, for example, at the time of turning the power on or off, or during feed or ejection of the recording paper 752, or during maintenance of the recording head 702, detects the ink consumption condition, so that the throughput of print is not reduced and the printing speed is not lowered due to detection of the ink consumption condition. Further, the ink residue is detected a predetermined time after the carriage 700 and the recording head 702 stop, so that the ink residue after the vibration of ink in the ink cartridge 701 due to movement of the carriage 700 is stopped can be detected accurately. Particularly in a liquid detection means using the actuator 106 for detecting the ink residue using vibration, the vibration of ink may cause a detection error. However, such an error is not caused and the ink residue can be detected accurately. Further, when the carriage 700 is in the stop state and the recording head 702 is in the non-recording state, the carriage driving motor 716 and the motor for driving the recording head 702 are stopped and the ink consumption can be measured free of noise generated when the carriage driving motor 716 and the motor for driving the recording head 702 are driven, so that the ink consumption can be detected more accurately.

Next, by referring to the flow charts shown in FIGS. 14 to 19, the processing flow executed by the control means 730 of the ink jet recording apparatus will be explained in detail.

Figure 14:
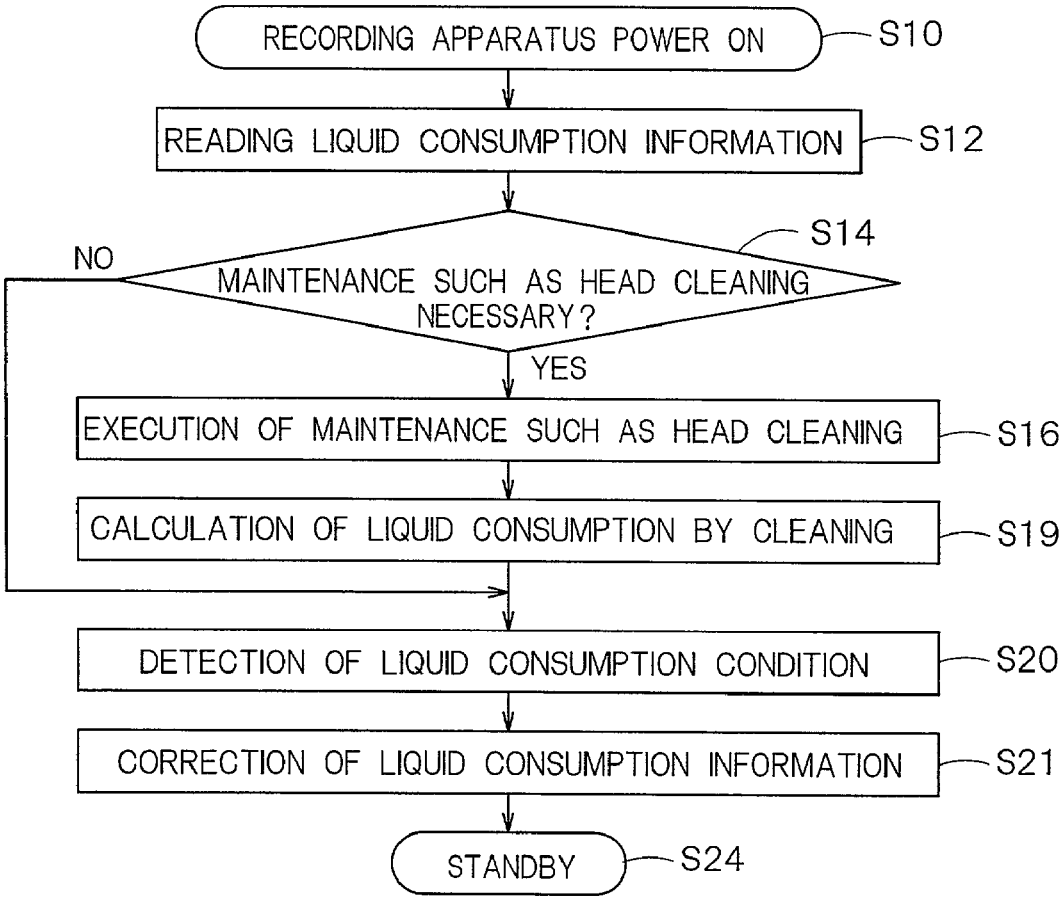

FIG. 14 shows the processing flow when the power for the recording apparatus is turned on. When the power for the recording apparatus is turned on (S10), the control means 730 reads the liquid consumption information stored in the semiconductor storage means 7 from the semiconductor storage means 7 of the ink cartridge 701 (S12). The liquid consumption information includes, for example, the manufacturing date of ink, ink residue, and opening date of the ink cartridge and on the basis of these data, the control means 730 judges whether the ink cartridge 701 can be used or not.

Next, the control means 730 judges whether maintenance such as head cleaning is necessary or not (S14) and when maintenance is not necessary (S14, NO), instructs detection of the ink residue in the ink cartridge 701 to the ink residue detection decision means 726. The ink residue detection decision means 726 drives the actuator 106 and detects the ink consumption condition in the ink cartridge 701 (S20). The ink residue detection decision means 726 corrects the liquid consumption information read from the semiconductor storage means 7 on the basis of the ink consumption condition detected by the actuator 106 (S21). After correction of the liquid consumption information by the ink residue detection decision means 726, the recording apparatus enters in the print standby state (S24).

When maintenance of the head is necessary (S14, YES), the control means 730 executes maintenance such as head cleaning (S16). For example, when a predetermined time elapses after the last use of the recording apparatus and maintenance such as cleaning is necessary for the recording head 702, the control means 730 executes head maintenance at Step S16. The head maintenance includes the flashing operation and cleaning operation. When the ink residue read from the semiconductor storage means 7 of the ink cartridge 701 first is so small as not suited to execution of head maintenance, the control means does not execute head maintenance.

Next, when the head maintenance ends (S16), the control means 730 calculates the ink residue on the basis of the ink amount used for the head maintenance using the ink residue detection decision means 726 (S19). Further, the control means 730 instructs detection of the ink residue in the ink cartridge 701 using the actuator 106 to the ink residue detection decision means 726. The ink residue detection decision means 726 drives the actuator 106 and detects the ink consumption condition in the ink cartridge 701 (S20). The ink residue detection decision means 726 corrects the ink residue calculated from the ink use amount in the head maintenance on the basis of the ink residue detected by the actuator 106 (S21). After correction of the ink residue by the ink residue detection decision means 726, the recording apparatus enters in the print standby state (S24).

When the power is turned on, the recording apparatus is in the non-recording state, so that the throughput of print is not reduced and the printing speed is not lowered due to detection of the ink consumption condition. Further, the carriage 700 and the recording head 702 are stopped, so that the ink residue when the ink in the ink cartridge 701 is not vibrating can be detected. Further, the carriage driving motor 716 and the motor for driving the recording head 702 are stopped, so that the ink consumption can be measured free of noise generated when the carriage driving motor 716 and the motor for driving the recording head 702 are driven and the ink consumption can be detected more accurately.

Figure 15:
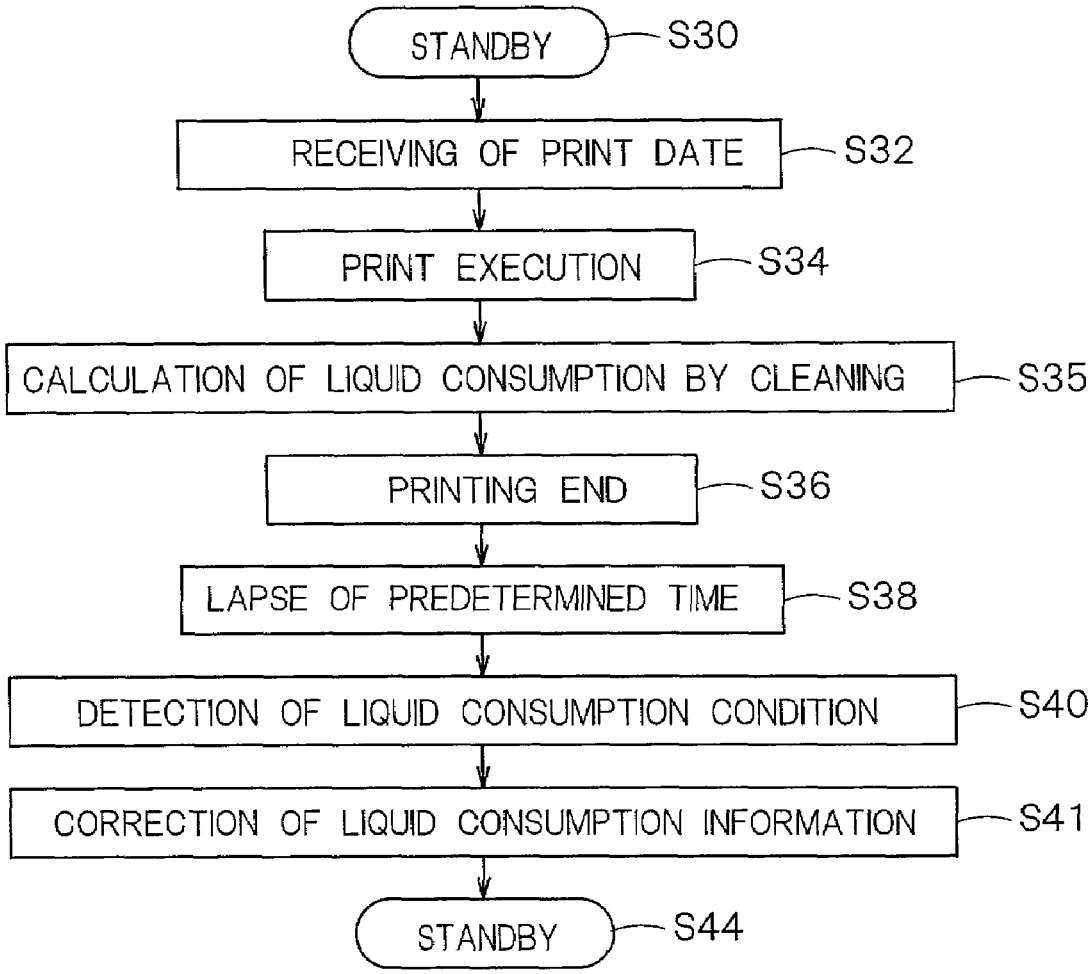
FIG. 15 is a drawing showing the process (S130) flow to be performed by a control means 730 during printing.

FIG. 15 shows the flow of the process (S130) performed by the control means 730 during printing. Upon receipt of print data from a host device not shown in the drawing in the standby state (S30) (S32), the control means 730 prepares a print image from the print data, drives the recording head 702, and prints the print image on the recording paper 752 (S34). The control means 730 calculates the ink amount used in printing using the ink residue detection decision means 726 during printing, thereby calculates the ink residue in the ink cartridge 710 (S35). Concretely, the control means calculates the number of jetted dots and the ink amount used for one dot, calculates the used ink amount, subtracts the used ink amount from the ink residue in the ink cartridge, and calculates the ink residue.

When the printing ends (S36) and a predetermined time elapses (S38), the control means 730 instructs detection of the ink residue in the ink cartridge 701 to the ink residue detection decision means 726. The ink residue detection decision means 726 drives the actuator 106 and detects the ink consumption condition in the ink cartridge 701 (S40). The ink residue detection decision means 726 corrects the ink residue obtained by calculation on the basis of the ink consumption condition detected by the actuator 106 (S41). Thereafter, the recording apparatus enters in the print standby state (S44).

The control means 730 detects the ink consumption condition in the non-recording state after end of printing, so that the throughput of print is not reduced and the printing speed is not lowered due to detection of the ink consumption condition. Further, the ink residue is detected a predetermined time after the carriage 700 and the recording head 702 stop, so that the ink residue after the vibration of ink in the ink cartridge 701 due to movement of the carriage 700 is stopped can be detected accurately. Further, when the carriage 700 is in the stop state and the recording head 702 is in the non-recording state, the carriage driving motor 716 and the motor for driving the recording head 702 are stopped and the ink consumption can be measured free of noise generated when the carriage driving motor 716 and the motor for driving the recording head 702 are driven, so that the ink consumption can be detected more accurately.

Figure 16:
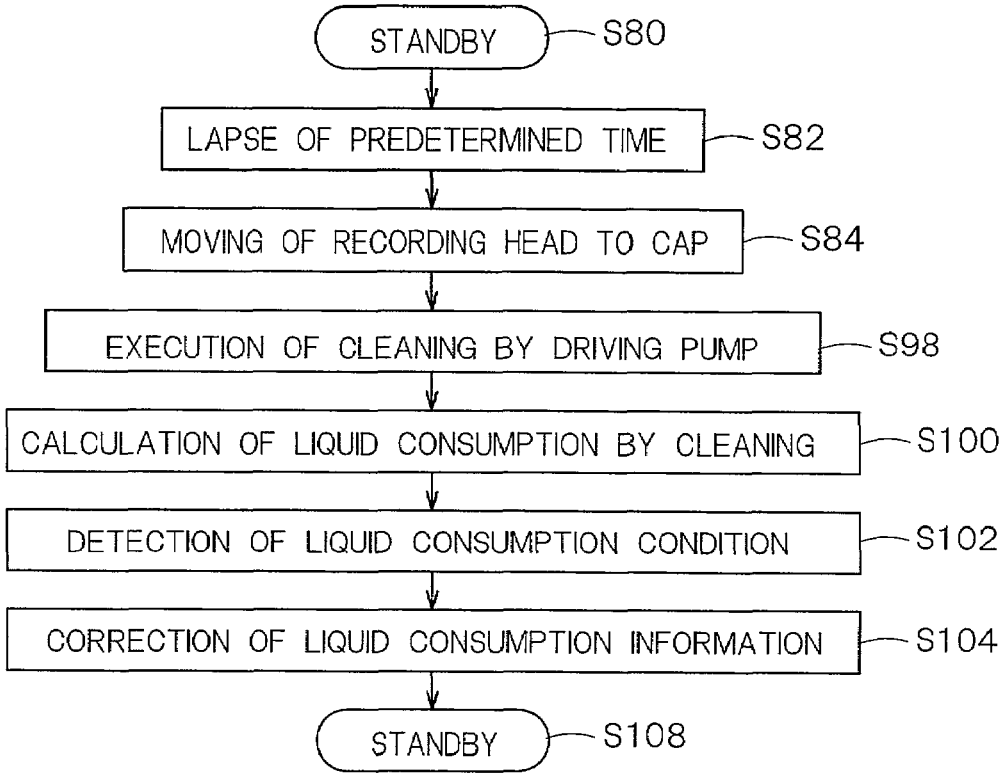
FIG. 16 is a drawing showing the process flow during maintenance of the recording head.

FIG. 16 shows the processing flow during maintenance of the recording head. When a predetermined time elapses in the standby state (S80) (S82), the control means 730 moves the recording head 702 to the position of the cap 712 and enables the cleaning operation (S84). After moving the recording head 702 to the position of the cap 712, the control means 730 drives the suction pump 718, sucks ink from the recording head 702, and forcibly ejects ink in the recording head 702 (S98). The ink amount consumed by cleaning is calculated by the ink residue detection decision means 726 and the ink residue in the ink cartridge 701 is calculated (S100). Further, the ink residue detection decision means 726 drives the actuator 106 during the cleaning operation and detects the ink residue in the ink cartridge 701 (S102). The ink residue detection decision means 726 corrects the ink residue obtained by calculation on the basis of the ink residue detected by the actuator 106 (S104). Thereafter, the recording apparatus enters in the print standby state (S108).

The printing operation is stopped during the maintenance operation of the recording head 702 and the ink consumption condition is detected in the print stop state, so that the throughput of print is not reduced and the printing speed is not lowered due to detection of the ink consumption condition. Further, the ink residue is detected when the carriage 700 and the recording head 702 are stopped, so that the ink residue when the ink in the ink cartridge 701 is not vibrating can be detected. Further, the carriage driving motor 716 and the motor for driving the recording head 702 are stopped and the ink consumption can be measured free of noise generated when the carriage driving motor 716 and the motor for driving the recording head 702 are driven, so that the ink consumption can be detected more accurately.

Further, when the ink consumption during cleaning of the recording head 702 is comparatively large, thus the actuator 106 is arranged so as to detect passing of the liquid level, passing of the liquid level during the cleaning operation can be detected surely. Furthermore, by detecting a detection of passing of the liquid level at any timing of the whole period of the cleaning operation, the liquid level at end time of cleaning can be found.

Figure 17:
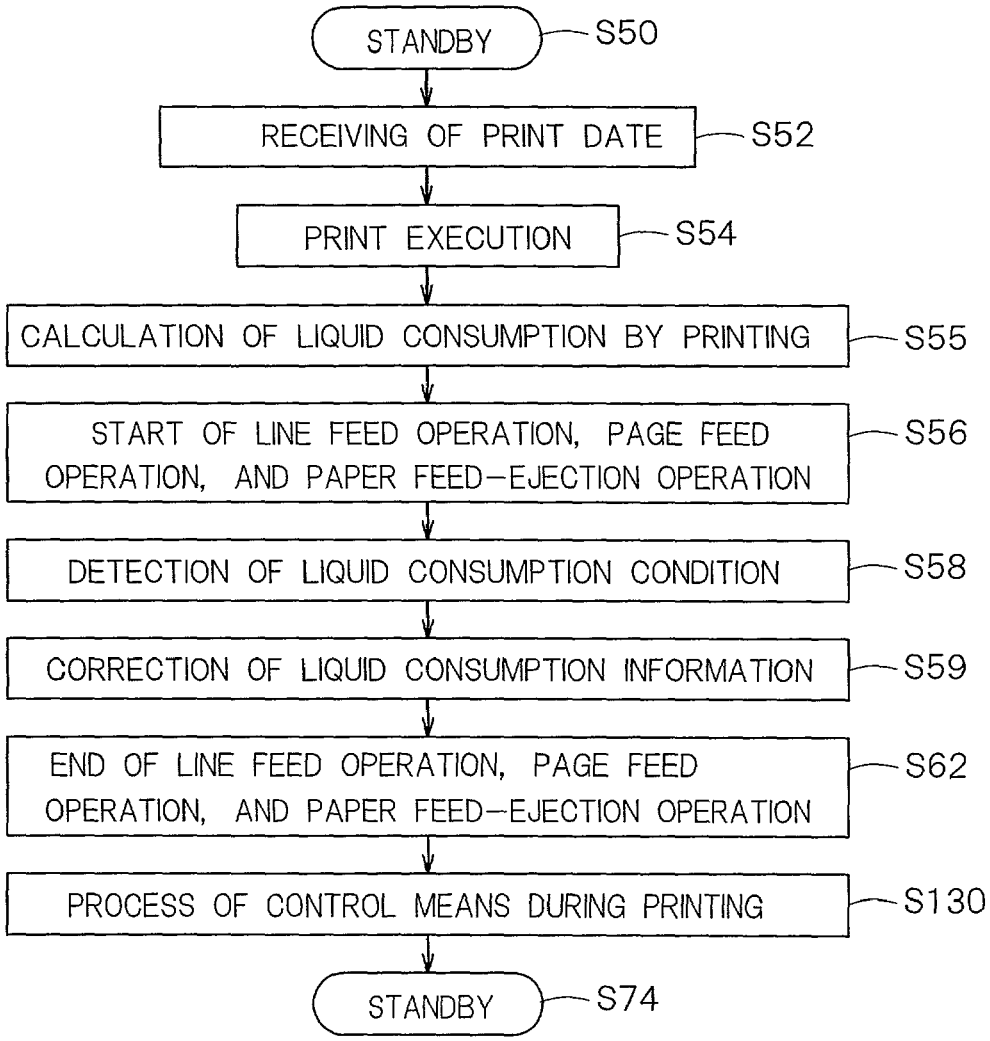
FIG. 17 is a drawing showing the process flow to be performed by the control means 730 during feed and ejection of a recording paper 752.

FIG. 17 shows the flow of the process performed by the control means 730 during feeding or ejecting of the recording paper 752. Upon receipt of print data from a host device not shown in the drawing in the standby state (S50) (S52), the control means 730 prepares a print image from the print data, drives the recording head 702, and prints the print image on the recording paper 752 (S54). The control means 730 calculates the ink amount used in printing using the ink residue detection decision means 726 during printing, thereby calculates the ink residue in the ink cartridge 710 (S55). When printing is stopped due to start of the line feed operation, page feed operation, or paper feed-ejection operation during execution of printing (S56), during execution of the line feed operation, page feed operation, or paper feed-ejection operation, the control means 730 controls the ink residue detection decision means 726, drives the actuator 106, and detects the ink residue in the ink cartridge 701 (S58). The ink residue detection decision means 726 corrects the ink residue obtained by calculation on the basis of the ink consumption condition detected by the actuator 106 (S59). When the line feed operation, page feed operation, or paper feed-ejection operation ends (S62), the process (S130) of the control means during printing shown in FIG. 14 is restarted from the print execution step (S34). After end of the liquid consumption information correction (S41), the recording apparatus enters the print standby state (S74).

The printing operation is stopped during feed or ejection of the recording paper 752 and the ink consumption condition is detected in that state, so that the throughput of print is not reduced and the printing speed is not lowered due to detection of the ink consumption condition. Further, the ink residue is detected when the carriage 700 and the recording head 702 are stopped, so that the ink residue when the ink in the ink cartridge 701 is not vibrating can be detected accurately. Further, the carriage driving motor 716 and the motor for driving the recording head 702 are stopped and the ink consumption can be measured free of noise generated when the carriage driving motor 716 and the motor for driving the recording head 702 are driven, so that the ink consumption can be detected more accurately.

Figure 18:
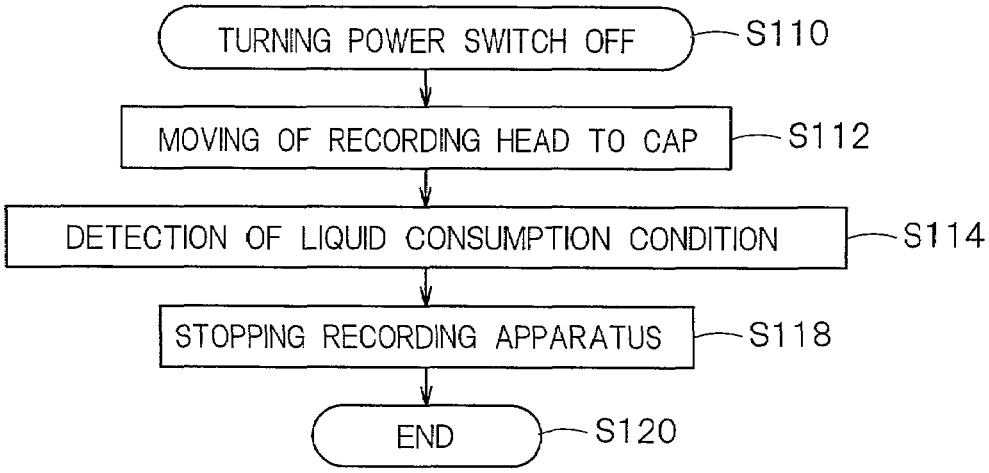
FIG. 18 is a drawing showing the process flow to be performed by the control means 730 when the power source is off.

FIG. 18 shows the flow of the process performed by the control means 730 when the power is off. When the power switch 706 is turned off (S110), the control means 730 moves the carriage 700 by the carriage motor control means 722 and seals the recording head 702 by the cap 712 (S112). Next, the ink residue detection decision means 726 drives the actuator 106 and detects the ink residue in the ink cartridge 701 (S114). Thereafter, the power breaking means 734 stops supply of power to the whole recording apparatus (S118) and the process ends (S120).

The ink consumption condition is detected when the power is off, so that the throughput of print is not reduced and the printing speed is not lowered due to detection of the ink consumption condition. Further, the ink residue when the ink in the ink cartridge 701 is not vibrating can be detected accurately. Further, the carriage driving motor 716 and the motor for driving the recording head 702 are stopped and the ink consumption can be measured free of noise generated when the carriage driving motor 716 and the motor for driving the recording head 702 are driven, so that the ink consumption can be detected more accurately.

Figure 19:
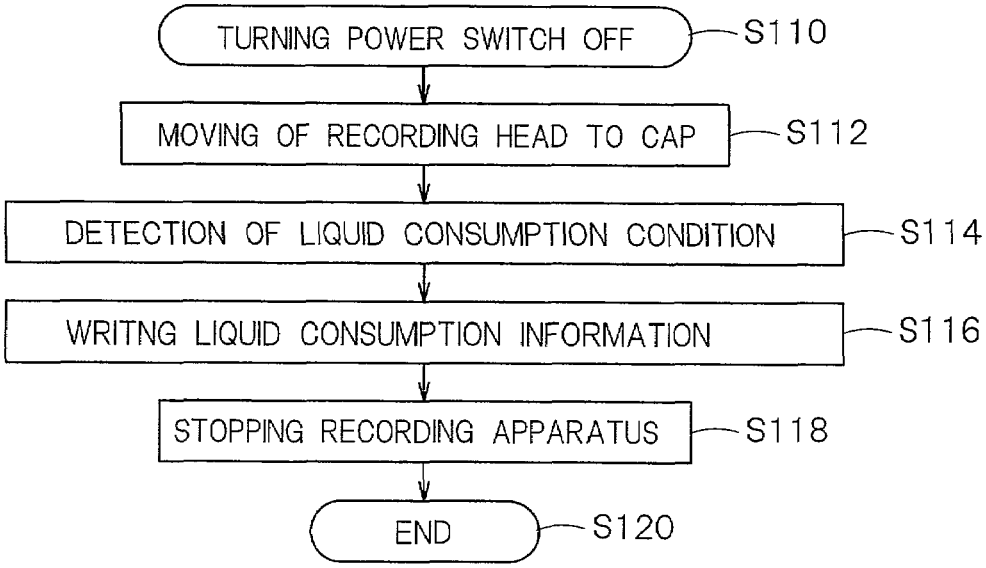
FIG. 19 is a drawing showing another example of the process flow to be performed by the control means 730 when the power source is off.

FIG. 19 shows another embodiment of the flow of the process performed by the control means 730 when the power is off. The process from driving of the actuator 106 to detection of the ink residue in the ink cartridge 701 (S114) is the same as that of the process flow shown in FIG. 18. After the ink residue detection process, the control means 730 writes the information of ink residue output by the ink residue detection decision means 726 into the semiconductor storage means 7 as liquid consumption information (S116). After the liquid consumption information is written into the semiconductor storage means 7, the power breaking means 734 stops supply of power to the whole recording apparatus (S118) and the process ends (S120).

When the information of ink residue in the ink cartridge 701 detected by the actuator 106 when the power is off is stored in the semiconductor storage means 7, the control means 730 reads the information of ink residue stored in the semiconductor storage means 7 when the ink cartridge 701 is attached to the recording apparatus again and can control the recording apparatus on the basis of the read information of ink residue.

Next, the other embodiments of the present invention will be explained.

Figure 20:
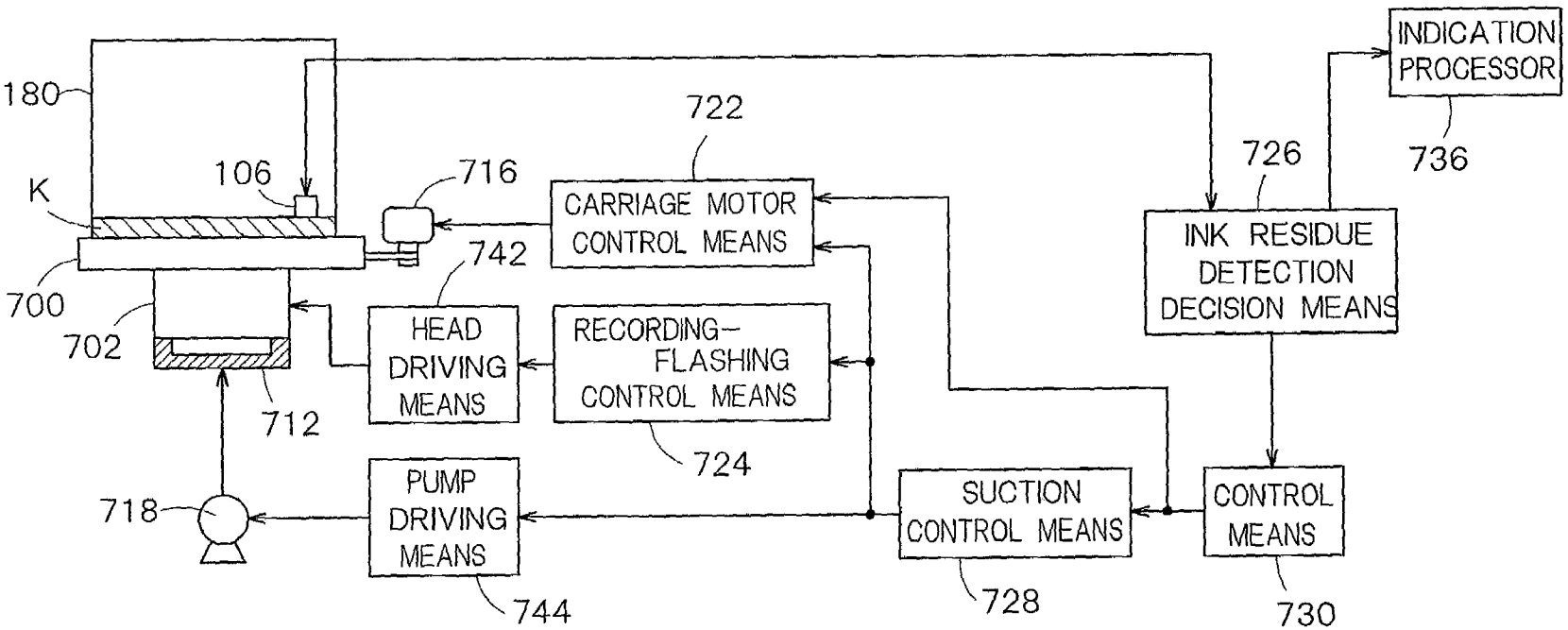
FIG. 20 is a block diagram showing the control mechanism of an ink jet recording apparatus of an embodiment of the present invention.

FIG. 20 is a block diagram showing the control mechanism of the ink jet recording apparatus of this embodiment. The ink jet recording apparatus has a recording head 702 for jetting ink drops on a recording paper 752 and recording data, a carriage 700 for moving the recording head 702 back and forth in the width direction (main scanning direction) of the recording paper 752, and an ink cartridge 701 mounted on the carriage 700 for feeding ink to the recording head 702. The carriage 700 is connected to a carriage driving motor 716. When the carriage driving motor 716 is driven, the carriage 700 and the recording head 702 move back and forth in the width direction of the recording paper 752. Upon receipt of control from a control means 730, a carriage motor control means 722 controls the carriage driving motor 716, moves the carriage 700 back and forth for printing, and moves the recording head 702 to the position of a cap 712 at the time of the flashing and cleaning operations.

Further, on the ink cartridge 180, the actuator 106 which is an embodiment of the piezo-electric device for detecting the ink consumption condition in the ink cartridge 180 is mounted. The actuator 106 is formed by a piezo-electric element, detects changes in the acoustic impedance in correspondence to changes in the ink residue, thereby can detect the ink residue in the ink cartridge 180. The piezo-electric device is not limited to the configuration of the actuator 106 and a sensor of another configuration may be used. The ink consumption condition detected by the actuator 106 is output to the ink residue detection decision means 726 and the ink residue detection decision means 726 decides the ink residue on the basis of the detection result of the actuator 106. When the ink residue detection decision means 726 decides that there is no ink in the ink cartridge 180, it makes the indication processor 736 indicate no ink. The indication processor 736 indicates the corresponding information to the actuator 106 detecting the presence of a liquid in the ink container 1. For indication of the information, the display and speaker are used.

The ink jet recording apparatus loads the cap 712 for sealing the recording head 702 in the non-recording area. The cap 712 is connected to the suction pump 718 via a tube, receives negative pressure, jets ink from all the nozzles of the recording head 702, thereby cleans the nozzle openings of the recording head 702. The suction control means 728 receives control by the control means 730, controls the carriage motor control means 722, thereby moves the recording head 702 to the position of the cap 712, seals it by the cap 712, controls the suction force and suction time of the suction pump 718 by the pump driving means 744, and forcibly jets ink from the recording head 702 for recovery of the ink jet capacity.

The recording-flashing control means 724 outputs a drive signal for jet of ink drops to the recording head 702 by the head driving means 742 and makes it execute printing. Further, the recording-flashing control means 724 outputs a drive signal to the recording head 702 moving to the position of the cap 712 and makes it jet ink drops from all the nozzle openings, thereby jets ink of increased viscosity to the ink receiver. The flashing operation can clean clogs of the nozzle openings of the recording head 702. Upon receipt of a signal from the ink residue detection decision means 726, the control means 730 controls the operations of the flashing process, cleaning process, ink residue checking process, and print processing.

An ink consumption condition detecting method which is an embodiment of the present invention using the ink jet recording apparatus shown in FIG. 20 will be explained hereunder. When ink K in the ink cartridge 180 mounted on the ink jet recording apparatus is consumed and the ink level is lowered below the mounting position of the actuator 106, the actuator 106 detects that there is not ink K in the ink cartridge 180 and informs the ink residue detection decision means 726 of it.

However, when the actuator 106 detects ink end, the ink K in the ink cartridge 180 is not always consumed completely and ink K may remain below the mounting position in the actuator 106. When air bubbles are attached in the neighborhood of the actuator 106, the same may be also caused. To effectively use ink K remaining in the ink cartridge 180, in this embodiment, the ink cartridge 180 is moved, thus the ink K in the ink cartridge 180 is vibrated. The ink residue is detected by the actuator 106 when the ink K is vibrating, so that when a small amount of ink K remains in the ink cartridge 180, the actuator 106 detects the presence of ink K and the residual ink can be used.

Further, ink K is collected or hardened in a complicatedly-shaped part of the groove or hole in the ink cartridge, so that the actuator 106 may detect a smaller amount of ink K than the actual and inform ink end. In this case, the ink cartridge 180 is vibrated and stirred, thus the ink K collected or hardened in the complicatedly-shaped part is made even or dissolved, and the residual ink K can be used effectively.

For example, when the actuator 106 detects that there is not ink K in the ink cartridge 180, the ink residue detection decision means 726 informs the control means 730 of ink end. Then, the control means 730 controls the carriage motor control means 722, drives the carriage drive motor 716, and moves the carriage 700 for a predetermined time. The ink cartridge 180 mounted on the carriage 700 moves together with the carriage 700, so that the ink K in the ink cartridge 180 is vibrated. When the ink cartridge 180 is vibrated, the level of the ink K may be higher than the mounting position of the actuator 106. By detecting the ink consumption condition by the actuator 106 during moving of the carriage 700, when only a small amount of ink K exists in the ink cartridge 180, the actuator 106 can detect that there is ink K in the ink cartridge 180.

At the time of moving of the carriage 700, the moving speed of the carriage 700 is preferably faster than the moving speed at the time of normal recording of the carriage 700. When the carriage 700 moves at a fast speed, the level of the ink K when it vibrates rises larger and when a small amount of ink K exists in the ink cartridge 180, it can be detected, so that the ink in the ink cartridge 180 can be used effectively.

Further, when the actuator 106 detects that there is no ink in the ink cartridge 180, it moves the carriage 700, thereby stirs the ink K in the ink cartridge 180, and can make even or dissolve the ink collected or hardened in the complicatedly-shaped part in the ink cartridge 180. At the time of moving of the carriage 700, when the moving speed of the carriage 700 is made faster than the moving speed at the time of normal recording of the carriage 700, the ink in the ink cartridge 180 can be stirred more effectively.

Further, when the ink K consumption condition is detected several times during moving of the carriage 700 and it is detected even once that there is ink K in the ink cartridge 180, it may be decided that ink K remains in the ink cartridge 180. By this operation, when even a small amount of ink K remains in the ink cartridge 180, the presence of ink K can be detected. Further, the ink K consumption condition is detected several times during moving of the carriage 700 and whether there remains ink K in the ink cartridge 180 or not may be decided on the basis of the mean value of a plurality of detection results. Using the mean value of a plurality of detection results, a detection error can be suppressed. In this case, the detection result indicates the detection amount detected by a sensor so as to detect the consumption and in a case of an actuator, it indicates a quantity such as resonance frequency or vibration amplitude and in a case of an optical sensor, it indicates a light quantity of reflection or transmission.

Further, when a predetermined time elapses after end of movement of the carriage 700, the ink residue in the ink cartridge 180 may be measured using the actuator 106. In this case, the actuator 106 detects the ink residue after the level of ink K in the ink cartridge 180 stops, so that the ink residue can be detected accurately. Further, the ink residue can be detected without being adversely affected by noise generated by driving the recording head 180 and the carriage 700. The object of moving the carriage 700 in a case of measurement of the ink residue after stopping of the carriage 700 is to increase the ink amount which can be used by making even or dissolving ink collected or hardened in the complicatedly-formed part in the ink cartridge 180 by stirring ink K in the ink cartridge 180.

Further, the cycle of movement of the carriage 700 and redetection of ink residue by the actuator 106 may be executed several times. For example, when the cycle of movement of the carriage 700 and ink residue detection by the actuator 106 is executed several times and the actuator 106 detects the presence of ink even once, it may be decided that there is ink in the ink cartridge 180. The carriage is moved several times, and the number of stirring of ink is increased, and when the actuator 106 detects the presence of ink even once, the presence of ink is decided, thus it is prevented that, although there is ink in the ink cartridge 180, absence of ink is decided and ink is not used effectively.

Further, the cycle of movement of the carriage 700 and ink residue detection by the actuator 106 is executed several times, and the average of the ink residue detection results by the actuator 106 is calculated, and whether there is ink in the ink cartridge 180 or not may be decided on the basis of the calculated mean value. The ink residue is detected several times and the average is obtained, thus detection errors are reduced, and whether ink remains in the ink cartridge 180 or not can be judged accurately.

As a result of the twice ink residue detections by the actuator 106 mentioned above, when the ink residue detection decision means 726 decides that there is ink in the ink cartridge 180, the ink jet recording apparatus enters the recording standby state or recording state. When the ink residue detection decision means 726 decides ink end again, the control means 730 performs a predetermined low ink amount countermeasure. The low ink amount countermeasure, in consideration of a small amount of residual ink, is a process of prohibiting or suppressing an operation of the recording apparatus such as unsuitable printing.

As a low ink amount countermeasure, the control means 730 makes the indication processor 736 indicate ink end. The indication processor 736 includes a display and a speaker and informs a user of the ink jet recording apparatus of ink end by the display and speaker. Further, the control means 730 stops movement of the carriage 700 by the carriage motor control means 722, and stops the recording head via the recording-flashing control means 724 and the head driving means 742, thereby stops the printing operation and suppresses consumption of ink K. Further, the control means 730 stops the flashing operation by the recording-flashing control means 724 and suppresses consumption of ink K. Further, the control means 730 controls the suction control means 728 and the pump driving means 744, prohibits the cleaning operation, and suppresses consumption of ink K in the ink cartridge 180 due to the cleaning operation.

Figure 21:
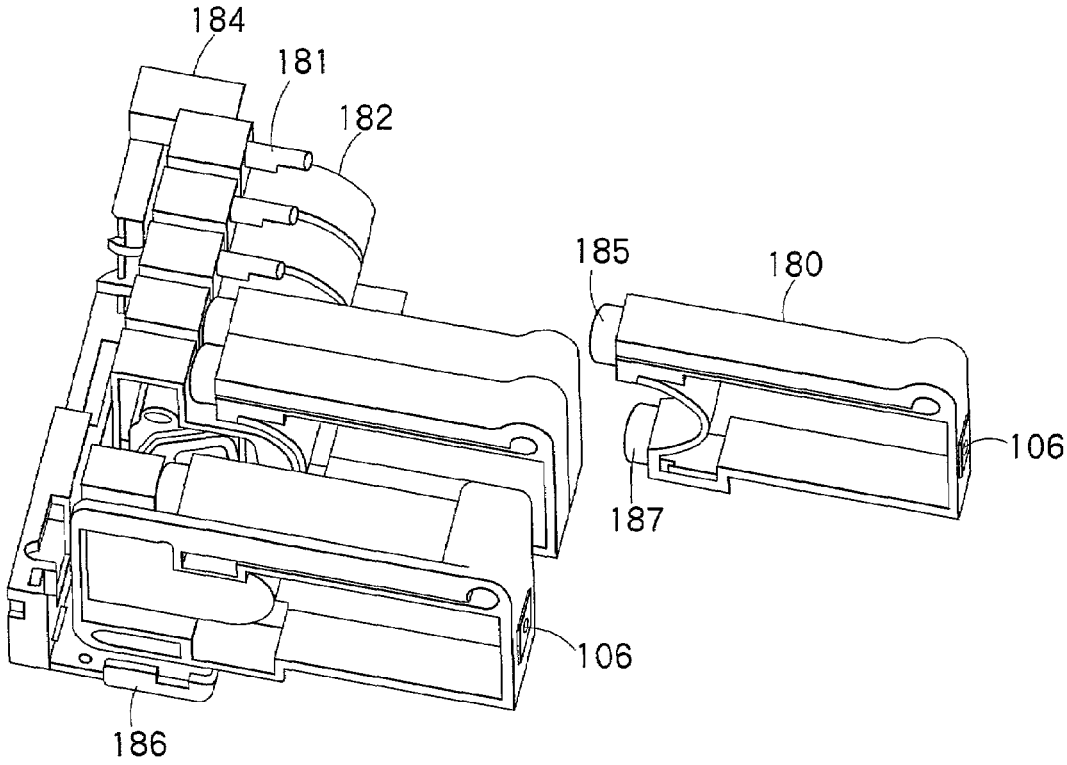
FIG. 21 is a drawing showing a concrete example of the ink cartridge and ink jet recording apparatus shown in FIG. 1.

FIG. 21 shows a concrete example of the ink cartridge and ink jet recording apparatus shown in FIG. 20. A plurality of ink cartridges 180 are mounted on the ink jet recording apparatus having a plurality of ink introduction parts 182 and recording heads 186 corresponding to the respective ink cartridges 180. The plurality of ink cartridges 180 store inks of different kinds of, for example, colors, respectively. On the respective sides of the plurality of ink cartridges, the actuator 106 which is a means for, at least, detecting acoustic impedance is mounted. When the actuator 106 is mounted on the ink cartridge 180, the ink residue in the ink cartridge 180 can be detected.

The ink jet recording apparatus has the ink introduction parts 182, a holder 184, and the recording heads 186. Ink is jetted from each recording head 186 and the recording operation is executed. Each ink introduction part 182 has an air feed port 181 and an ink introduction port not shown in the drawing. The air feed ports 181 feed air to the ink cartridges 180. The ink introduction ports introduce ink from the ink cartridges 180. Each ink cartridge 180 has an air introduction port 185 and an ink feed port 187. The air introduction ports 185 introduce air from the air feed ports 181 of the ink introduction parts 182. The ink feed ports 187 feed ink to the ink introduction ports of the ink introduction parts 182. When the ink cartridges 180 introduce air from the air introduction ports 185, feed of ink to the ink jet recording apparatus is urged by the ink cartridges 180. The holder 184 interconnects ink fed from the ink cartridges 180 via the ink introduction parts 182 to the recording heads 186.

Figure 22:
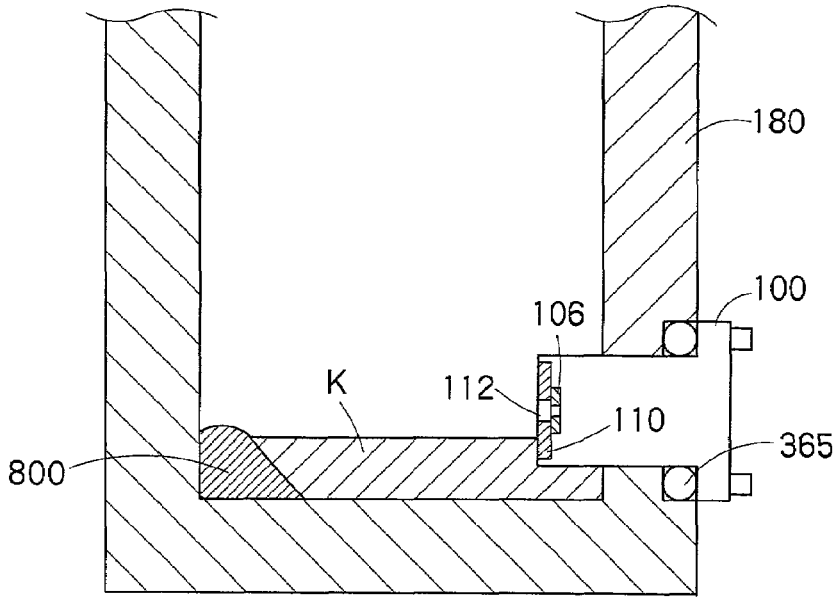
FIG. 22 is a sectional view of the neighborhood of the bottom of an ink container when the module body 100 with the actuator 106 installed at its end is mounted on the ink cartridge 180.

FIG. 22 is a sectional view of the neighborhood of the bottom of an ink container when the module body 100 with the actuator 106 installed at its end is mounted on the ink cartridge 180. The module body 100 is mounted so as to pass through the side wall of the ink cartridge 180. On the junction surface between the side wall of the ink cartridge 180 and the module body 100, an O-ring 365 is installed and maintains the liquid tightness between the module body 100 and the ink container 180. The module body 100 preferably has a cylindrical part so as to be sealed by the O-ring. When the end of the module body 100 is inserted into the ink cartridge 180, ink in the ink cartridge 180 makes contact with the actuator 106 via the through hole 112 of the plate 110. The acoustic impedance detected by the actuator 106 is changed depending on a liquid or gas existing around the vibration part of the actuator 106, so that the ink consumption condition can be detected using the module body 100.

In FIG. 22, the level of ink K is positioned in the neighborhood of the through hole 112. Since ink K is not in contact with the actuator 106 at this point of time, the actuator 106 detects absence of ink. In this case, to detect presence of ink K below the mounting position of the actuator 106, the carriage 700 moves and the actuator 106 detects the ink residue during moving of the carriage 700. Since the level of ink K in the ink cartridge 180 vibrates during moving of the carriage 700, the level of ink K rises above the mounting position of the actuator 106 and the presence of ink K below the mounting position of the actuator 106 can be detected.

Further, even when although the level of ink K is above the actuator 106, air bubbles are attached in the neighborhood of the actuator 106 and absence of ink is detected by mistake, the liquid level is vibrated by movement of the carriage, thus air bubbles are removed and the presence of ink can be detected. Further, ink K is hardened in the ink cartridge 180 and a hardened article 800 may be formed. The carriage 700 is moved and ink K in the ink cartridge 180 is stirred, thus the hardened article 800 is dissolved. The ink residue is detected during moving of the carriage 700, thus the presence of ink below the mounting position of the actuator 106 can be detected and used effectively. Further, when the ink residue is to be detected by the actuator 106 a predetermined time after end of movement of the carriage 700, if ink K is stirred, thus the hardened article 800 is dissolved and the level of ink rises above the actuator 106, the ink remaining in the ink cartridge 180 can be detected.

Figure 23A:
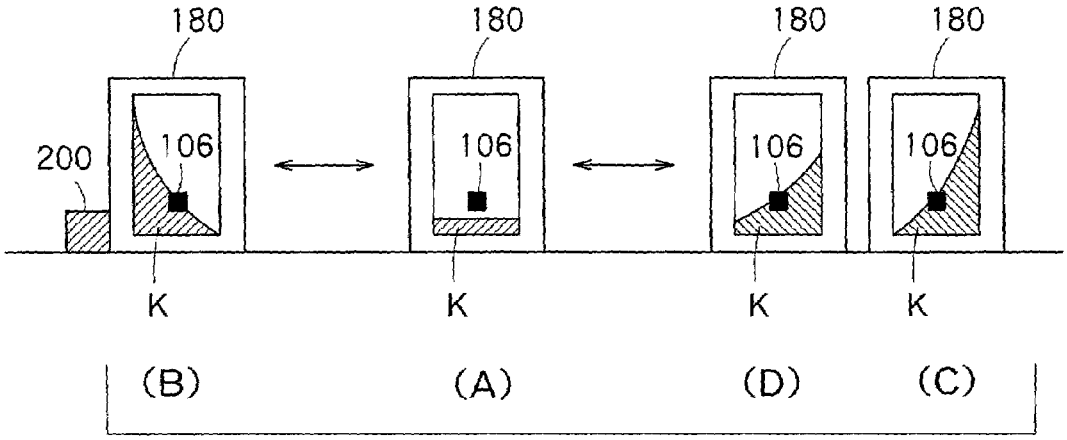
FIGS. 23A and 23B are drawings showing the operation for moving the ink cartridge 180 by moving a carriage 700 when the actuator 106 detects absence of ink and detecting the ink consumption condition again by the actuator 106.

FIG. 23A shows the operation for moving the ink cartridge 180 by moving the carriage 700 when the actuator 106 detects absence of ink and detecting the ink consumption condition again by the actuator 106. FIG. 23A(A) shows the condition that the ink cartridge 180 is at a standstill. FIG. 23A(B) shows the condition that the ink cartridge 180 moves from the central position of FIG. 23A(A) to the left end of FIG. 23A. Here, the movement to the left is referred to as a forward path. On the other hand, FIG. 23A(C) shows the condition that the ink cartridge 180 moves from the left end of FIG. 23A(B) to the right end. Here, the movement to the right is referred to as a backward path. FIG. 23A(D) shows the condition immediately after the ink cartridge 180 turns from the forward path to the backward path.

In the standstill state of the ink cartridge 180 shown in FIG. 23A(A), the level of ink K is lower than the actuator 107. Therefore, the actuator 106 detects ink end. In this case, when the ink cartridge 180 is moved in the direction of the forward path, that is, to the left, at the left end shown in FIG. 23A(B), the level of ink K is moved and inclined to the left in the ink cartridge 180. Next, when the ink cartridge 180 is moved in the direction of the backward path, that is, to the right, at the right end shown in FIG. 23A(C), the level of ink K is moved and inclined to the right in the ink cartridge 180 and the ink level is temporarily higher than the mounting position of the actuator 106. At this time, when the ink residue is measured by the actuator 106, ink existing below the mounting position of the actuator 106 can be detected. Further, ink is vibrated right and left, thus the hardened article 800 of ink K can be stirred and dissolved, so that the ink residue measured lower than the true residue can be measured accurately.

Further, as shown in FIG. 23A(B), a projection 200 is installed at the left end of movement of the carriage 700, and when the carriage 700 reaches the left end, the ink cartridge 180 collides with the projection 200, thus a shock may be given to the ink cartridge 180. When a shock is given to the ink cartridge 180, ink K is stirred, and the hardened article of ink K is dissolved, and ink collected in a complicatedly formed part of the ink cartridge 180 is removed, thus the ink remaining in the ink cartridge can be used effectively.

Further, when a predetermined time elapses after the movement of the carriage 700 ends and the ink cartridge 180 returns to the original position shown in FIG. 23A(A), the ink residue may be measured by the actuator 106. In this case, when ink K is stirred, and the hardened article 800 is dissolved, and the ink level rises above the actuator 106, the ink remaining in the ink cartridge 180 can be detected. It is preferable to move the ink cartridge 180 in the forward path and backward path several times, fully stir the ink K, and then measure the ink residue.

Figure 23B:
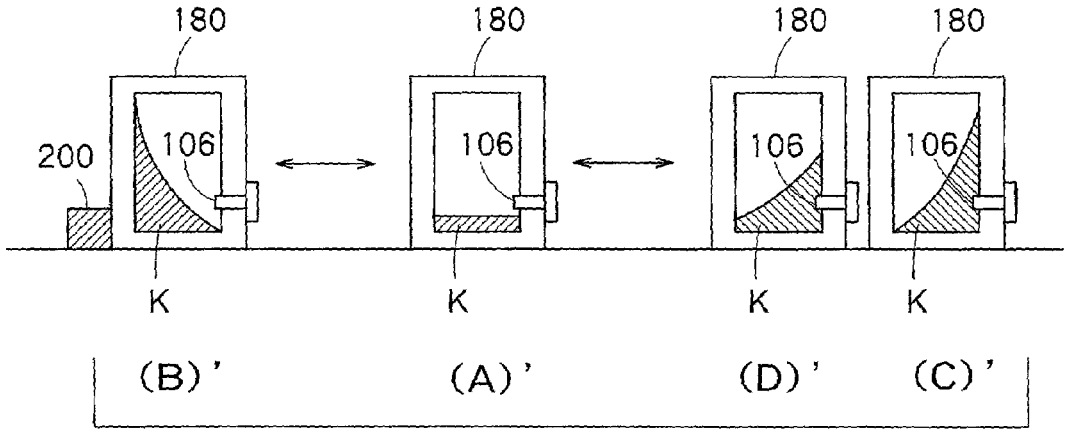

Further, unless the ink residue is measured when the ink cartridge 180 almost returns from the forward path to the backward path as shown in FIG. 23A(C), the ink residue may be measured immediately after the ink cartridge 180 returns from the forward path to the backward path as shown in FIG. 23A(D). Even at this point of time, the level of ink K inclined on the right is higher than the actuator 106, so that the actuator 106 can detect presence of ink. Further, as shown in FIG. 23A(B), the level of ink K rises above the actuator 106 when the ink cartridge 180 collides with the projection 200 or the ink cartridge 180 moves from the backward path to the forward path and reaches the left end, so that at such a time, the presence of ink may be detected using the actuator 106. FIGS. 23B(A)', (B)', (C)', and (D)' show a case that the actuator 106 shown in FIGS. 23A(A) to (D) is installed on the side in the carriage moving direction. Since a liquid can reach easily above the actuator 106, the liquid can make easily contact with the actuator 106 and the presence of ink can be detected more accurately.

Figure 24:
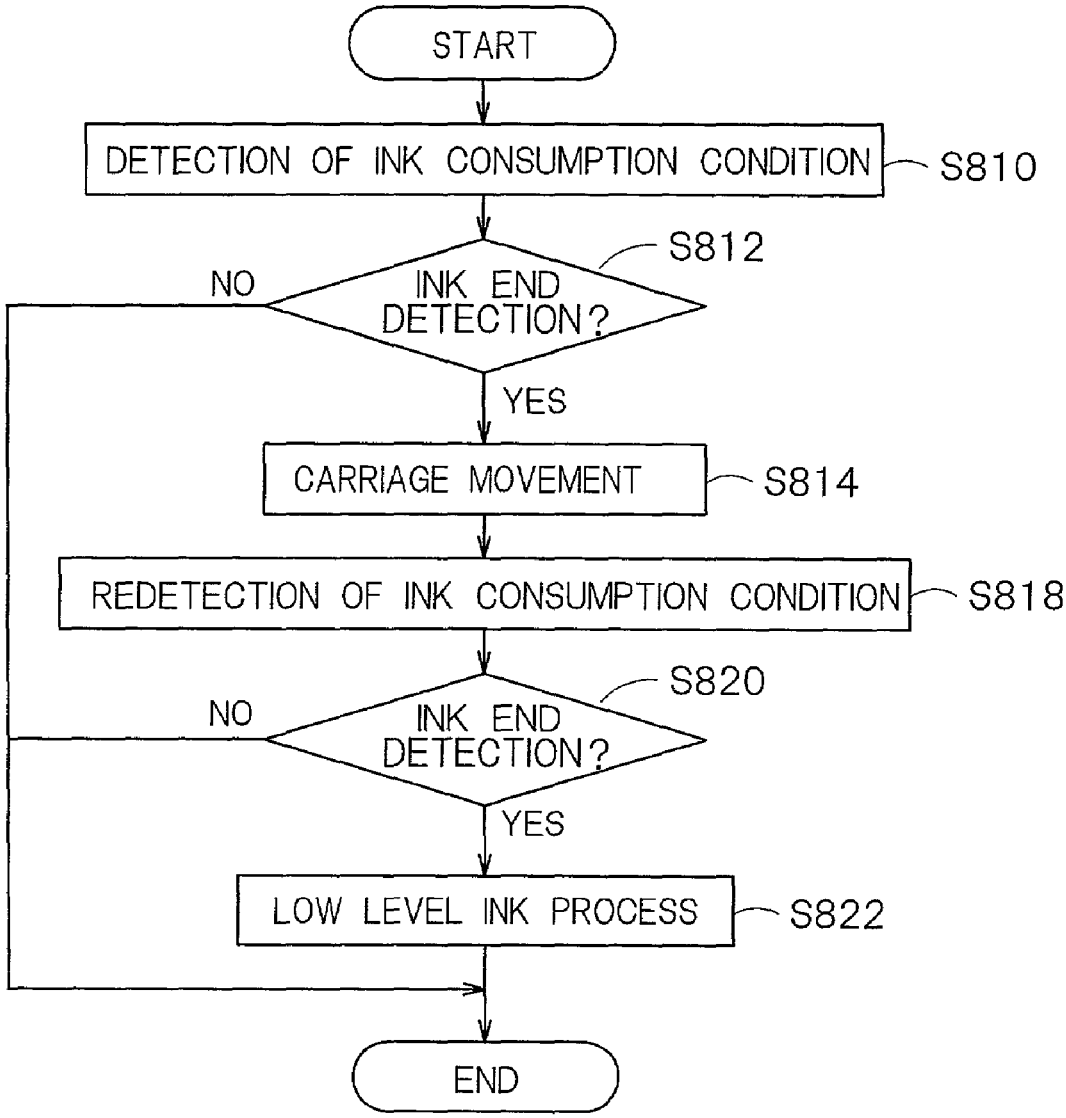
FIG. 24 is a drawing showing the detection procedure of the ink consumption condition detection method in an embodiment of the present invention.

FIG. 24 shows the detection procedure of the ink consumption condition detection method of the present invention. Firstly, the ink consumption condition in the ink cartridge 180 is detected by the actuator 106 (S810). When the actuator 106 detects ink end (S812), the carriage 700 is moved back and forth, thus the ink level in the ink cartridge 180 is vibrated (S814). When the carriage 700 almost returns from the forward path to the backward path or immediately after the carriage 700 returns from the forward path to the backward path, the ink consumption condition in the ink cartridge 180 is detected again by the actuator 106 (S818).

Further, when the ink K consumption condition is detected several times during moving of the carriage 700 (S814) (S818) and it is detected even once that there is ink K in the ink cartridge 180, it may be decided that ink K remains in the ink cartridge 180. Further, the ink K consumption condition is detected several times during moving of the carriage 700 (S814) (S818) and whether ink K remains in the ink cartridge 180 or not may be decided on the basis of the mean value of a plurality of detection results (S820).

Further, when a predetermined time elapses after end of movement of the carriage 700 (S814), the ink consumption condition in the ink cartridge 180 may be measured again using the actuator 106 (S818). Further, when the ink consumption condition detection step (S810) to the ink end redetection step (S820) are repeated several times and presence of ink is decided even once, it may be decided that there is ink. The ink consumption condition detection step (S810) to the ink end redetection step (S820) are repeated several times, and the mean value of the ink residue is calculated, and ink end may be decided on the basis of the calculated mean value.

When ink end is detected by the aforementioned detection operation (S820), a predetermined low ink amount countermeasure is executed (S822). When no ink end is detected at the ink end detection steps (S812, S820), the detection operation of the ink consumption condition accompanied by movement of the carriage 700 ends.

Next, another embodiment of the present invention will be explained.

This embodiment relates to an effective measuring method for the ink consumption condition of an ink cartridge using a piezo-electric device such as an actuator. Generally, importances in measurement of the ink consumption condition are to find the ink residue and to prevent omission of detection and maldetection of ink end so as to be capable of surely exchanging the ink cartridge immediately before ink end. Therefore, if ink end can be surely detected, there is no need to always measure between the condition that the ink cartridge is filled with ink and ink end.

Therefore, the ink consumption condition measuring method of this embodiment controls the ink consumption condition measuring timing by the piezo-electric device such as the actuator explained already on the basis of the operation history of the ink jet recording apparatus. In this case, the operation history indicates the history that the switch of the ink jet recording apparatus is ON, the carriage operation history, and the recording head operation history. A rough estimate of ink residue can be found from these operation histories, so that the ink consumption condition may be measured in a suitable count and frequency according to the operation history.

Figure 25:
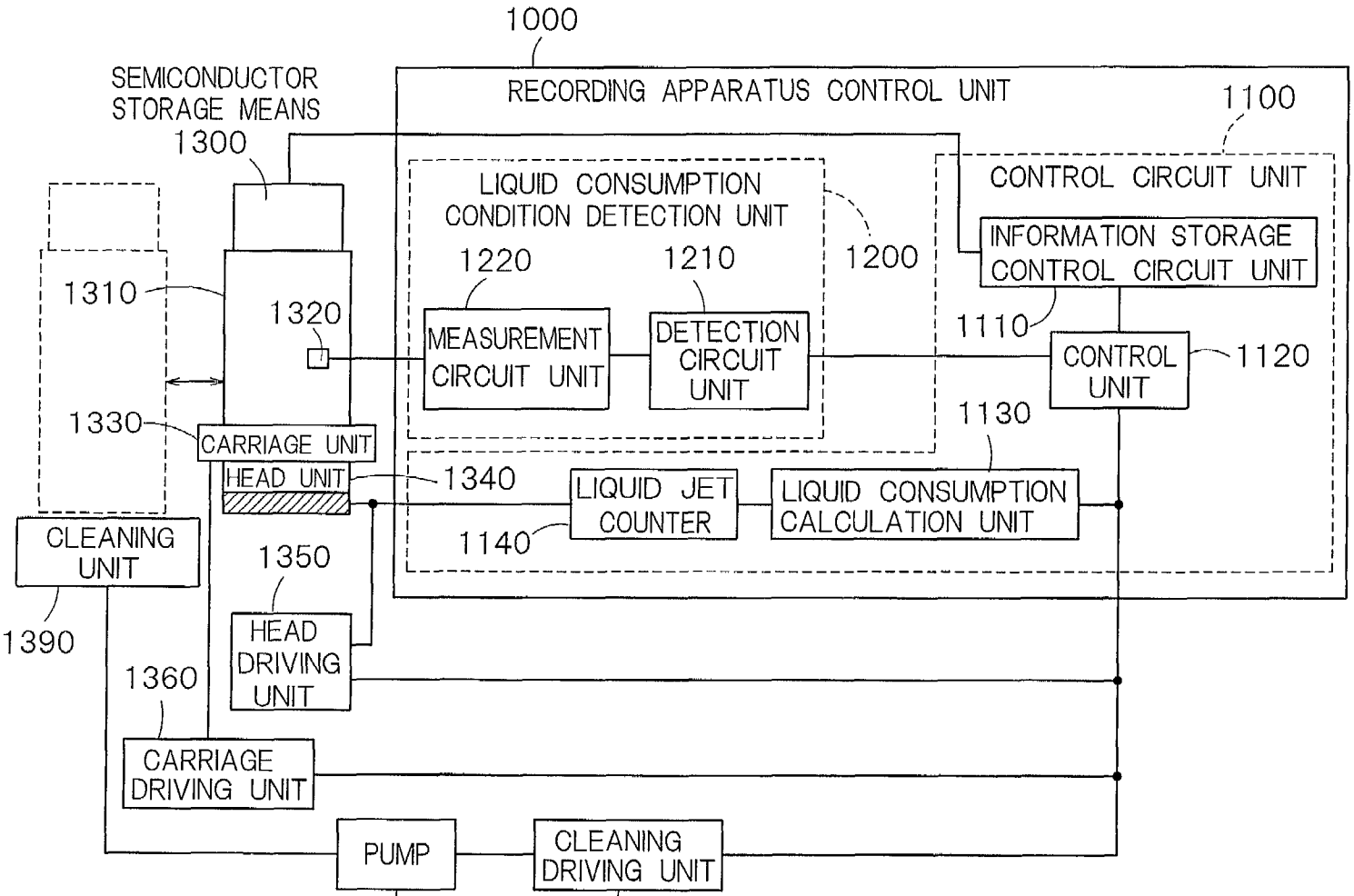
FIG. 25 is a conceptual drawing showing the constitution of the control system used in the ink consumption condition detection method in an embodiment of the present invention.

FIG. 25 is a conceptual drawing showing a constitution example of the control system used in the ink consumption condition detection method in this embodiment. A recording head unit 1340 of the ink jet recording apparatus moves back and forth in the scanning direction by a carriage 1330. On the carriage, an ink cartridge 1310 is mounted in a removable state. The ink cartridge 1310 has a piezo-electric device 1320 such as an actuator for measuring the ink residue in the ink cartridge and a semiconductor storage means 1300.

To operate the piezo-electric device 1320 properly and measure the ink consumption condition, the piezo-electric device 1320 is connected to a liquid consumption condition detection unit 1200 and a control circuit unit 1100.

The liquid consumption condition detection unit 1200 has a measurement circuit unit 1220 for measuring a signal by the piezo-electric device 1320 and a detection circuit unit 1210 for detecting the ink consumption condition.

The control circuit unit 1100 has an information storage control circuit unit 1110 for controlling information of the semiconductor storage means 1300. Further, the control circuit unit 1100 has a liquid jet counter 1140 for calculating the ink consumption by the head unit 1340 and a consumption calculation unit 1130 for calculating the liquid consumption on the basis of the liquid jet counter 1140. Furthermore, a control unit 1120, to control the operation of each unit of the ink jet recording apparatus, is connected to a carriage driving unit 1360, a head driving unit 1350, and a cleaning driving unit 1370.

The carriage driving unit 1360 drives the carriage unit 1330 and the head driving unit 1350 drives the head unit 1340. Furthermore, the cleaning driving unit 1370 cleans the head unit 130 moved to a cleaning unit 1390 using a pump 1380. In the drawing, the semiconductor storage means 1300 stores information such as the driving time of the ink jet recording apparatus. However, the storage means is not limited to it and may be a memory installed in a recording apparatus control unit 1000.

Next, the flow of the process for controlling the measuring timing of the piezo-electric device for measuring the ink consumption condition in the ink cartridge will be explained. As described above, the measuring frequency of the ink consumption condition can be decided by measuring the operation histories at various parts of the ink jet recording apparatus. For example, the ink residue can be estimated according to the cumulative time of the operation of the carriage unit 1330 for moving the head unit 1340, so that the ink consumption condition measuring frequency is increased.

In such a process, the control unit 1120 reads the previous cumulative driving time from the semiconductor storage means 1300 via an information storage control circuit unit 1110 when necessary. Then, the control unit 1120 measures the time required for driving the carriage driving unit 1360 by the carriage unit 1330 and calculates the total cumulative driving time by adding it to the read cumulative driving time.

On the basis of the total cumulative driving time, it is set so as to control the detection circuit unit 1210 by the control unit 1120 as the cumulative time is increased and increase the measuring frequency of the measurement circuit unit 1220 for measuring a signal from the piezoelectric device 1320.

In the ink jet recording apparatus, to keep a proper print quality, the head maintenance process such as cleaning and flashing of the head unit is performed. Therefore, the waste ink amount absorbed in the pump 1380 by these processes is measured and the ink residue in the ink cartridge 1310 is calculated by the control unit. By reflecting the calculation result on the control sequence of ink consumption condition measurement, the measurement control of ink consumption condition can be executed more properly.

Hereunder, a proper control sequence of ink consumption condition measurement using the control system shown in FIG. 25 will be explained. The measuring method for ink consumption condition on the basis of the operation history of the ink jet recording apparatus is broadly divided into measurement control on the basis of the cumulative time and cumulative measuring count and measurement control on the basis of the elapsed time from operation end of a member such as the carriage. The measuring method on the basis of the cumulative time will be explained in FIG. 26, and the measuring method on the basis of the cumulative measuring count will be explained in FIG. 27, and the measuring method on the basis of the elapsed time from operation end of the carriage will be explained in FIGS. 28 and 29.

Figure 26:
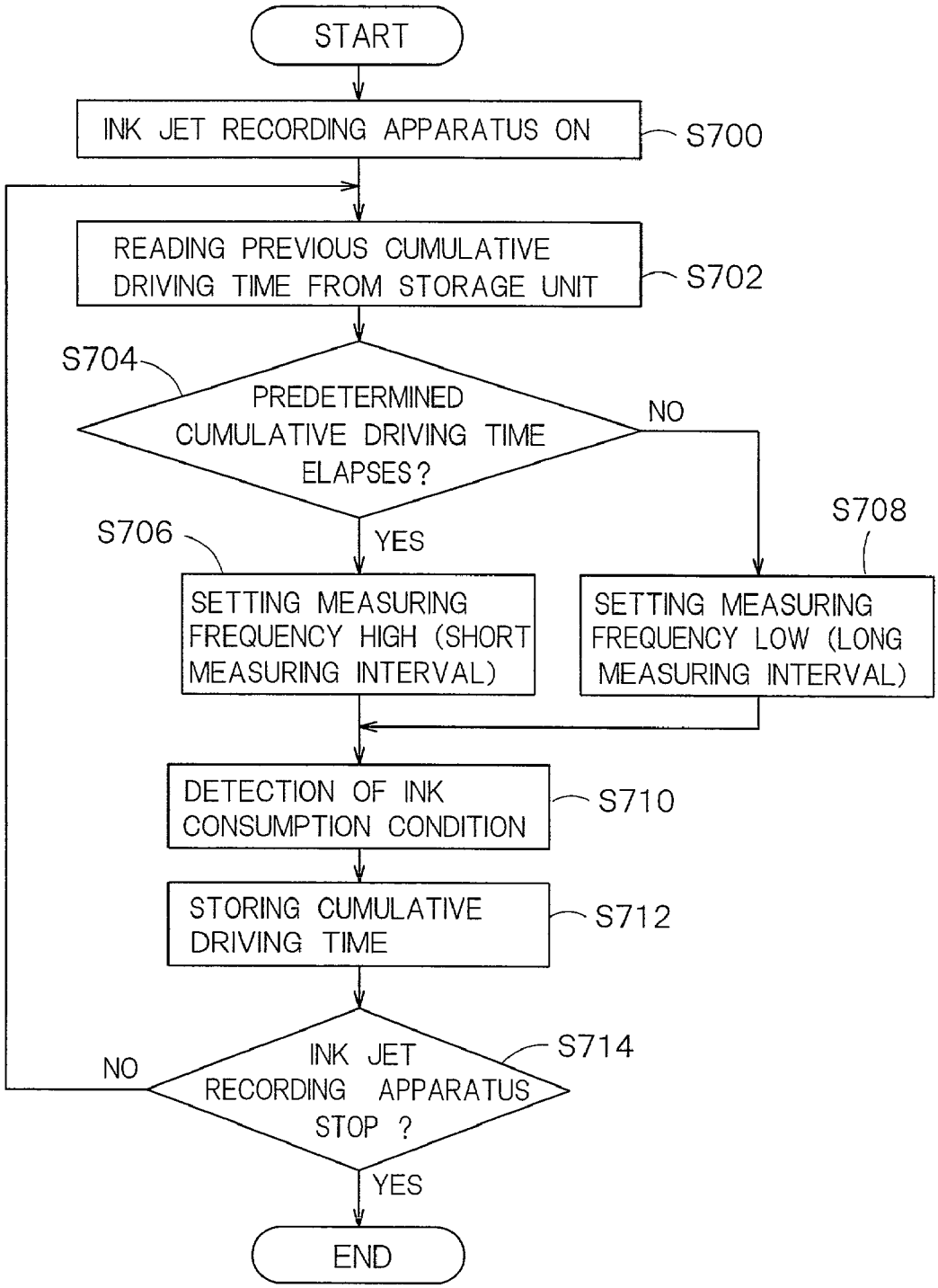
FIG. 26 is a drawing showing the flow of processing of control of measuring timing of the ink consumption condition on the basis of the cumulative driving time of the ink jet recording apparatus.

FIG. 26 is a drawing showing the flow of processing of control of the measuring timing of the ink consumption condition on the basis of the cumulative driving time of the ink jet recording apparatus. In this case, the driving of the ink jet recording apparatus includes driving of the carriage and driving of the recording head. The process flow will be explained hereunder.

The switch of the ink jet recording apparatus is turned ON (Step S700). Next, the system reads the previous cumulative driving time from the storage unit of the semiconductor storage means (Step S702). The system judges whether the read cumulative driving time elapses a predetermined time or not (Step S704). When the read cumulative driving time is less than the predetermined time, the system sets a low ink consumption condition measuring frequency (a long measuring interval) (Step S708). On the other hand, when the read cumulative driving time is more than the predetermined time, the system sets a high ink consumption condition measuring frequency (a short measuring interval) (Step S706). Thereafter, the system measures the ink consumption condition at the set measuring frequency (Step S710). After measurement, the system stores the cumulative driving time of the ink jet recording apparatus in the storage unit (Step S712). Finally, if the ink jet recording apparatus is not to be stopped (Step S714), the system returns to Step S702 and repeats the process and if the ink jet recording apparatus is to be stopped (Step S714), the system ends the process.

The same process as mentioned above may be performed according to the cumulative driving time of the recording head. To judge the driving time of the recording head, it is desirable to measure the cumulative supply time of the driving voltage to be supplied for head driving.

As mentioned above, when the ink consumption condition measuring frequency is changed according to the cumulative driving time of the ink jet recording apparatus, unnecessary measurement when the ink residue is still much can be reduced. Further, as the cumulative driving time increases, the measuring frequency increases, so that when the ink residue is reduced, ink end can be detected without missing.

Figure 27:
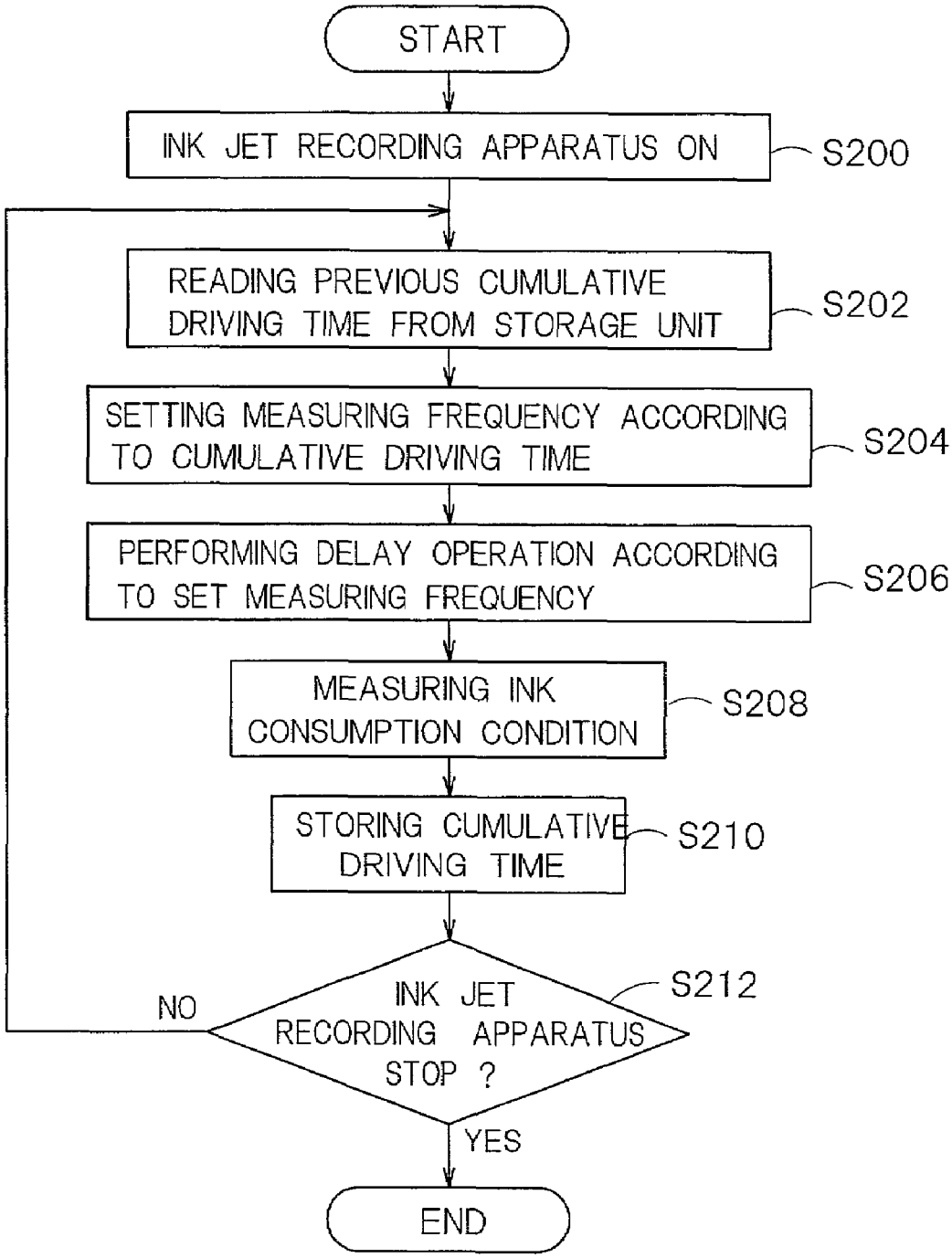
FIG. 27 is a drawing showing another the process flow of control of measuring timing of the ink consumption condition on the basis of the cumulative driving time of the ink jet recording apparatus.

FIG. 27 is a drawing showing another embodiment of the flow of measuring control on the basis of the cumulative driving time shown in FIG. 26. Up to Step S202, the same process as that shown in FIG. 26 is performed. Then, the system sets the measuring frequency from the cumulative driving time read from the storage unit (Step S204).

Next, the system performs the delay operation according to the set measuring frequency (Step S206). Thereafter, the system measures the ink consumption condition at the set measuring frequency (Step S208). The subsequent process is the same as that shown in FIG. 26.

In the measuring method shown in FIG. 26, the measuring frequency is set to high or low according to whether the cumulative time is more than the predetermined time or not. However, in the actual printing, the ink consumption does not always proceed at a constant pace as the cumulative driving time is prolonged. Therefore, even if the cumulative time is long, ink may not be consumed so much. When the measuring frequency is increased though the ink residue is much, unnecessary measurement may be often made because the ink residue does not change suddenly. Therefore, in FIG. 27, the measuring frequency is set according to the cumulative time and moreover, the delay operation is performed according to the set measuring frequency, so that a proper measuring frequency according to the ink residue can be maintained.

The same process as mentioned above may be performed according to the cumulative driving time of the recording head. To judge the driving time of the recording head, it is desirable to measure the cumulative supply time of the driving voltage to be supplied for head driving.

As mentioned above, when the ink consumption condition measuring frequency is changed according to the cumulative driving time of the ink jet recording apparatus, unnecessary measurement when the ink residue is still much can be reduced. Further, as the cumulative driving time increases, the measuring frequency increases, so that when the ink residue is reduced, ink end can be detected without missing.

Figure 28:
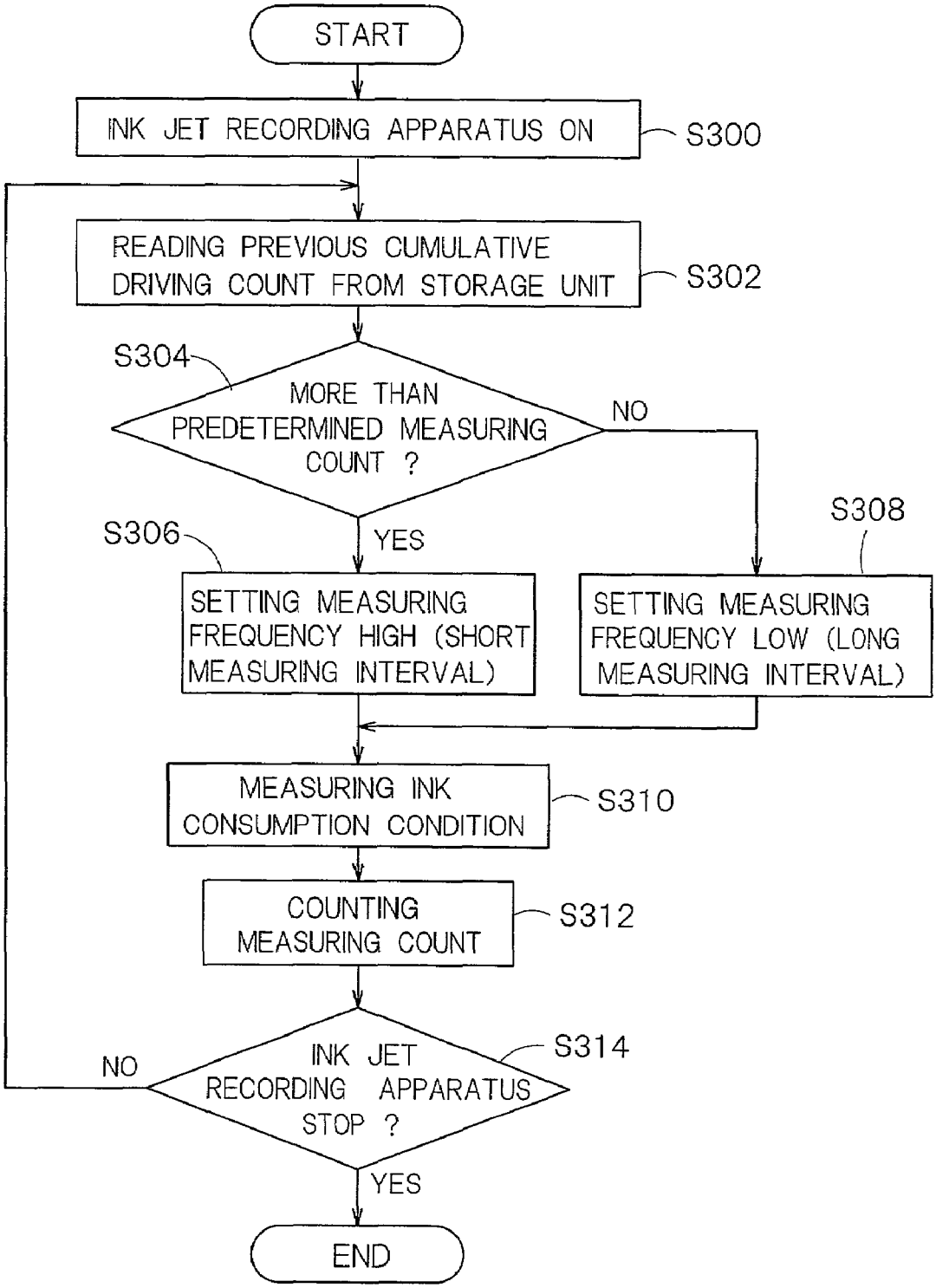
FIG. 28 is a drawing showing the process flow of control of measuring timing of the ink consumption condition on the basis of the measuring count of the ink consumption condition.

FIG. 28 is a drawing showing the flow of processing of control of the measuring timing of the ink consumption condition on the basis of the measuring count of the ink consumption condition and shows a different embodiment from that shown in FIG. 26. The process flow will be explained hereunder.

The switch of the ink jet recording apparatus is turned ON (Step S300). Next, the system reads the previous cumulative measuring count from the storage unit of the semiconductor storage means (Step S302). The system judges whether the read cumulative measuring count is more than a predetermined count or not (Step S304). When the read cumulative measuring count is less than the predetermined count, the system sets a low ink consumption condition measuring frequency (a long measuring interval) (Step S308). On the other hand, when the read ink consumption condition measuring count is more than the predetermined count, the system sets a high ink consumption condition measuring frequency (a short measuring interval) (Step S306). Thereafter, the system measures the ink consumption condition at the set measuring frequency (Step S310). After measurement, the system stores the cumulative measuring count in the storage unit (Step S312). Finally, if the ink jet recording apparatus is not to be stopped (Step S314), the system returns to Step S302 and repeats the process and if the ink jet recording apparatus is to be stopped (Step S314), the system ends the process.

As mentioned above, when the ink consumption condition measuring frequency is changed according to the cumulative measuring count, unnecessary measurement when the ink residue is still much can be reduced. Further, as the ink consumption condition measuring count increases, the measuring frequency increases, so that when the ink residue is reduced, ink end can be detected without missing.

Figure 29:
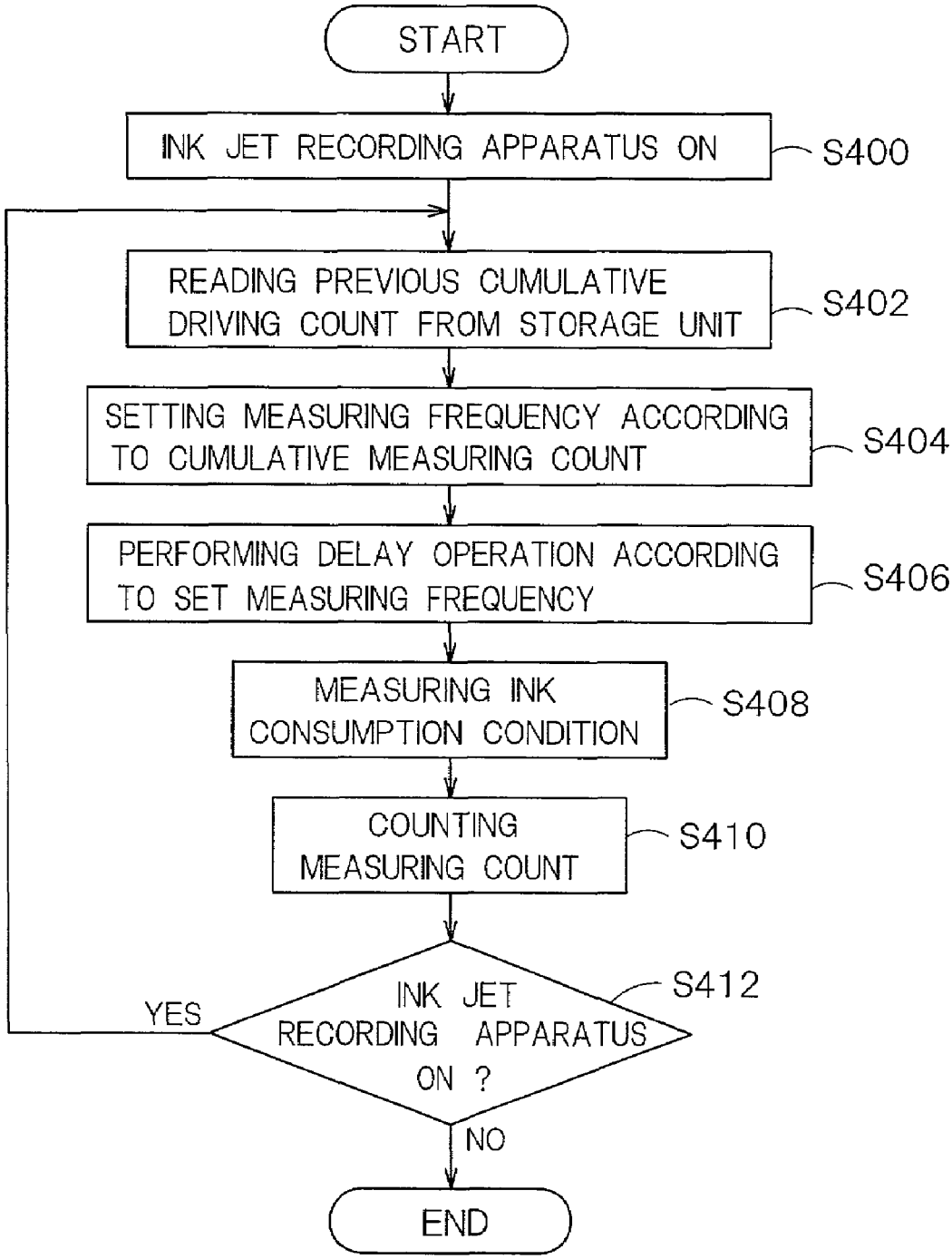
FIG. 29 is a drawing showing another process flow of control of measuring timing of the ink consumption condition on the basis of the measuring count of the ink consumption condition.

FIG. 29 is a drawing showing another embodiment of the processing flow on the basis of the cumulative measuring count shown in FIG. 28. Hereunder, the process flow will be explained. Up to Step S402, the same process as that shown in FIG. 28 is performed. Then, the system sets the measuring frequency from the cumulative measuring count read from the storage unit (Step S404). Further, the system performs the delay operation according to the set measuring frequency (Step S406). Thereafter, the system measures the ink consumption condition (Step S408). The subsequent process is the same as that shown in FIG. 28.

In the measurement control shown in FIG. 28, the measuring frequency is set to high or low according to whether the cumulative measuring count is more than the predetermined count or not. However, in the actual printing, the ink consumption does not always proceed at a constant pace as the cumulative measuring count is increased. Therefore, even if the cumulative measuring count is large, ink may not be consumed so much. When the measuring frequency is increased though the ink residue is much, unnecessary measurement may be often made because the ink residue does not change suddenly. Therefore, in FIG. 29, the measuring frequency is set according to the cumulative measuring count and moreover, the delay operation is performed according to the set measuring frequency, so that a proper measuring frequency according to the ink residue can be maintained.

The measuring methods on the basis of the cumulative time and cumulative measuring count are explained in FIGS. 26 to 29. Then, a measuring method on the basis of the elapsed time from operation end of the carriage which is a different embodiment from these methods will be explained.

Figure 30:
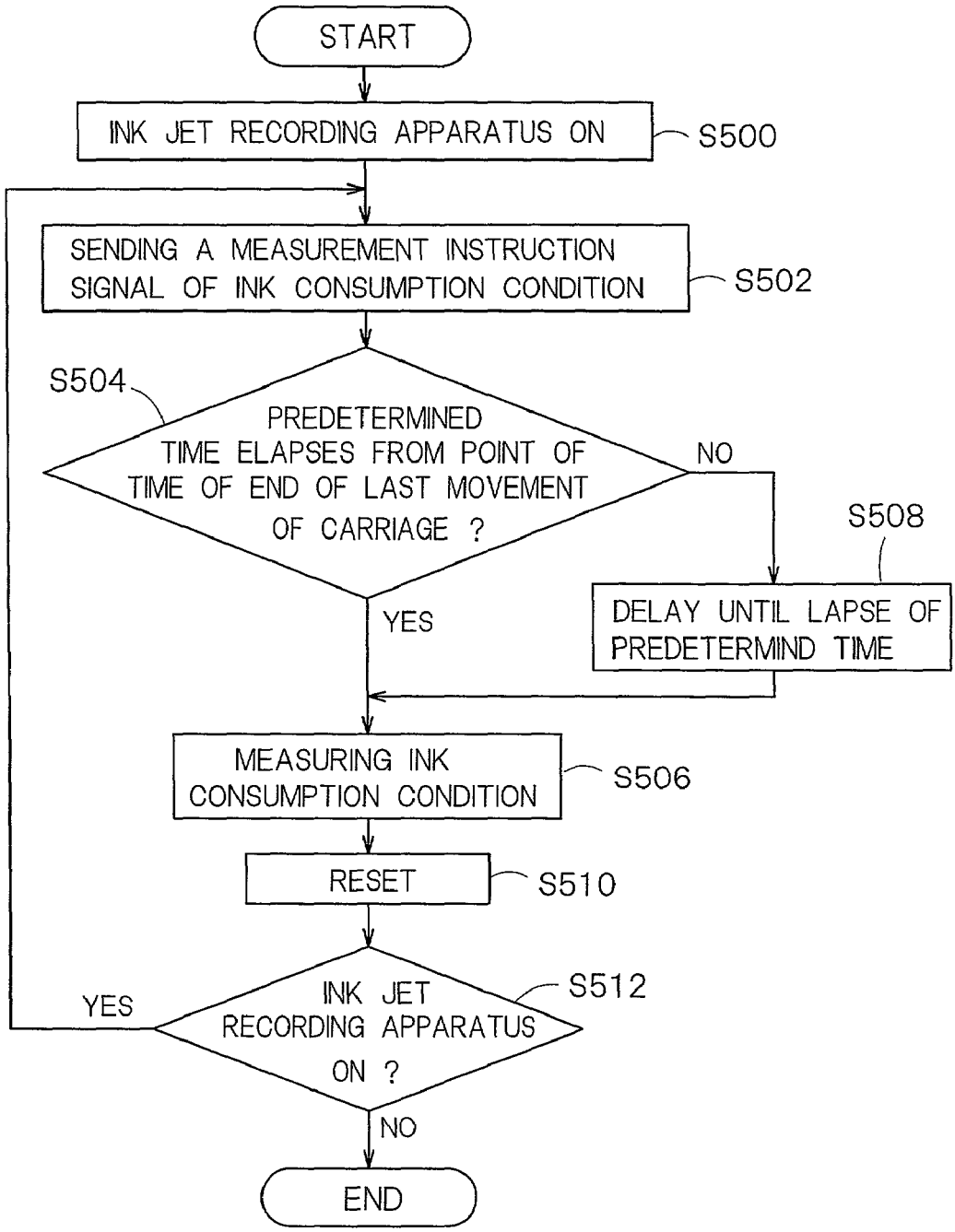
FIG. 30 is a drawing showing the process flow of control of measuring timing of the ink consumption condition on the basis of the cumulative driving time of the carriage.

FIG. 30 is a drawing showing the flow of processing of control of the measuring timing of the ink consumption condition on the basis of the operation history of the carriage. The process flow will be explained hereunder.

The switch of the ink jet recording apparatus is turned ON (Step S500). Next, from the control unit 1120 of the recording apparatus control unit 1000 shown in FIG. 25, a measurement instruction signal of ink consumption condition is sent to the piezo-electric device 1220 attached to the ink cartridge (Step S502).

The control unit 1120 judges whether the elapsed time from the point of time of last movement of the carriage to the time of sending the measurement instruction signal of ink consumption condition elapses a predetermined time or not (Step S504). When the elapsed time elapses the predetermined time, the ink consumption is measured immediately (Step S506). On the other hand, when the elapsed time does not elapse the predetermined time, the measurement of the ink consumption condition is delayed until lapse of another predetermined time (Step S508) and then the ink consumption condition is measured (Step S506). The other predetermined time at Step S508 may be the same as the predetermined time at Step S504.

When the measurement of ink consumption condition ends, the equipment is reset (Step S510). When the ink jet recording apparatus is turned ON after reset (Step S512), the control unit 1120 returns to Step S502 and repeats the process. When the ink jet recording apparatus is not turned ON (Step S512), the control unit 1120 ends the process.

In the aforementioned process, the predetermined times are decided at Step S504 and Step S508 respectively. These predetermined times can be separately set long or short freely. For example, the predetermined time at Step S504 is set to 10 hours and the predetermined time at Step S508 is set to 2 hours. When 10 hours elapse from the last use of the ink jet recording apparatus, the ink consumption condition is measured immediately. On the other hand, when only one hour elapses after the last use, the control unit waits for 2 hours which are the predetermined time at Step S508 and then measures the ink consumption condition. The predetermined time set at Step S504 is preferably shorter than the time required for continuously driving the ink jet recording apparatus and exhausting ink.

Further, the predetermined time may be in second units instead of in hour units as mentioned above and various time intervals can be set. For example, the predetermined time at Step S504 is set to 10 seconds and the predetermined time at Step S508 is set to 5 seconds. When 10 seconds elapse after the last use of the ink jet recording apparatus, the ink consumption condition is measured immediately. On the other hand, when only two seconds elapse after the last use, the control unit waits for 5 seconds which are the predetermined time at Step S508 and then measures the ink consumption condition.

When the predetermined time is set like this, unnecessary measurement of ink consumption condition can be reduced.

Figure 31:
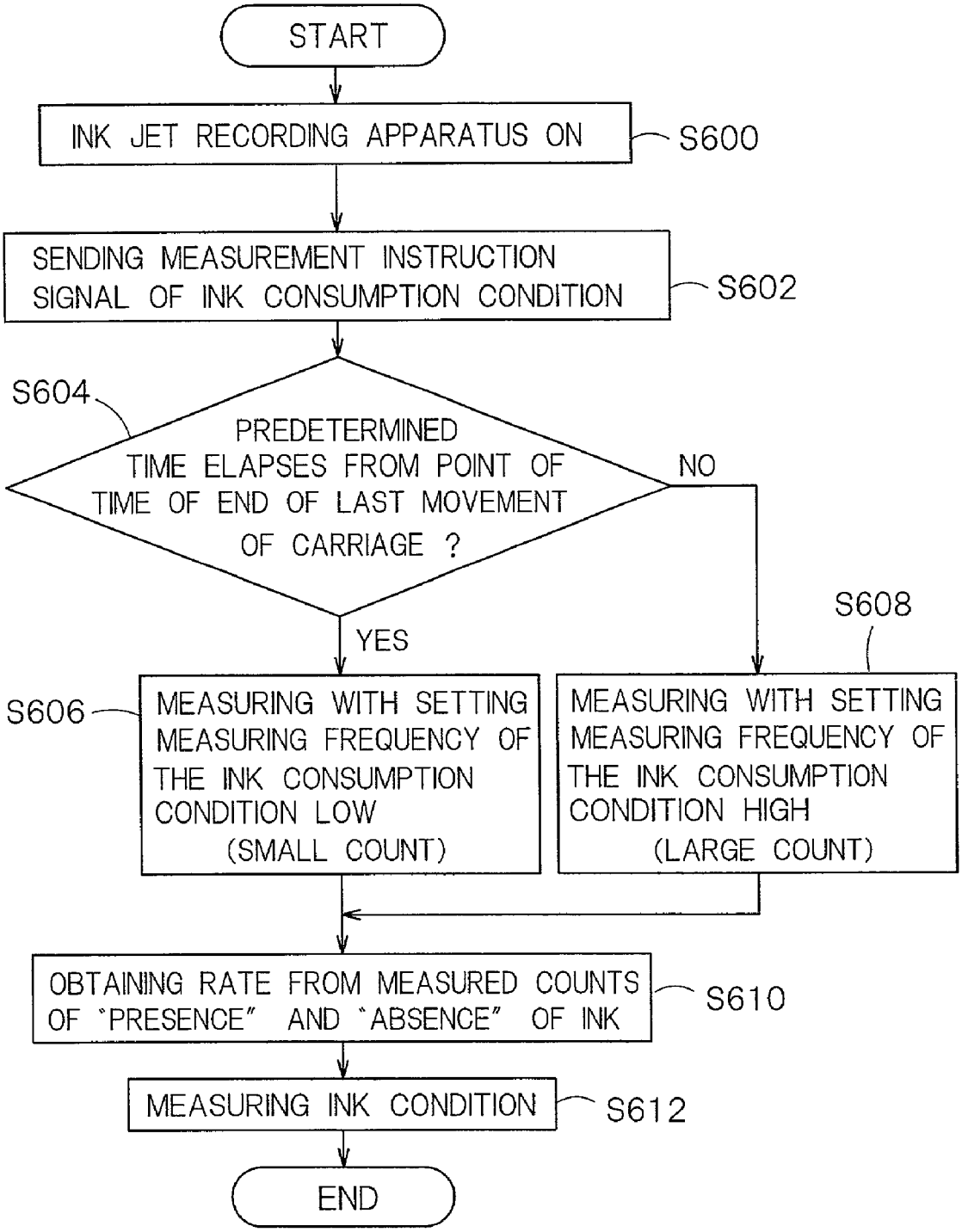
FIG. 31 is a drawing showing another example of the process flow of control of measuring timing of the ink consumption condition on the basis of the cumulative driving time of the carriage.

FIG. 31 is a drawing showing another example of the processing flow of controlling the measuring timing of the ink consumption condition on the basis of the operation history of the carriage. In this process, an operation history of the carriage in a short time compared with that shown in FIG. 30 is supposed. The process flow will be explained hereunder.

The switch of the ink jet recording apparatus is turned ON (Step S600). Next, from the control unit 1120 of the recording apparatus control unit 1000 shown in FIG. 25, a measurement instruction signal of ink consumption condition is sent to the piezo-electric device 1220 attached to the ink cartridge (Step S602).

The control unit 1120 judges whether the elapsed time from the point of time of last movement of the carriage to the time of sending the measurement instruction signal of ink consumption condition elapses a predetermined time or not (Step S604). When the elapsed time elapses the predetermined time, a low measuring frequency (a small measuring count) is set and the ink consumption is measured (Step S606). On the other hand, when the elapsed time does not elapse the predetermined time, a high measuring frequency (a large measuring count) is set and then the ink consumption condition is measured (Step S608).

After measurement, among the whole measuring count, the count of measuring of "presence" of ink or "absence" of ink is obtained. Next, the rate of "presence" of ink or "absence" of ink is obtained from the count of measuring of "presence" of ink or "absence" of ink and the final ink consumption condition is decided (Step S412). For example, when 8 times are measured as "absence" of ink among the total 10 times of measurement, "absence" of ink is decided. This criterion is preferably set high or low depending on that the predetermined time at Step S404 is long or short.

In the above process, a shorter predetermined time than that shown in FIG. 28 is supposed. For example, when only 3 to 5 seconds elapse after the last movement of the carriage, it is expected that the ink in the ink cartridge is still waving. When the ink residue is small in this state, the measurement reliability is low because ink makes contact or no contact with the piezo-electric device for measuring the ink consumption condition. Therefore, for example, the predetermined time is set to one minute, and one minute before lapse, it is judged that ink waves and is not in a quiet state, and the ink consumption condition measuring frequency is set high (large count). By doing this, the reliability of ink consumption condition measurement is enhanced and maldetection can be prevented. On the other hand, one minute after lapse, it is judged that ink is in a quiet state and the ink consumption condition measuring frequency is set low (small count). By doing this, waste ink consumption condition measurement can be reduced. The setting of predetermined time is preferably changed depending on the ink property such as viscosity.

Meanwhile, in the ink consumption condition detection method shown in FIGS. 26 to 31, the measurement is controlled by an increase in the cumulative driving time of the carriage and ink end can be detected accurately. Further, to prevent maldetection of ink within the predetermined time, the measuring frequency of ink consumption condition is increased. Furthermore, to increase the measurement accuracy of ink consumption condition, it is preferable to increase, as the measuring frequency is increased, the measuring count (refer to FIGS. 12A and 12B) of the periodic peak value of the counter electromotive power waveform generated by the residual vibration after oscillation of the piezo-electric device, and increase the measurement accuracy.

Next, another embodiment of the present invention will be explained.

In FIGS. 32 to 36, a measuring method for the ink consumption condition when a measuring method for the ink consumption condition in the ink container which is calculated by totalizing the ink consumption jetted from the recording head of the ink jet recording apparatus relating to this embodiment and a measuring method for the ink consumption condition in the ink cartridge using the piezo-electric device having a piezo-electric conversion function are combined will be explained.

Hereunder, an example of ink consumption condition measurement in the ink cartridge will be explained. However, the present invention is not limited to it and can be used for general ink consumption condition measurement in the ink container.

Generally, the important matters in measurement of the ink consumption condition are to find the ink residue and to prevent omission of detection and maldetection of ink end so as to be capable of surely exchanging the ink cartridge immediately before ink end. Therefore, if the aforementioned ink end can be surely detected, there is no need to always measure in detail between the condition that the ink cartridge is filled with ink and ink end.

In the ink consumption condition measuring method of this embodiment, by properly combining the aforementioned two ink consumption condition detection methods, the ink residue can be measured more properly than measurement by a single method and the ink end can be detected.

Figure 32:
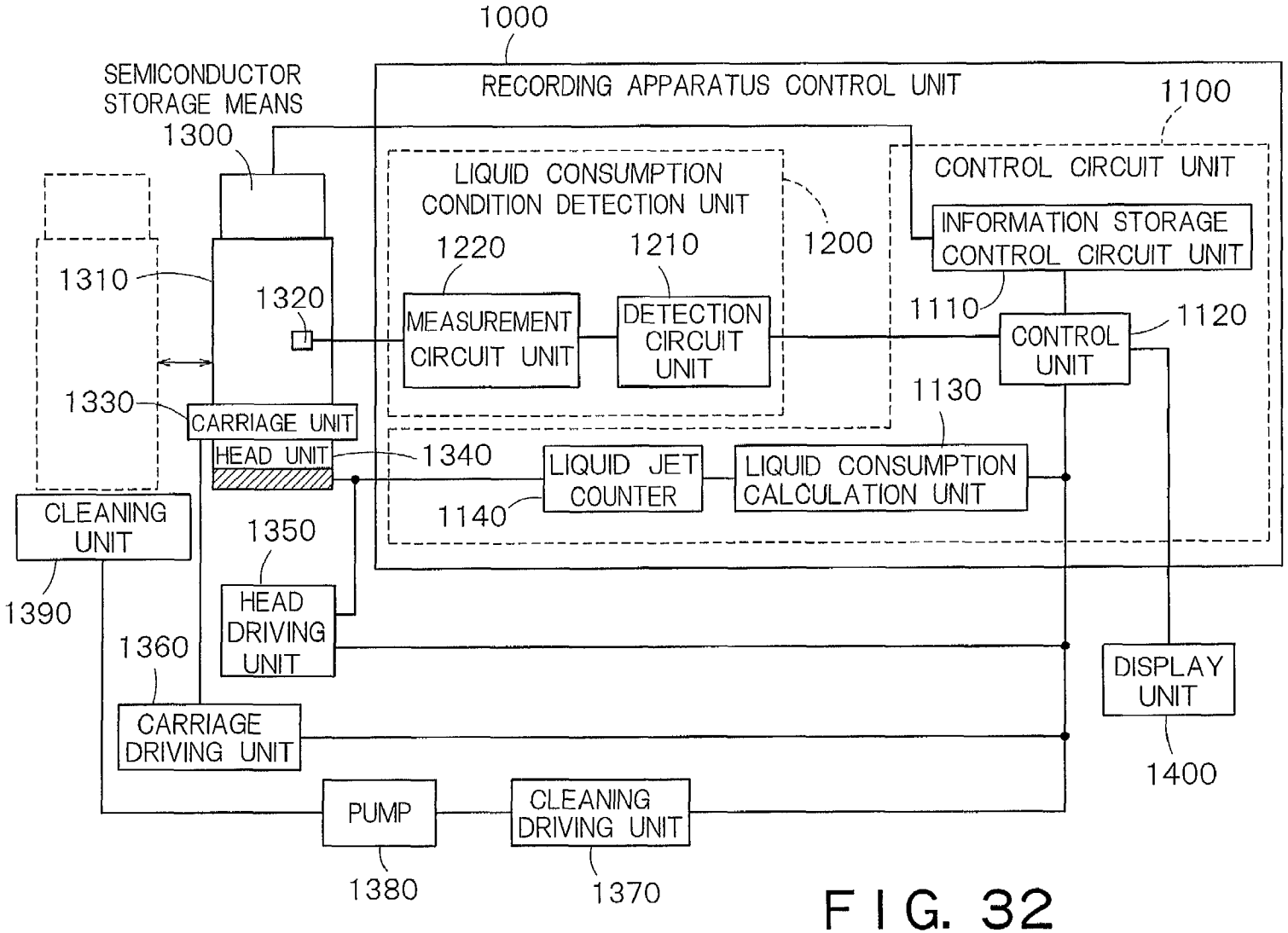
FIG. 32 is a conceptual drawing showing the constitution of the control system used in the ink consumption condition detection method in an embodiment of the present invention.

FIG. 32 is a conceptual drawing showing a constitution example of the control system used in the ink consumption condition detection method of this embodiment. The recording head unit 1340 of the ink jet recording apparatus moves back and forth in the scanning direction by the carriage 1330. On the carriage, the ink cartridge 1310 is mounted in a removable state. The ink cartridge 1310 has the piezoelectric device 1320 such as an actuator for measuring the ink residue in the ink cartridge and the semiconductor storage means 1300.

To operate the piezo-electric device 1320 properly and measure the ink consumption condition, the piezo-electric device 1320 is connected to the liquid consumption condition detection unit 1200 and the control circuit unit 1100.

The liquid consumption condition detection unit 1200 has the measurement circuit unit 1220 for measuring a signal by the piezo-electric device 1320 and the detection circuit unit 1210 for detecting the ink consumption condition.

The control circuit unit 1100 has the information storage control circuit unit 1110 for controlling information of the semiconductor storage means 1300. Further, the control circuit unit 1100 has the liquid jet counter 1140 for calculating the ink consumption by the head unit 1340 and the consumption calculation unit 1130 for calculating the liquid consumption on the basis of the liquid jet counter 1140. Furthermore, the control unit 1120, to control the operation of each unit of the ink jet recording apparatus, is connected to the carriage driving unit 1360, the head driving unit 1350, and the cleaning driving unit 1370. Further, the control unit 1120 lets a display unit 1440 display the measured results of ink consumption condition. The display unit 1400 may be a display on the side of the ink jet recording apparatus or a display on the side of a personal computer connected to the ink jet recording apparatus.

The carriage driving unit 1360 drives the carriage unit 1330 and the head driving unit 1350 drives the head unit 1340. Furthermore, the cleaning driving unit 1370 cleans the head unit 130 moved to a cleaning unit 1390 using a pump 1380. In the drawing, the semiconductor storage means 1300 stores various parameter information such as the ink consumption condition and ink characteristics. However, the storage means is not limited to it and may be a memory installed in the recording apparatus control unit 1000.

Next, in measurement of the ink consumption condition in the ink cartridge, an example of the flow for controlling the timing of the measurement on the basis of calculation of the ink consumption jetted from the recording head and of the measurement using the piezo-electric device will be explained. As mentioned above, if the ink residue and ink end can be measured properly, there is no need to always measure the ink consumption condition in detail.

For example, between the state that the ink cartridge is fully filled with ink and the state in the neighborhood of the measuring position level, strict measurement of ink residue is not always necessary, so that the ink consumption condition is monitored by the method on the basis of calculation of the ink consumption. Then, between the state in the neighborhood of the measuring position level and the state of ink end, to properly detect ink end without missing, the ink consumption condition is measured by the method using the piezo-electric device.

In this case, the "measuring position level" indicates an ink residue level that the piezo-electric device such as an actuator can actually measure passing the ink level. Further, the neighborhood of the measuring position level indicates the ink residue before reaching the ink residue on the measuring position level, that is, the ink residue in a state that it includes a fixed amount of ink extra in addition to that on the measuring position level. The fixed amount of ink is preferably larger than the amount capable of absorbing a measurement error of ink consumption condition on the basis of the ink consumption.

In this process, the control unit 1120 reads the previous ink consumption and capacity of ink drops from the semiconductor storage means 1300 via the information storage control circuit unit 1110 when necessary. The read information is further sent to the liquid consumption calculation unit 1130. The liquid jet counter 1140 counts the count of ink drops jetted by the head unit 1340 driven by the head driving unit 1350. The liquid consumption calculation unit 1130 calculates the ink residue from the information sent from the control unit 1120 and the count by the liquid jet counter 1140.

Until the calculated ink residue reaches at least the set value in the neighborhood of the measuring position level, the measurement on the basis of calculation of the ink consumption jetted from the recording head under control of the control unit 1120 is continued and the ink consumption condition is monitored. When the calculated ink residue is reduced below the amount in the neighborhood of the measuring position level, the control unit 1120 controls the detection circuit unit 1210 and the measurement circuit unit 1220 so as to start measurement of the ink consumption condition using the piezo-electric device 1320 such as the actuator. The piezo-electric device receiving a measurement instruction from the control unit 1120 measures the ink consumption condition from the neighborhood of the measuring position level to ink end. By doing this, the ink end can be detected surely without losing the timing.

Meanwhile, in the ink jet recording apparatus, to keep a proper print quality, the head maintenance process such as cleaning and flashing of the head unit 1340 is performed. Therefore, the waste ink amount absorbed in the pump 1380 by these processes is measured and the ink residue in the ink cartridge 1310 is calculated by the control unit. When, as mentioned above, the ink consumption is calculated from calculation of the number of ink drops jetted from the recording head and ink calculation of the head maintenance process and the calculation result is reflected on the control sequence of ink consumption condition measurement, the measurement control of ink consumption condition can be executed more properly. The measured result of ink consumption condition is displayed on the display unit 1400, so that a user of the ink jet recording apparatus can ascertain the ink consumption condition when necessary. When the ink consumption condition is measured by combining the measurement on the basis of calculation of the ink consumption and the measurement using the piezo-electric device using the control system mentioned above, the ink residue is measured properly and the ink end can be detected.

Hereunder, a proper control sequence for the measuring method for ink consumption condition combining the measuring method on the basis of calculation of the ink consumption and the measuring method using the piezo-electric device using the control system shown in FIG. 32 will be explained.

Figure 33:
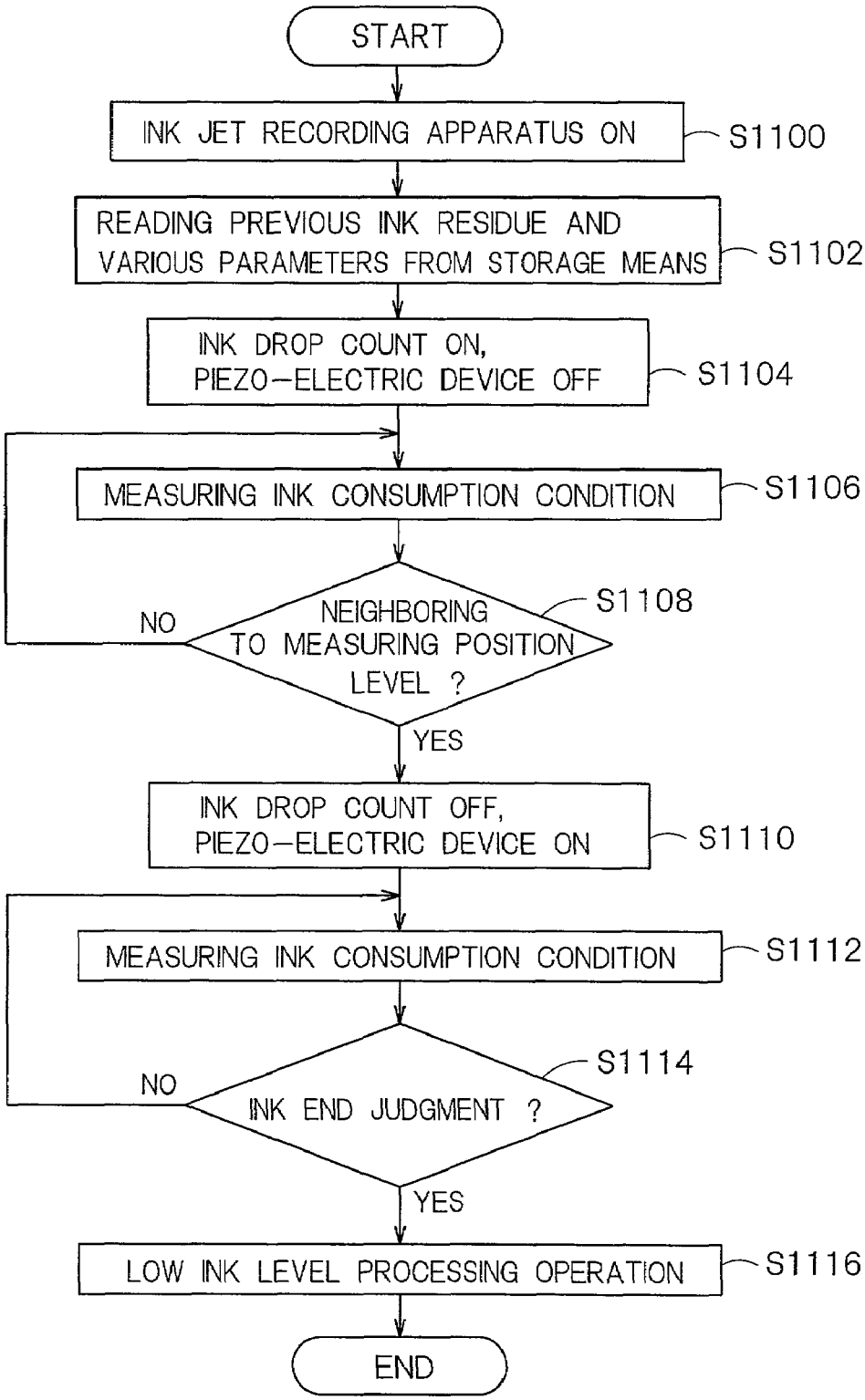
FIG. 33 is a drawing showing an example of the process flow of the ink consumption condition detection method in an embodiment of the present invention.

FIG. 33 is a drawing showing an example of the process flow of the measuring method for ink consumption condition combining the measuring method on the basis of calculation of the ink consumption and the measuring method using the piezo-electric device. The process flow will be explained hereunder.

The switch of the ink jet recording apparatus is turned ON (Step S1100) and the ink residue in the ink container and various parameters necessary for measurement are read from the storage means such as the semiconductor storage means 1300 shown in FIG. 32 (Step S1102). Next, to measure the ink consumption condition on the basis of calculation of the ink consumption used in this embodiment, counting of ink drops is started. On the other hand, at this point of time, measurement by the piezo-electric device such as the actuator is not executed yet (Step S1104).

By this set measuring method, the ink consumption condition is measured (Step S1106). When the ink consumption condition measured result shows that the ink residue is not the amount in the neighborhood of the measuring position level (Step S1108), the ink consumption condition is measured continuously (Step S1106). On the other hand, when the ink residue is the amount in the neighborhood of the measuring position level (Step S1108), the process goes to Step S1110. At Step S1110, to stop the measurement on the basis of calculation of the ink consumption, the counting of ink drops is turned OFF and the measurement by the piezo-electric device is turned ON.

By this set measuring method, the ink consumption condition is measured (Step S1112). When ink end is not judged from the measured result (Step S1114), the ink consumption condition is measured continuously (Step S1112), and when ink end is judged (Step S1114), a low level ink processing operation is performed, and the process ends (Step S1116). In this case, the low level ink processing operation is one of the peripheral operations performed by the ink jet recording apparatus when the ink residue reaches a predetermined ink residue. The peripheral operation includes operations for changing various parameters and sending various data to the printer driver. The predetermined ink amount can be set freely according to the peripheral operations. The low level ink processing operation is an operation for informing a user of the ink jet recording apparatus of ink end and it includes, for example, operations for displaying ink end on the display unit 1400 shown in FIG. 32, stopping the ink jet recording apparatus, and ringing a warning sound. Further, to prevent defective printing such as ink end during printing, it is preferable to judge ink end in a state that a properly small amount of ink remains.

From the aforementioned, when there is a large amount of ink residue, the ink consumption condition is measured from calculation on the basis of calculation of the ink consumption, and after the ink residue passes the amount in the neighborhood of the measuring position level, the ink consumption condition is measured using the piezo-electric device, thus the ink residue is measured properly and the ink end can be detected at proper timing.

Further, the ink residue in the neighborhood of the measuring position level varies with the number, shape, and mounting position of piezo-electric devices mounted on the ink container. For example, when the piezo-electric device is to be mounted on the side wall of the ink container, the ink amount in the neighborhood of the measuring position level to be set varies with the distance from the bottom of the ink container to the piezo-electric device. Further, in the measurement of the ink consumption condition on the basis of calculation of the ink consumption, to prevent the set ink amount in the neighborhood of the measuring position level from being measured after passing the actual measuring position level, a measurement error is taken into account. Namely, it is preferable to set the ink amount in the neighborhood of the measuring position level in consideration of a sufficient ink amount withstanding the measurement error.

Further, in the aforementioned process, the counting of ink drops is turned OFF at Step S1110. However, to execute more proper measurement, the measurement by the ink consumption may be continued. In this case, for the final judgment of ink end, the calculated result information on the basis of calculation of the ink consumption or the measured result information of the piezo-electric device can be freely selected.

Figure 34:
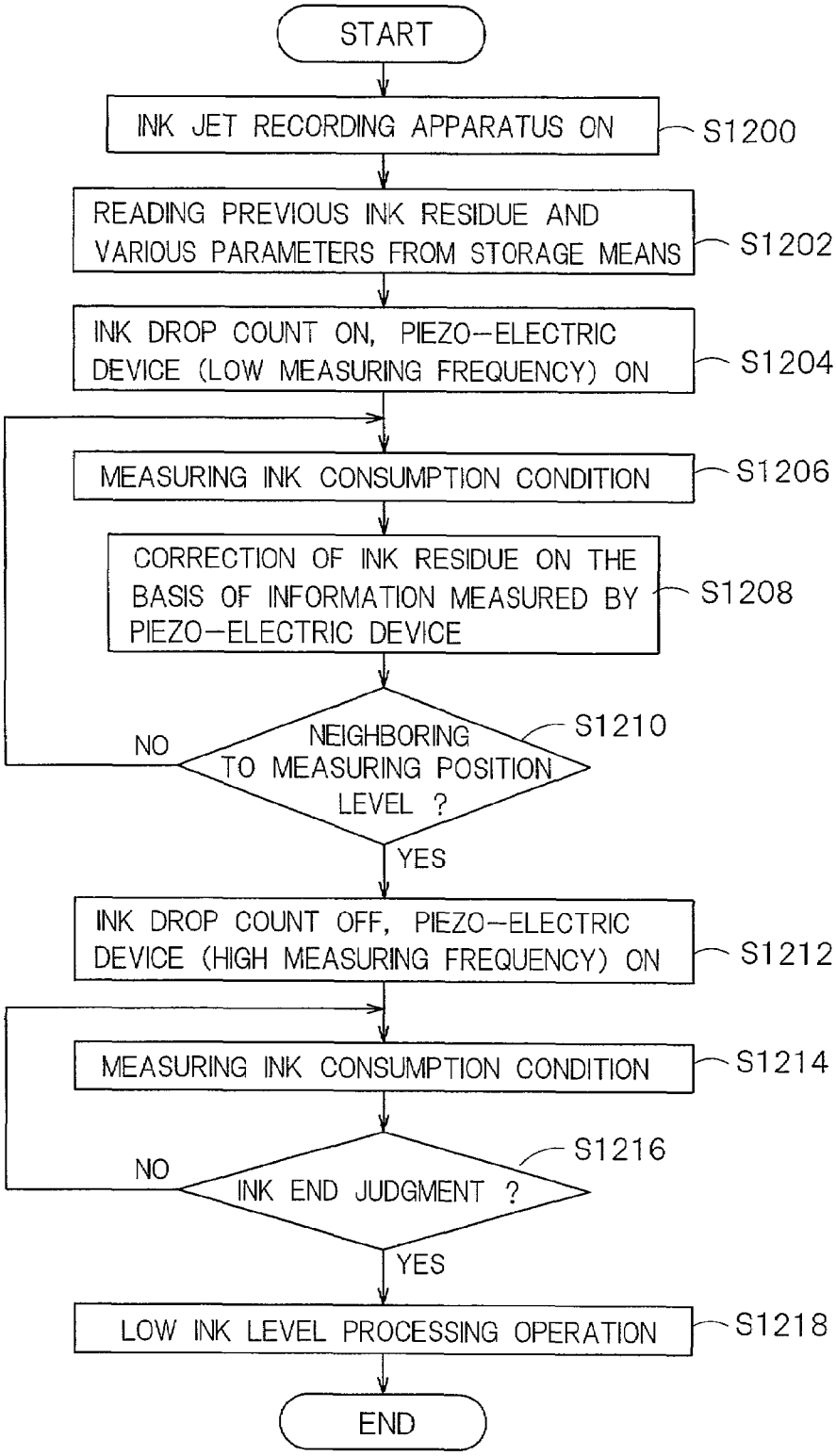
FIG. 34 is a drawing showing another process flow of the ink consumption condition detection method in an embodiment of the present invention.

FIG. 34 is a drawing showing another process flow of the measuring method for ink consumption condition combining the measuring method on the basis of calculation of the ink consumption and the measuring method using the piezo-electric device. The process flow will be explained hereunder.

The switch of the ink jet recording apparatus is turned ON (Step S1200). The ink residue in the ink container and various parameters necessary for measurement are read from the storage means such as the semiconductor storage means 1300 shown in FIG. 32 (Step S1202). Next, to measure the ink consumption condition on the basis of calculation of the ink consumption used in this embodiment, counting of ink drops is started and at the same time, measurement by the piezo-electric device such as the actuator is also started (Step S1204). Here, the measuring frequency of the piezo-electric device is low.

The ink consumption condition is measured by this set measuring method (Step S1206). Among the measured results of the ink consumption condition, the value of ink residue calculated on the basis of calculation of the ink consumption is corrected on the basis of the information measured by the piezo-electric device (Step S1208). Furthermore, various parameter values for controlling the printer operation may be corrected.

When the ink residue is not the amount in the neighborhood of the measuring position level (Step S1210), the ink consumption condition is measured again (Step S1206). On the other hand, when the ink residue is the amount in the neighborhood of the measuring position level (Step S1210), the process goes to Step S1212. At Step S1212, to stop the measurement on the basis of calculation of the ink consumption, the counting of ink drops is turned OFF. Further, to surely detect ink end, the measuring frequency by the piezo-electric device is increased (Step S1212).

The ink consumption condition is measured on the basis of this setting (Step S1214). When ink end is not judged from the measured result (Step S1216), the ink consumption condition is measured continuously (Step S1214), and when ink end is judged (Step S1216), the low level ink processing operation is performed, and the process ends (Step S1218).

Further, at Steps S1204 and S1212, the measuring frequencies of the piezo-electric device are changed. Generally, the measuring frequency of the piezo-electric device itself attached to a small module body as shown in FIG. 5 may be changed. However, the piezo-electric device may be mounted and controlled as shown below.

When a plurality of piezo-electric devices are mounted perpendicularly to the side wall of the ink container, the mounting intervals of the piezo-electric devices are narrowed from upper side to lower side of the side wall. Particularly at the part less than the ink residue in the neighborhood of the measuring position level, the mounting intervals are preferably narrowed. By doing this, the measuring frequency can be automatically increased in correspondence to ink consumption. Further, when a piezo-electric device extending long in the vertical direction is to be used, by changing the measuring frequency of the piezo-electric device itself, the ink consumption condition can be measured continuously.

In the aforementioned process, the counting of ink drops is turned OFF at Step S1212. However, to execute more proper measurement, the measurement on the basis of calculation of the ink consumption may be continued. However, in the measuring method using both of measurement on the basis of calculation of the ink consumption after the ink residue passes the neighborhood of the measuring position level and measurement by the piezo-electric device, final judgment of ink end on the basis of any one of the measured results can be set freely. Further, the piezo-electric device may be controlled so as to judge on the basis of both measured results.

From the aforementioned, when the ink residue is much, the measured result by the piezo-electric device is reflected on the measurement on the basis of calculation of the ink consumption, thus proper ink residue measurement can be executed. Further, after the ink residue is reduced below the amount in the neighborhood of the measuring position level, the measuring frequency of the piezo-electric device is increased and the ink residue is measured, thus ink end can be detected at proper timing.

Figure 35:
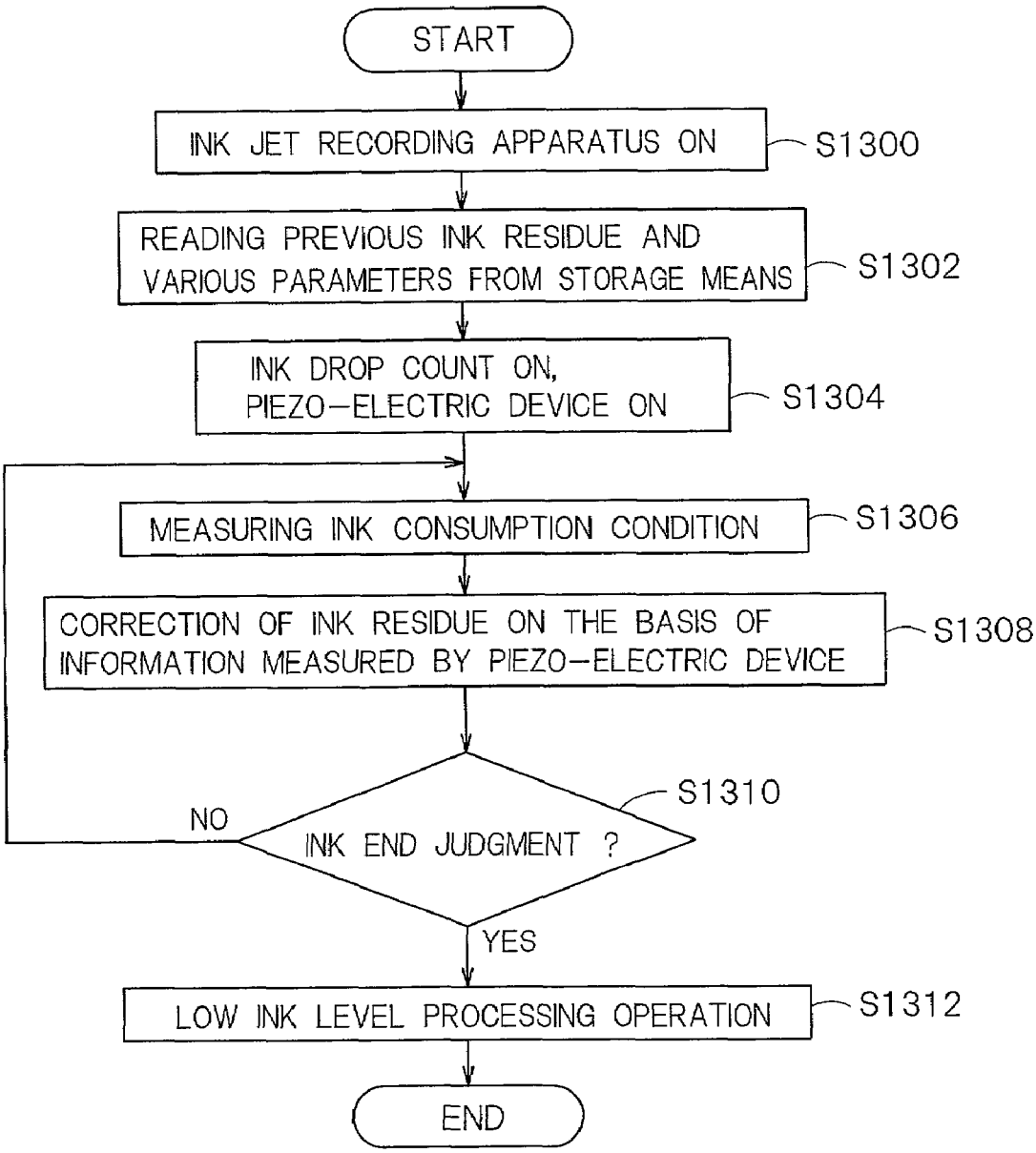
FIG. 35 is a drawing showing still another process flow of the ink consumption condition detection method in an embodiment of the present invention.

FIG. 35 is a drawing showing still another process flow of the measuring method for ink consumption condition combining the measuring method on the basis of calculation of the ink consumption and the measuring method using the piezo-electric device. In this process, unlike FIGS. 33 and 34, the measuring method on the basis of calculation of the ink consumption is a main measuring method. The process flow will be explained hereunder.

The switch of the ink jet recording apparatus is turned ON (Step S1300). The ink residue in the ink container and various parameters necessary for measurement are read from the storage means such as the semiconductor storage means 1300 shown in FIG. 32 (Step S1302). Next, to measure the ink consumption condition on the basis of calculation of the ink consumption used in this embodiment, counting of ink drops is started and, at the same time, measurement by the piezo-electric device such as the actuator is also started (Step S1304).

The ink consumption condition is measured on the basis of this setting (Step S1306). Among the measured results of the ink consumption condition, the value of ink residue calculated on the basis of calculation of the ink consumption is corrected on the basis of the information measured by the piezo-electric device (Step S1308). Furthermore, various parameter values for controlling the printer operation may be corrected.

When ink end is not judged (Step S1310), the ink consumption condition is measured continuously (Step S1306), and when ink end is judged (Step S1310), the low level ink processing operation is performed, and the process ends (Step S1312). The low level ink processing operation is an operation for informing a user of the ink jet recording apparatus of ink end after calculation of a predetermined ink consumption and it includes, for example, operations for displaying ink end on the display unit 1400 shown in FIG. 32, stopping the ink jet recording apparatus after printing a predetermined number of papers, and ringing a warning sound. Further, to prevent defective printing such as ink end during printing, it is preferable to judge ink end in a state that a properly small amount of ink remains.

From the aforementioned, the ink residue is corrected on the basis of the measurement information of the piezo-electric device and the measurement on the basis of calculation of the ink consumption is executed, thus a difference between the calculated value and the actual value which is caused by factors such as changes in the ink characteristics due to the use environment of the ink jet recording apparatus can be reduced and the ink consumption condition can be measured properly. Further, at Step S1304, the measuring frequency of the piezo-electric device can be set freely. However, when the error of the measurement on the basis of calculation of the ink consumption is large, it is desirable to increase the measuring frequency.

Figure 36:
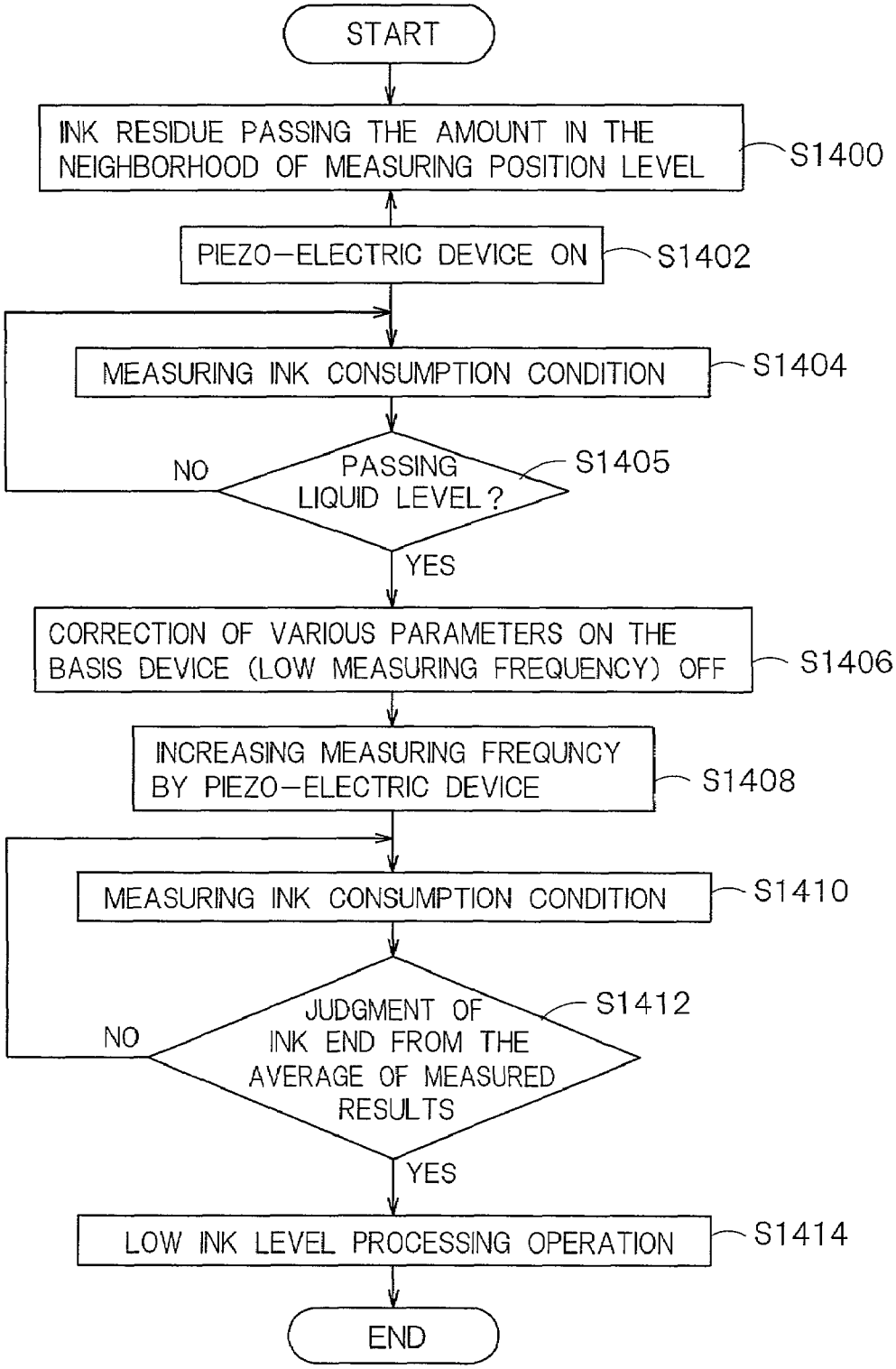
FIG. 36 is a drawing showing another process flow according to an embodiment of the present invention after the ink residue passes the amount in the neighborhood of the measuring position level.

FIG. 36 is a drawing showing another process flow of the measuring method after the ink residue passes the amount in the neighborhood of the measuring position level. The process to be explained hereunder may be applied to the process after the ink residue passes the amount in the neighborhood of the measuring position level shown in FIGS. 32 and 33.

The ink consumption condition is measured and after the ink residue passes the amount in the neighborhood of the measuring position level, the piezo-electric device is turned ON (Step S1402). The measurement before the ink residue reaches the amount in the neighborhood of the measuring position level may be either of the measurement on the basis of calculation of the ink consumption and the measurement using the piezo-electric device or both of them.

Next, the ink consumption condition is measured using the piezo-electric device (Step S1404). As a result of ink consumption condition measurement, when passing of the liquid level is not measured (Step S1405), the ink consumption condition is measured continuously (Step S1404). On the other hand, when passing of the liquid level is measured (Step S1405), the process goes to Step S1406. Further, the measurement of passing of the liquid level is not limited to passing of the liquid level measured first and several times of passing of the liquid level may be set. Further, when a plurality of piezo-electric devices are mounted, the piezo-electric device to be used for judging passing of the liquid level can be set freely.

At Step S1406, on the basis of the measured result information obtained at the time of measurement of passing of the liquid level by the piezo-electric device, various parameters for controlling the printer operation are corrected (Step S1406).

In this case, various parameters indicate a parameter for accurately displaying the ink residue, a parameter of the suction amount of the maintenance processing operation, and a parameter of the ink jet amount. By correcting the various parameters, when the ink residue reduces in amount, the suction amount of the maintenance processing operation can be reduced and the ink amount for one ink drop can be reduced.

Next, the ink consumption condition is measured using the corrected various parameters and the measuring frequency of the ink consumption condition is increased (Step S1408). The measurement of the ink consumption condition is continued on the basis of this setting (Step S1408). Finally, from the average of measured results, that is, the mean count of "presence" of ink or "absence" of ink, ink end is judged (Step S1412). For example, when eight times are measured as "absence" of ink and two times are measured as "presence" of ink among the ten times of measurement, "absence" of ink is judged.

When ink end is not judged at Step S1412, the ink consumption condition is measured continuously (Step S1410). On the other hand, when ink end is judged at Step S1412, the low level ink processing operation is performed and the process ends (Step S1414).

Further, in the aforementioned process, after passing of the liquid level is measured at Step S1405, various parameters are corrected only once at Step S1406. However, various parameters may be corrected every measurement of passing of the liquid level.

As mentioned above, when the ink residue passes the amount in the neighborhood of the measuring position level and approaches ink end, various parameters are corrected from the measured result information of the piezo-electric device such as the actuator and the measuring frequency is further set high, thus the ink end can be detected without losing the timing.

The present invention is explained above using the embodiments. However, the technical scope of the present invention is not limited to the scope described in the aforementioned embodiments. In the aforementioned embodiments, various changes or improvements may be added. It is clear from the claims that any embodiment with various changes or improvements added is included in the technical scope of the present invention.

According to the present invention, the ink consumption condition is detected in the non-recording state of the recording head, so that the ink residue can be decided free of a reduction in the throughput. Further, the present invention can detect the ink residue in a state that ink in the ink cartridge as an ink container does not vibrate, so that the ink residue can be detected accurately. Further, the present invention can measure the ink consumption free of noise generated when the carriage driving motor and the motor for driving the recording head are driven, so that the ink consumption can be detected accurately.

According to the present invention, even when the piezo-electric device detects absence of ink in the ink container, the presence of ink remaining in the ink container is detected and the residual ink can be used effectively.

According to the present invention, the measuring timing of the ink consumption condition in the ink container, particularly in the ink cartridge loaded in the ink jet recording apparatus is controlled on the basis of the operation history of the ink jet recording apparatus, so that the ink consumption condition can be measured properly.

According to the present invention, the ink consumption condition in the ink container, particularly in the ink cartridge loaded in the ink jet recording apparatus can be measured using the measuring method combining the measuring method on the basis of calculation of the ink consumption jetted from the recording head and the measuring method using the piezo-electric device, so that the ink residue is measured properly and the ink end can be detected.

INDUSTRIAL APPLICABILITY

The present invention can be used to detect the ink consumption condition in the ink container used in the ink jet recording apparatus.

The invention claimed is:

1. An ink consumption condition detection method for detecting an ink consumption condition in an ink container loaded in an ink jet recording apparatus having a recording head for jetting ink drops, wherein said ink consumption condition in said ink container is detected using a piezo-electric device having a piezo-electric element during a non-recording state of said recording head, wherein said piezo-electric device further has a vibrating plate on one side of which said piezoelectric element is arranged, and a cavity forming member having a cavity which is arranged on the other side of said vibrating plate, wherein said piezo-electric element of said piezo-electric device has a vibration part, and said piezo-electric device outputs a signal indicating a residual vibration state of said vibration part under free vibration, wherein said vibration part of said piezo-electric element contacts with an ink in said ink container via said cavity, said cavity defining an area of said vibration part, wherein said ink consumption condition is detected based on a change of said residual vibrating state of said vibration part under free vibration corresponding to ink being consumed, and wherein said piezo-electric device measures a periodic peak value of a waveform of counter electromotive force generated by residual vibration remaining in said vibration part by a predetermined number of said periodic peak values from a predetermined point of time, and said piezo-electric device measures more number of said periodic peak values than said predetermined number of said periodic peak values in subsequent detection of said ink consumption condition, and thereby detects said ink consumption condition.

2. An ink consumption condition detection method according to claim 1, wherein said periodic peak value of said waveform of counter electromotive force is measured by increasing said predetermined number of values from said predetermined point of time in accordance with increasing of a detection count of said ink consumption condition in the ink container, and thereby said ink consumption condition is detected.

3. An ink consumption condition detection method according to claim 1, wherein said ink jet recording apparatus or said ink container has a storage memory, and said storage memory stores a measurement history of said ink consumption condition of said piezo-electric device.

* * * * *